US010531777B2

(12) United States Patent
Hwang et al.

(10) Patent No.: US 10,531,777 B2
(45) Date of Patent: Jan. 14, 2020

(54) CLEANER

(71) Applicant: LG ELECTRONICS INC., Seoul (KR)

(72) Inventors: Philjae Hwang, Seoul (KR); Eunji Sung, Seoul (KR); Taekgi Lee, Seoul (KR); Mantae Hwang, Seoul (KR); Jungbae Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 120 days.

(21) Appl. No.: 15/652,898

(22) Filed: Jul. 18, 2017

(65) Prior Publication Data

US 2018/0055320 A1 Mar. 1, 2018

(30) Foreign Application Priority Data

Aug. 25, 2016 (KR) ..... 10-2016-0108315
Dec. 30, 2016 (KR) ..... 10-2016-0183823

(51) Int. Cl.
*A47L 9/28* (2006.01)
*A47L 9/16* (2006.01)
*A47L 9/32* (2006.01)

(52) U.S. Cl.
CPC ..... *A47L 9/2842* (2013.01); *A47L 9/1608* (2013.01); *A47L 9/1633* (2013.01); *A47L 9/1641* (2013.01); *A47L 9/1683* (2013.01); *A47L 9/2857* (2013.01); *A47L 9/2884* (2013.01); *A47L 9/32* (2013.01)

(58) Field of Classification Search
CPC ..... A47L 9/2842; A47L 5/24; A47L 9/1608; A47L 9/1633; A47L 9/1641; A47L 9/1666; A47L 9/1683; A47L 9/22; A47L 9/28; A47L 9/2857; A47L 9/2884; A47L 9/32; A47L 9/322
See application file for complete search history.

(56) References Cited

U.S. PATENT DOCUMENTS 3,533,119 A * 10/1970 Dokos ..... A61C 17/3418 15/22.1
7,414,211 B2 8/2008 Elsworthy
8,925,145 B2 1/2015 Wilson
2008/0083601 A1 4/2008 Elsworthy
(Continued)

FOREIGN PATENT DOCUMENTS

CN 1726857 2/2006
JP 2016067459 5/2016
(Continued)

OTHER PUBLICATIONS

International Search Report in International Application No. PCT/KR2017/006441, dated Aug. 30, 2017, 3 pages (with partial English translation).

(Continued)

*Primary Examiner* — Robert J Scruggs
(74) *Attorney, Agent, or Firm* — Fish & Richardson P.C.

(57) ABSTRACT

A cleaner includes: a suction unit that guides dust and air; a main body that includes a dust separation unit for separating dust from air guided through the suction unit; a main body terminal mounted on the main body; a handle unit that is slide-coupled to the main body; and a handle terminal mounted on the handle unit and is connected to the main body terminal when the handle unit is slide-coupled to the main body.

23 Claims, 58 Drawing Sheets

(56) References Cited

U.S. PATENT DOCUMENTS

| | | | | |
|---|---|---|---|---|
| 2008/0104793 | A1 | 5/2008 | Kang et al. | |
| 2008/0105278 | A1 | 5/2008 | Kang et al. | |
| 2008/0172821 | A1 | 7/2008 | Kang et al. | |
| 2009/0265877 | A1 | 10/2009 | Dyson et al. | |
| 2010/0050357 | A1* | 3/2010 | Misner | A46B 15/0002 15/167.1 |
| 2014/0196245 | A1* | 7/2014 | Liter | A47L 9/2842 15/339 |
| 2015/0059118 | A1* | 3/2015 | Lim | A47L 5/225 15/329 |
| 2016/0029864 | A1 | 2/2016 | Lim et al. | |
| 2017/0290481 | A1* | 10/2017 | Conrad | A47L 5/24 |

FOREIGN PATENT DOCUMENTS

| | | | |
|---|---|---|---|
| KR | 100762323 | | 9/2007 |
| KR | 10-1127088 | | 4/2009 |
| KR | 10-2016-0015622 | | 2/2016 |
| KR | 10-2016-0034041 | * | 3/2016 |
| KR | 2016067459 | | 5/2016 |
| KR | 101649250 | | 8/2016 |
| WO | WO2008041207 | | 4/2008 |

OTHER PUBLICATIONS

Extended European Search Report in European Application No. 17843791.9, dated May 31, 2019, 7 pages.

* cited by examiner

CLEANER

CROSS-REFERENCE TO RELATED APPLICATIONS

This application claims priority under 35 U.S.C. § 119 to Korean Patent Application No. 10-2016-0108315, filed in Korea on Aug. 25, 2016, and Korean Patent Application No. 10-2016-0183823, filed in Korea on Dec. 30, 2016, whose entire disclosure is hereby incorporated by reference.

BACKGROUND

The present disclosure relates to a cleaner.

Cleaners may be classified into a manual cleaner that a user moves in person for cleaning and an automatic cleaner that automatically moves for cleaning.

Manual cleaners may fall into, depending on the types, a canister cleaner, an upright cleaner, a handy cleaner, and a stick cleaner.

Handy cleaners, generally, may include a suction unit, a body, and a handle.

An extension pipe having a suction nozzle may be connected to the suction unit. Further, a battery for supplying power may be disposed in the handle.

When the suction nozzle includes a cleaning unit for sweeping carpets and a motor for rotating the cleaning unit, the motor is supposed to be supplied with power from the battery.

In order to supply power to the motor from the battery in the handle, the battery should be connected with the motor through a power supply wire and a control signal wire. The wires are connected to the suction unit through the body.

A PCB for controlling the motor may be disposed in the body or the handle.

However, handy cleaners are small in volume in comparison to other cleaners, so it is difficult to combine the PCB and connect the wires in the assembly process.

Meanwhile, in the related art, a handheld vacuum cleaner has been disclosed in Korean Patent No. 10-1127088 (registered on 8 Mar. 2012).

SUMMARY

The present disclosure provides a cleaner that can be easily assembled.

The present disclosure provides a cleaner of which terminals can be connected in the process of assembling the cleaner without a user connecting the terminals.

The present disclosure provides a cleaner of which terminals can be reduced in size by separating a wire for supplying power and a wire for transmitting control signals from each other.

A cleaner includes: a suction unit that guides dust and air; a main body that includes a dust separation unit for separating dust from air guided through the suction unit; a main body terminal that is mounted on the main body; a handle unit that is slide-coupled to the main body; and a handle terminal that is mounted on the handle unit and is connected to the main body terminal when the handle unit is slide-coupled to the main body.

A cleaner includes: a suction unit that guides air and dust; a main body including a suction motor generating suction force to suck air through the suction unit; a main body terminal that is mounted on the main body and connected with the suction motor through wires; a handle unit that is coupled to the main body; a battery that is separately connected to the handle unit to supply power to the suction motor; and a handle terminal that is mounted on the handle unit, connected with the battery, and mechanically connected with the main body terminal when the handle unit is coupled to the main body.

DETAILED DESCRIPTION OF THE EMBODIMENTS

Figure 1:
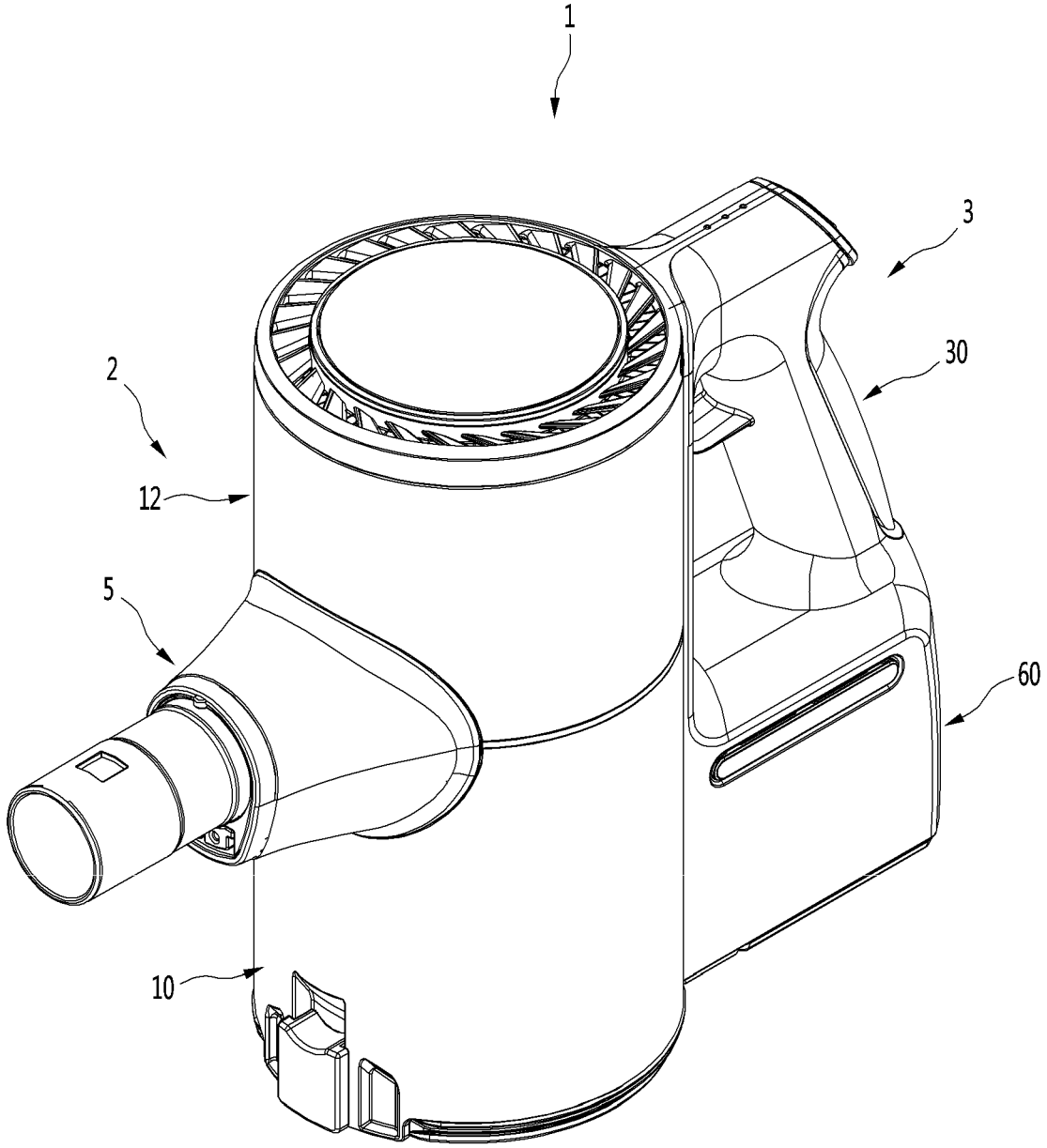
FIG. 1 is a perspective view of a cleaner according to an embodiment of the present invention.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
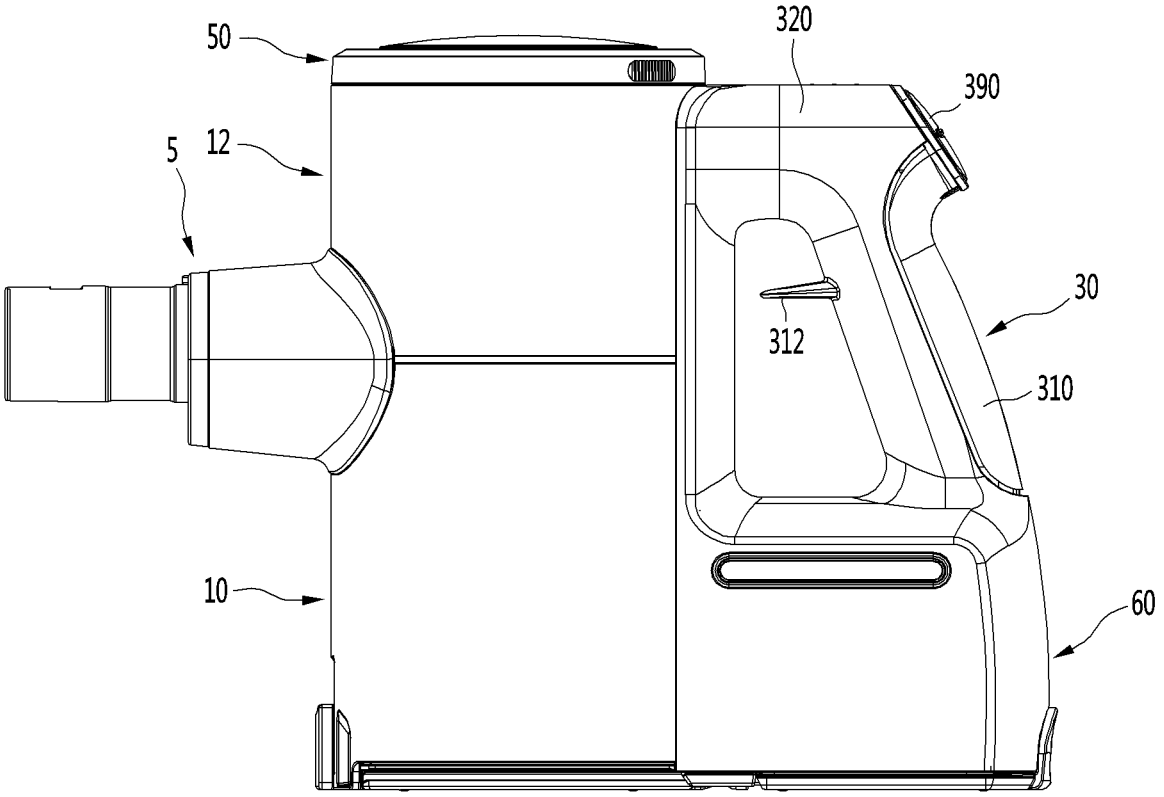
FIG. 2 is a side view of the cleaner according to an embodiment of the present invention.
Figure 3:
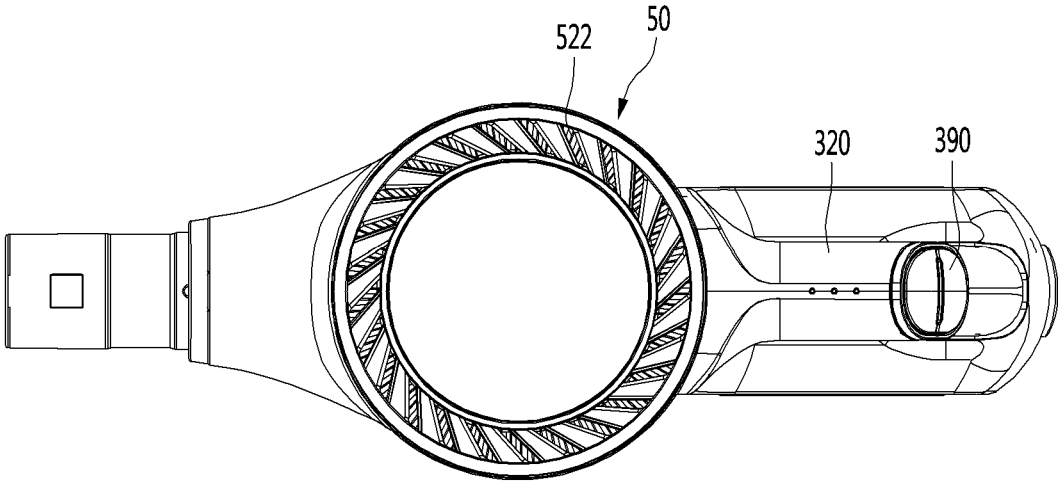
FIG. 3 is a plan view of the cleaner according to an embodiment of the present invention.
Figure 4:
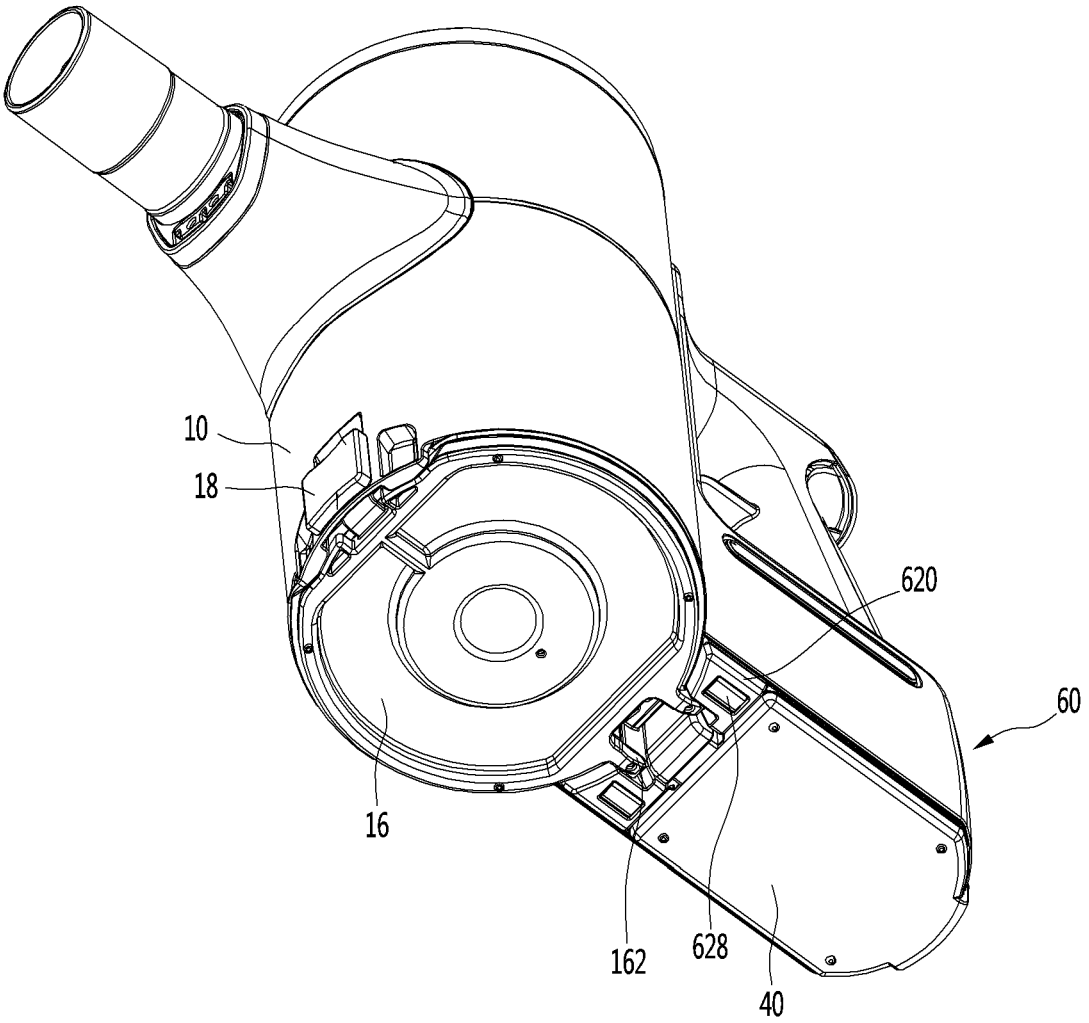
FIG. 4 is a perspective view of the cleaner according to an embodiment of the present invention when seen from under the cleaner.
Figure 5:
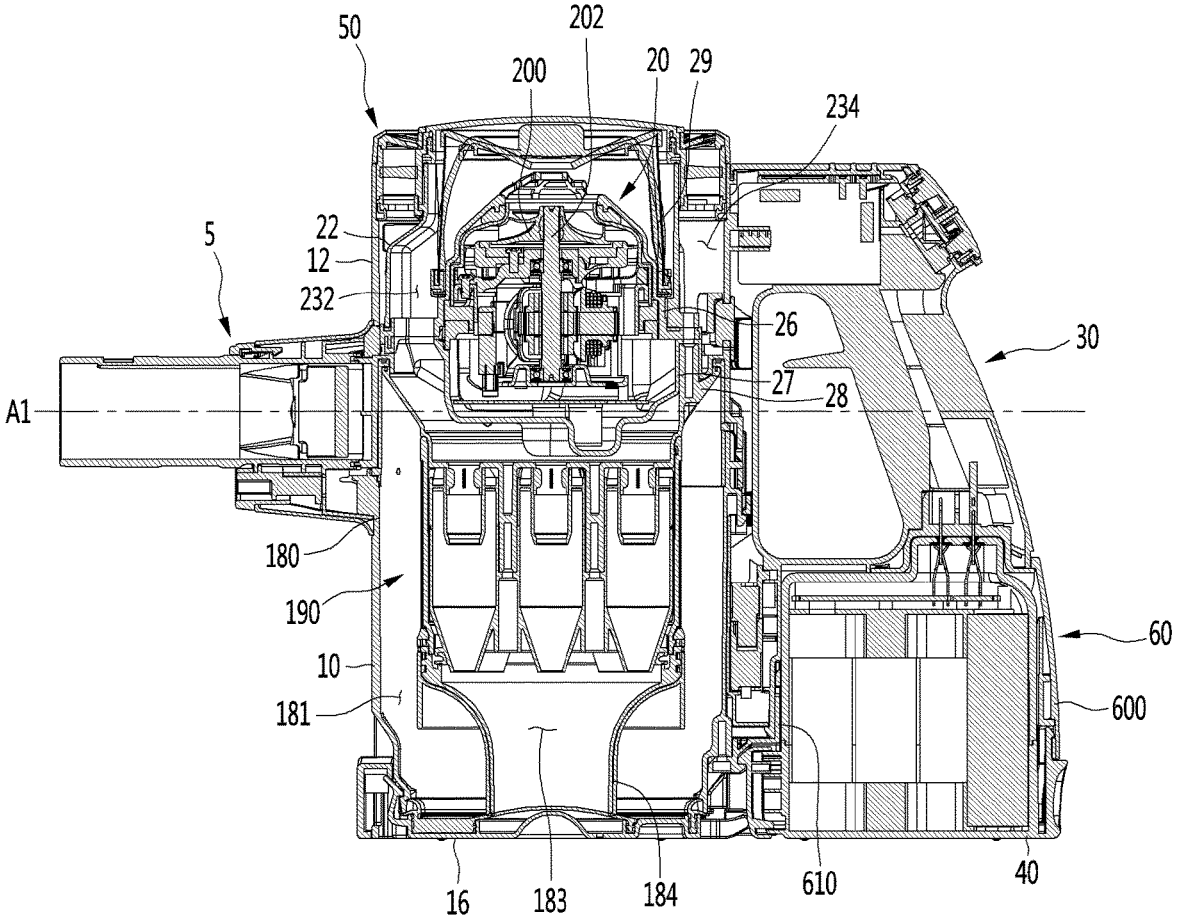
FIG. 5 is a cross-sectional view of the cleaner according to an embodiment of the present invention.

FIG. 1 is a perspective view of a cleaner according to an embodiment of the present invention, FIG. 2 is a side view of the cleaner according to an embodiment of the present invention, FIG. 3 is a plan view of the cleaner according to an embodiment of the present invention, FIG. 4 is a perspective view of the cleaner according to an embodiment of the present invention when seen from under the cleaner, and FIG. 5 is a cross-sectional view of the cleaner according to an embodiment of the present invention.

Referring to FIGS. 1 to 5, a cleaner 1 according to an embodiment of the present invention may include a main body 2.

The cleaner 1 may further include a suction unit 5 coupled to the front of the main body 2. The suction unit 5 can guide air containing dust into the main body 2.

The cleaner 1 may further include a handle unit 3 coupled to the main body 2. The handle unit 3 may be positioned opposite to the suction unit 5 on the main body 2.

That is, the main body 2 may be disposed between the suction unit 5 and the handle unit 3.

The main body 2 may include a first body 10 and a second body 12 on the first body 10.

The first body 10 and the second body 12 may be, though not limited thereto, formed in a cylindrical shape.

The suction unit 5 may be coupled to the main body 2 such that the center of the suction unit 5 is positioned approximately at the boundary between the first body 10 and the second body 12.

The main body 2 may further include a dust separation unit that separates dust from air sucked through the suction unit 5.

The dust separation unit may include a first cyclone unit 180 that can separate dust, for example, using cyclonic flow. The first body 10 includes the first cyclone unit 180 in this configuration.

The air and dust sucked through the suction unit 5 helically flow along the inner side of the first cyclone unit 180.

The axis of the cyclonic flow in the first cyclone unit 180 may vertically extend.

The dust separation unit may further include a second cyclone unit 190 that secondarily separates dust from the air discharged out of the first cyclone unit 180. The second cyclone unit 190 may be disposed inside the first cyclone unit 180 to minimize the size of the dust separation unit. The second cyclone unit 190 may include a plurality of cyclone bodies arranged in a raw.

As another example, the dust separation unit may include one cyclone unit, in which the axis of the cyclonic flow may also vertically extend.

The first body 10 functions as a dust container that stores dust separated by the cyclone units 180 and 190. That is, the first body 10 includes the first cyclone unit 180 and the dust container. The upper part of the first body 10 is the first cyclone unit 180 and the lower part of the first body 10 is the dust container. The first body 10 may be partially or entirely transparent or translucent to enable a user to visually check the amount of dust in the dust container.

The main body 2 may further include a body cover 16 for opening/closing the bottom of the first body 10. The body cover 16 can open/close the first body 10 by being rotated.

At least a portion of the second cyclone unit 190 may be positioned inside the first body 10.

A dust storage guide 184 that guides the dust separated by the second cyclone unit 190 to be stored may be disposed in the first body 10. The dust storage guide 184 may be coupled to the bottom of the second cyclone unit 190 in contact with the top of the body cover 16.

The dust storage guide 184 may divide the internal space of the first body 10 into a first dust storage part 181 where the dust separated by the first cyclone unit 180 is stored and a second dust storage part 183 where the dust separated by the second cyclone unit 190 is stored.

The internal space of the dust storage guide 184 is the second dust storage part 183 and the space between the dust storage guide 184 and the first body 10 is the first dust storage part 181.

The body cover 16 can open/close both of the first dust storage part 181 and the second dust storage part 183.

The cleaner 1 may further include a suction motor 20 for generating suction force and a battery 40 for supplying power to the suction motor 20.

The suction motor 20 may be disposed in the second body 12. At least a portion of the suction motor 20 may be disposed over the dust separation unit. Accordingly, the suction motor 20 is disposed over the first body 10.

The suction motor 20 may communicate with an outlet of the second cyclone unit 190.

To this end, the main body 2 may further include a discharge guide 28 connected to the second cyclone unit 190 and a flow guide 22 that communicates with the discharge guide 28.

For example, the discharge guide 28 is disposed on the second cyclone unit 190 and the flow guide 22 is disposed over the discharge guide 28.

Further, at least a portion of the suction motor 20 is positioned inside the flow guide 22.

Accordingly, the axis of the cyclonic flow in the first cyclone unit 180 may pass through the suction motor 20.

When the suction motor 20 is disposed over the second cyclone unit 190, the air discharged from the second cyclone unit 190 can flow directly to the suction motor 20, so the channel between the dust separation unit and the suction motor 20 can be minimized.

The suction motor 20 may include a rotary impeller 200. The impeller 200 may be fitted on a shaft 202. The shaft 202 is vertically disposed.

An extension line from the shaft 202 (which may be considered as the rotational axis of the impeller 200) may pass through the first body 10. The rotational axis of the impeller 200 and the axis of the cyclonic flow in the first cyclone unit 180 may be on the same line.

According to the present invention, there is the advantage that the path through which the air discharged from the dust separation unit, that is, the air discharged upward from the second cyclone unit 190 flows to the suction motor 20 can be reduced and a change in direction of air can be decreased, so a loss of airflow can be reduced.

As the loss of airflow is reduced, suction force can be increased and the lifetime of the battery 40 for supplying power to the suction motor 20 can be increased.

The cleaner 1 may further include an upper motor housing 26 covering a portion of the top of the suction motor 20 and a lower motor housing 27 covering a portion of the bottom of the suction motor 20. The lower motor housing 27 may be integrally formed with the second body 12 or may be coupled to the second body 12.

The suction motor 20 may be disposed inside the motor housings 26 and 27 and the flow guide 22 may be disposed to cover the upper motor housing 26.

At least a portion of the flow guide 22 may be spaced apart from the upper motor housing 26. Further, at least a portion of the flow guide 22 may be spaced apart from the second body 12.

Accordingly, a first air passage 232 is defined by the inner side of the flow guide 22 and the outer side of the upper motor housing 26 and a second air passage 234 is defined by the outer side of the flow guide 22 and the inner side of the second body 12.

The air discharged from the second cyclone unit 190 flows to the suction motor 20 through the first air passage 232 and the air discharged from the suction motor 20 flows through the second air passage 234 and is then discharged outside. Accordingly, the second air passage 234 functions as an exhaust channel.

The handle unit 3 may include a handle 30 for a user to hold and a battery housing 60 under the handle 30.

The handle 30 may be disposed behind the suction motor 20.

As for directions, with respect to the suction motor 20 in the cleaner 1, the direction in which the suction unit 5 is positioned is the front direction and the direction in which the handle 30 is positioned is the rear direction.

The battery 40 may be disposed behind the first body 10. Accordingly, the suction motor 20 and the battery 40 may be arranged not to vertically overlap each other and may be disposed at different heights.

According to the present invention, since the suction motor 20 that is heavy is disposed ahead of the handle 30 and the battery 40 that is heavy is disposed behind the handle 30, so weight can be uniformly distributed throughout the cleaner 1. It is possible to prevent injuries to the user's wrist when a user cleans with the handle 30 in his/her hand. That is, since the heavy components are distributed at the front and rear portions and at different heights in the cleaner 1, it is possible to prevent the center of gravity of the cleaner 1 from concentrating on any one side.

Since the battery 40 is disposed under the handle 30 and the suction motor 20 is disposed in front of the handle 30, there is no component over the handle 30. That is, the top of the handle 30 forms a portion of the external appearance of the top of the cleaner 1.

Accordingly, it is possible to prevent any component of the cleaner 1 from coming in contact with the user's arm while the user cleans with the handle 30 in his/her hand.

The handle 30 may include a first extension 310 extending vertically to be held by a user and a second extension 320 extending toward the suction motor 20 over the first extension 310. The second extension 320 may at least partially horizontally extend.

A stopper 312 for preventing a user's hand holding the first extension 310 from moving in the longitudinal direction of the first extension 310 (vertically in FIG. 2) may be formed on the first extension 310. The stopper 312 may extend toward the suction unit 5 from the first extension 310.

The stopper 312 is spaced apart from the second extension 320. Accordingly, a user is supposed to hold the first extension 310, with some of the fingers over the stopper 312 and the other fingers under the stopper 312.

For example, the stopper 312 may be positioned between the index finger and the middle finger.

According to this arrangement, when a user holds the first extension 310, the longitudinal axis A1 of the suction unit 5 may pass through the user's wrist.

When the longitudinal axis A1 of the suction unit 5 passes through the user's wrist and the user's arm is stretched, the longitudinal axis A1 of the suction unit 5 may be substantially aligned with the user's stretched arm. Accordingly, there is the advantage in this state that the user uses minimum force when pushing or pulling the cleaner 1 with the handle 30 in his/her hand.

The handle 30 may include an operation unit 390. For example, the operation unit 390 may be disposed on an inclined surface of the second extension 320. It is possible to input instructions to turn on/off the cleaner (suction motor) through the operation unit 390.

The operation unit 390 may be disposed to face a user. The operation unit 390 may be disposed opposite to the stopper 312 with the handle 30 therebetween.

The operation unit 390 is positioned higher than the stopper 312. Accordingly, a user can easily operate the operation unit 390 with his/her thumb with the first extension 310 in his/her hand.

Further, since the operation unit 390 is positioned outside the first extension 310, it is possible to prevent the operation unit 390 from being unexpectedly operated when a user cleans with the first extension 310 in his/her hand.

The battery housing 60 may be disposed under the first extension 310.

The battery 40 may be detachably combined with the battery housing 60. For example, the battery 40 may be inserted into the battery housing 60 from under the battery housing 60.

The rear side of the battery housing 60 and the rear side of the first extension 310 may form a continuous surface. Accordingly, the battery housing 60 and the first extension 310 can be shown like a single unit.

When the battery 40 is inserted in the battery housing 60, the bottom of the battery 40 may be exposed to the outside. Accordingly, when the cleaner 1 is placed on the floor, the battery 40 can be in contact with the floor.

According to this structure, there is the advantage that the battery 40 can be directly separated from the battery housing 60.

Further, since the bottom of the battery 40 is exposed to the outside, the bottom of the battery 40 can come in direct contact with the air outside the cleaner 1, so the battery 40 can be more efficiently cooled.

The battery housing 60 may include an outer housing 600 and an inner housing 610. The inner housing 610 may be inserted under the outer housing 600.

The inner housing 610 may be fixed to one or more of the outer housing 600 and the first body 10. Further, the battery 40 may be coupled to the inner housing 610.

According to the present invention, the inner housing 610 is inserted into the outer housing 600 and then the battery 40 is inserted to be coupled to the inner housing 610, so it is possible to prevent the outer housing 600 from deforming or to prevent the outer housing 600 from being damaged when inserting or separating the battery 40.

The inner housing 610 may include charging stand connection terminals 628 for charging the battery 40 coupled to the inner housing 610. It is possible to bring the charging stand connection terminals 628 in contact with terminals of a charging stand (not shown) by placing the cleaner 1 on the charging stand.

The battery housing 60 may include battery connection terminals 670 that are connected to battery terminals 490 in the battery 40 inserted in the battery housing 60. The battery connection terminals 670 may be connected to the battery terminals 490 through the top of the battery 40.

Obviously, it may be possible to integrally form the inner housing 610 with the outer housing 600 without separately forming the inner housing 610.

The inner housing 610 may include a pair of hinge coupling portions 620 to which a hinge 162 of the body cover 16 is coupled. The hinge coupling portions 620 may be spaced at a predetermined distance from each other.

Referring to FIG. 3, the cleaner 1 may further include a filter unit 50 having air exits 522 for discharging the air that has passed through the suction motor 20. For example, the air exits 522 may include a plurality of openings and the openings may be circumferentially arranged.

The filter unit 50 may be detachably coupled to the top of the main body 2. The filter unit 50 may be detachably inserted in the second body 12.

When the filter unit 50 is combined with the main body 2, a portion of the filter unit 50 is positioned outside the second body 12. Accordingly, a portion of the filter unit 50 is inserted in the main body 2 through the open top of the main body 2 and the other portion protrudes outside from the main body 2.

The height of the main body 2 may be substantially the same as the height of the handle 30. Accordingly, the filter unit 50 protrudes upward from the main body 2, so a user can easily hold and separate the filter unit 50.

When the filter unit 50 is combined with the main body 2, the air exits 522 are positioned at the upper portion of the filter unit 50. Accordingly, the air discharged from the suction motor 20 is discharged upward from the main body 2.

According to this embodiment, it is possible to prevent the air discharged from the air exits 522 from flowing to a user while the user cleans using the cleaner 1.

The main body 2 may further include a pre-filter 29 for filtering the air flowing into the suction motor 20. The pre-filter 29 may be disposed inside the flow guide 22. Further, the pre-filter 29 is seated over the upper motor housing 16 and may surround a portion of the upper motor housing 26. That is, the upper motor housing 26 may include a filter support for supporting the pre-filter 29.

Figure 6:
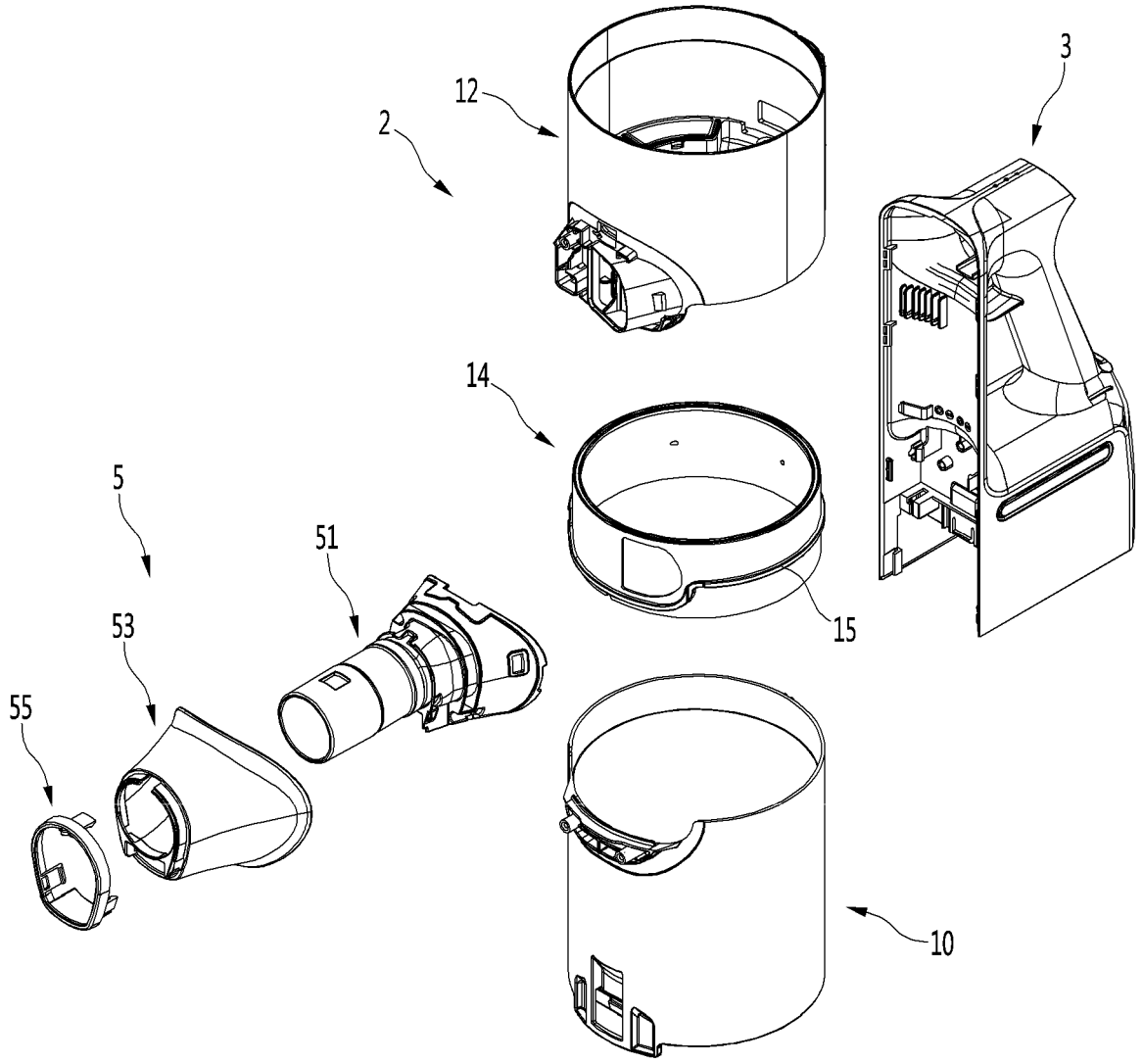
FIG. 6 is an exploded perspective view of the cleaner according to an embodiment of the present invention.
Figure 7:
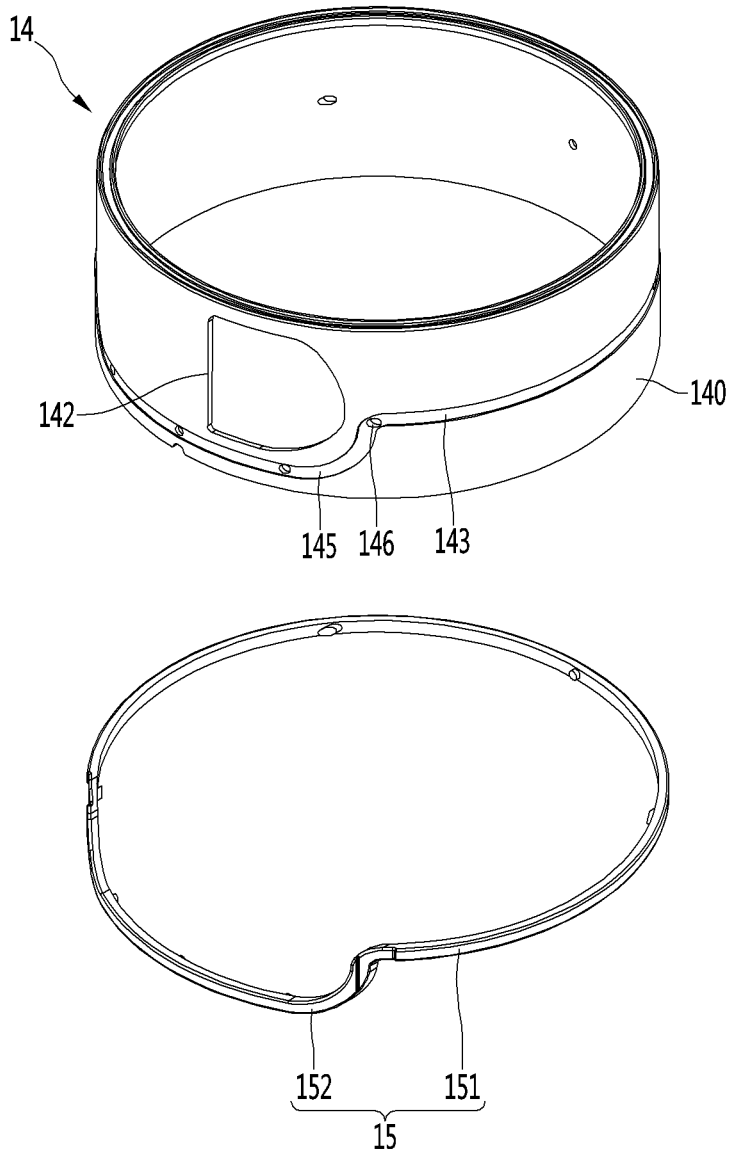
FIG. 7 is a view showing a support body and a sealing member according to an embodiment of the present invention.

FIG. 6 is an exploded perspective view of the cleaner according to an embodiment of the present invention and FIG. 7 is a view showing a support body and a sealing member according to an embodiment of the present invention.

Referring to FIGS. 5 to 7, the main body 2 may be disposed between the suction unit 5 and the handle unit 3. The first body 10 and the second body 12 may be, for example, vertically arranged.

The cleaner 1 may further include a sealing member 15 and a support body 14 supporting the sealing member 15 to seal the boundary between the first body 10 and the second body 12 that have been combined.

The first body 10 and the second body 12 may be open at the top and the bottom, respectively. That is, the bodies 10 and 12 may include a top opening and a bottom opening, respectively.

The support body 14 may be formed in a cylindrical shape. The outer diameter of the support body 14 may be made the same as or smaller than the inner diameter of the first body 10 so that the support body 14 can be inserted into the first body 10 through the top opening of the first body 10.

Further, the outer diameter of the support body 14 may be made the same as or smaller than the inner diameter of the second body 12 so that the support body 14 can be inserted into the second body 12 through the bottom opening of the second body 12.

The support body 14 may include an opening 142.

The sealing member 15 may be fitted around the support body 14. For example, the sealing member 15 may be integrally formed with the support body 14 through injection molding. Alternatively, the sealing member 15 may be attached to the outer side of the support body 14 through an adhesive.

The support body 14 may include a first seating groove 143 extending around the support body 14 and a second seating groove 145 extending from the first seating groove 143 at a different height from the first seating groove 143.

The sealing member 15 can be seated in the seating grooves 143 and 145.

The first seating groove 143 may be formed at a position that approximately bisects the height of the support body 14. The second seating groove 145 bypasses the opening 142. For example, the second seating groove 145 is positioned under the opening 142.

Accordingly, the sealing member 15 may include a first section 151 that is seated in the first seating groove 143 and a second section 152 that continues from the first section 151 and is seated in the second seating groove 145.

When the sealing member 15 is seated in the seating grooves 143 and 145, a portion of the sealing member 15 may protrude from the support body 14. Since the sealing member 15 fitted on the support body 14 protrudes from the support body 14, the sealing member 15 can be positioned at the boundary between the first body 10 and the second body 12 even though the support body 14 is inserted in the first body 10 and the second body 12, whereby sealing is possible.

Fixing holes 146 where portions of the sealing member 15 are positioned are formed in the seating grooves 143 and 145. As portions of the sealing member 15 are inserted in the fixing holes 146, the sealing member 15 can be prevented from rotating circumferentially around the support body 14.

The suction unit 5 may include a pipe 51 that is connected to the main body 2, a pipe cover 53 that covers the pipe 51, and a cover deco-member 55 that surrounds a portion of the pipe cover 53 to be coupled to the pipe 51.

Figure 8:
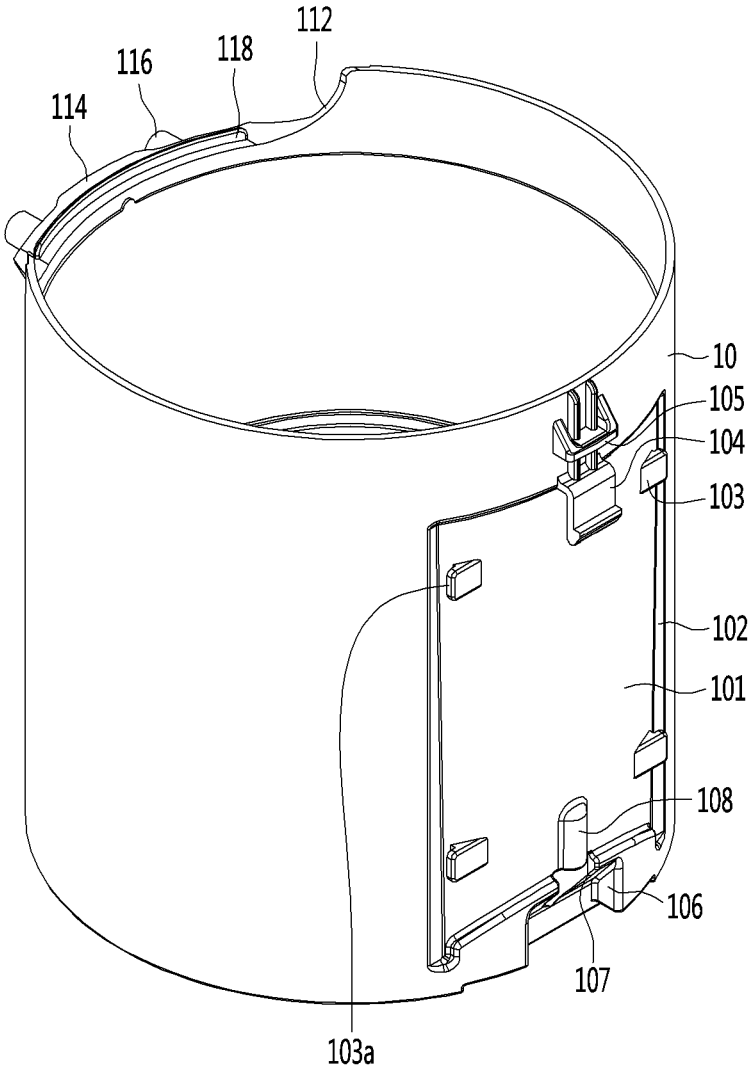
FIG. 8 is a perspective view of a first body according to an embodiment of the present invention.
Figure 9:
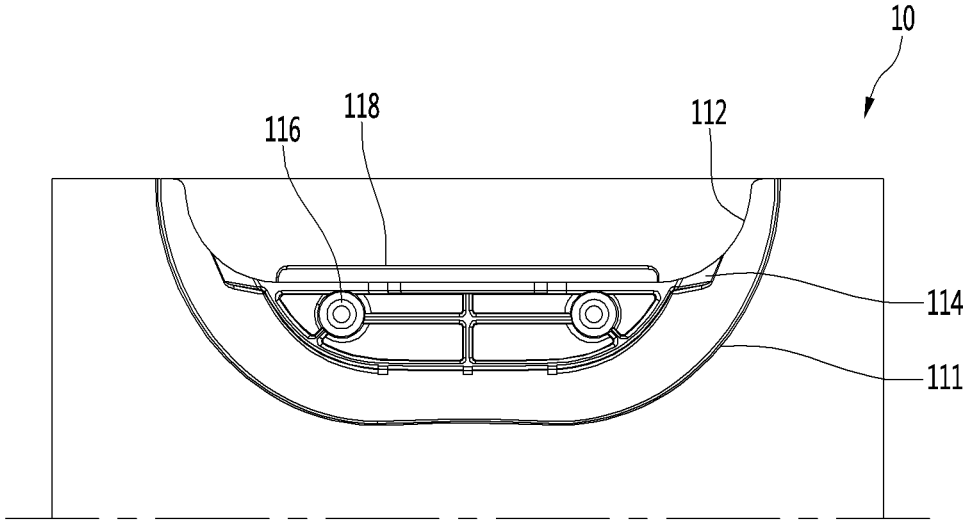
FIG. 9 is a front view of the first body shown in FIG. 8.

FIG. 8 is a perspective view of the first body according to an embodiment of the present invention and FIG. 9 is a front view of the first body shown in FIG. 8.

Referring to FIGS. 8 and 9, the first body 10 may include a recessed contact surface on the outer side. A cover member 70 (see FIG. 25) may be seated on the recessed contact surface.

The contact surface may include a rounded first contact surface 101 and flat second contact surfaces 102 at both sides of the first contact surface 101.

Figure 25:
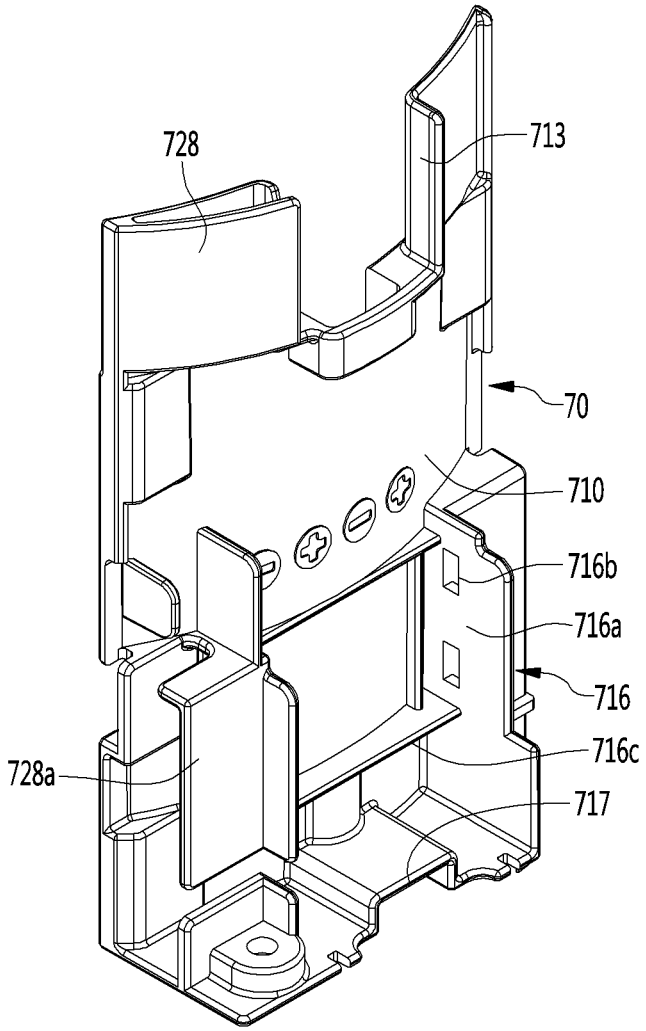
FIGS. 25 and 26 are perspective views of a cover member according to an embodiment of the present invention.

The first body 10 may further include a cover coupling hook 104 for coupling the cover member 70 (see FIG. 25).

The first body 10 may further include a first coupling portion 105 to be combined with the second body 12.

The first coupling portion 105 may protrude from the outer side of the first body 10 and the top of the first coupling portion 105 may be inclined downward for easy combination with the second body 12.

The first coupling portion 105 may be disposed at a predetermined distance downward from the upper end of the first body 10. The first body 10 may include one or more reinforcing ribs for preventing damage to the first coupling portion 105.

The cover coupling hook 104 may be disposed at a predetermined distance under the first coupling portion 105. The cover coupling hook 104 may extend downward under the first coupling portion 105.

Since the second contact surfaces 102 are disposed at both sides of the first contact surface 101, it is possible to prevent the cover member 70 (see FIG. 25) coupled to the first body 10 from horizontally rotating around the first body 10.

The first body 10 may include one or more locking ribs 103 for maintaining the cover member 70 (see FIG. 25) stably coupled.

For example, the first body 10 may include a plurality of locking ribs 103 to prevent up-down and left-right movement of the cover member 70 (see FIG. 25).

The locking ribs 103 may protrude from the first contact surface 101 of the first body 10 and may be horizontally and vertically spaced apart from each other.

For example, two horizontally spaced locking ribs 103 may extend away from each other.

Ends **103*a* of at least some of the locking ribs 103 may be arranged to face the second contact surfaces 102 at a predetermined distance from the second contact surfaces 102. That is, spaces may be defined between the ends 103*a* of the locking ribs 103 and the second contact surfaces 102**.

The first body 10 may further include a housing fastening portion 108 to be fastened to the inner housing 610. A fastener such as a screw may be coupled to the housing fastening portion 108.

In order that the fastener can be coupled to the housing fastening portion 108, a portion of the housing fastening portion 108 may protrude outward from the first body 10 and the other portion may protrude inward from the first body 10. For example, the housing fastening portion 108 may protrude outward and inward from the first contact surface 101.

The housing fastening portion 108 may vertically extend so that the fastener can be vertically coupled to the housing fastening portion 108.

The housing fastening portion 108 may be spaced upward from the lower end of the first body 10.

Accordingly, the first body 10 may further include a recession 106 that provides a space for movement of a fastener and a guide groove 107 that guides the fastener in the recession so that the fastener can be coupled to the housing fastening portion 108.

A first recession 111 that is recessed inward may be formed at the upper portion of the first body 10.

A body receiving part 112 that provides a space for holding a portion of the second body 12 may be formed at the first recession 111.

The body receiving part 112 may be formed by cutting downward the upper end of the first body 10.

The first body 10 may further include a pipe coupling portion 114 (or a suction unit coupling portion) for coupling the pipe 51. The pipe coupling portion 114 may protrude from the first body 10 under the body receiving part 112.

The pipe coupling portion 114 may include one or more main body fastening bosses 116 to which fasteners are coupled.

The sealing member 15 may be seated on the body receiving part 112. In detail, the second section 152 of the sealing member 15 may be seated on the body receiving part 112.

A stopper rib 118 that prevents the second section 152 seated on the body receiving part 112 from moving away from the support body 14 may be disposed on the top of the pipe coupling portion 114. Since the second section 152 of the sealing member 15 is rounded, the stopper rib 118 may be rounded to come in contact with the second section 152 of the sealing member 15.

Accordingly, the first section 151 of the sealing member 15 can be seated on the upper end of the first body 10 and the second section 152 of the sealing member 15 can be seated on the body receiving part 112.

The pipe coupling portion 114 on the first recession 111 may be covered by the pipe 51.

Figure 10:
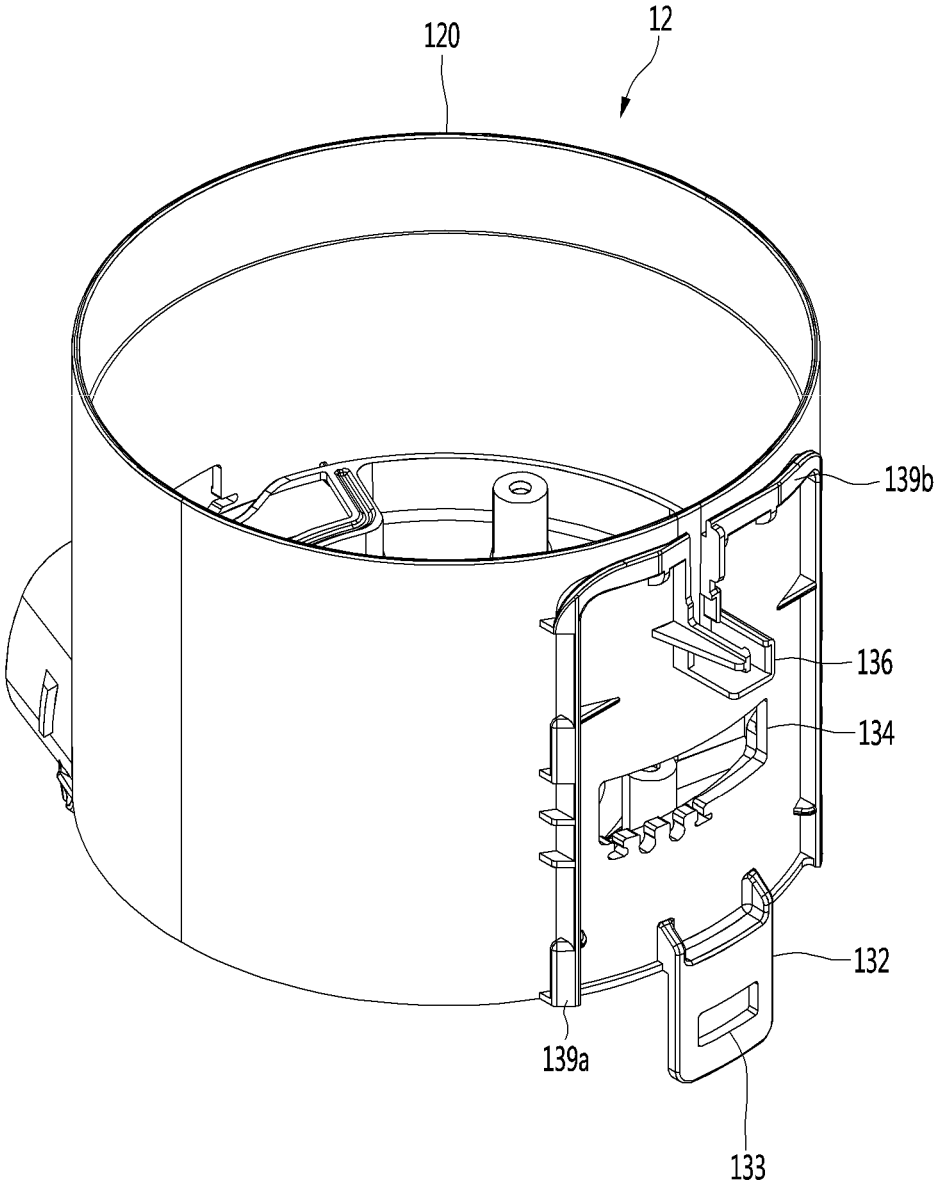
FIG. 10 is a perspective view of a second body according to an embodiment of the present invention.
Figure 11:
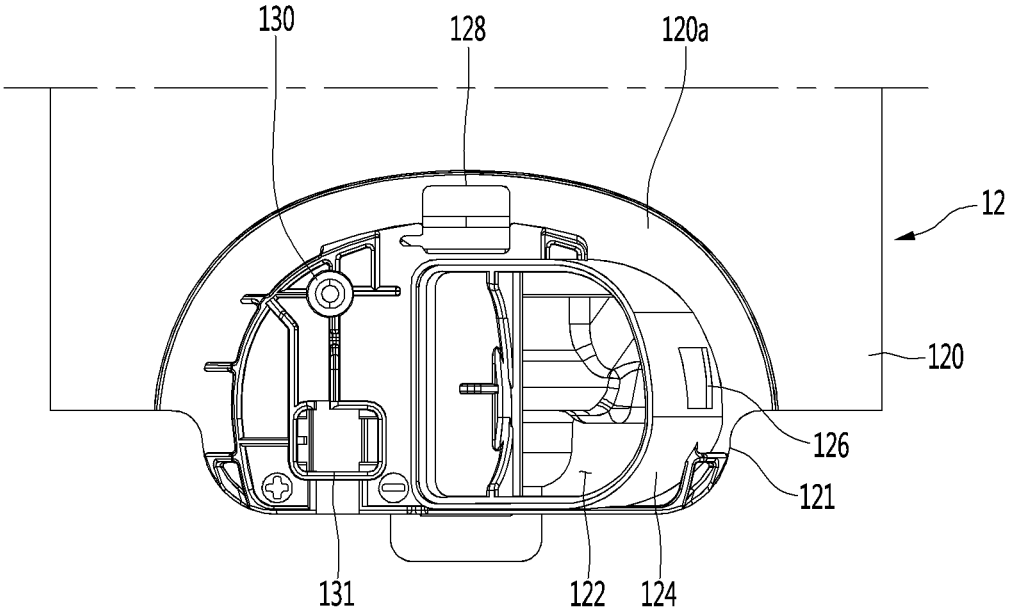
FIG. 11 is a front view of the second body according to an embodiment of the present invention.

FIG. 10 is a perspective view of the second body according to an embodiment of the present invention. FIG. 11 is a front view of the second body according to an embodiment of the present invention.

Referring to FIGS. 10 and 11, the second body 12 may include a cylindrical part 120. A second recession 120*a* that is recessed inward may be formed at a lower portion of the cylindrical part 120.

The second body 12 may further include an extension 121 that extends downward from the lower end of the second recession 120*a* of the cylindrical part 120.

The extension 121 may be formed in a shape corresponding to the body receiving part 112 of the first body 10. The extension 121 may be positioned on the body receiving part 112 of the first body 10 and seated on the second section 152 of the sealing member 15.

The second body 12 may include a suction opening 122 through which the air guided through the suction unit 5 flows inside.

The suction opening 122 may be formed at the cylindrical part 120 and the extension 121 inside the recession 120*a*.

The reason that the extension 121 extends downward from the cylindrical part 120 and a portion of the suction opening 122 is formed at the extension 121 is for positioning the suction unit 5 around the middle of the height of the main body 2 without a large difference in height between the first body 10 and the second body 12.

According to this structure, the longitudinal axis A1 of the suction unit 5 can be positioned between the suction motor 20 and the second cyclone unit 190.

If the longitudinal axis A1 of the suction unit 5 passes through the suction motor 20, there is a need for a channel for guiding air to the first cyclone unit 180 around the suction motor 20 and the diameter of the main body 2 is accordingly increased.

However, the lower the longitudinal axis A1 of the suction unit 5, the smaller the height of the first cyclone unit 180, so the ability to separate dust is deteriorated.

Therefore, according to the present invention, since the longitudinal axis A1 of the suction unit 5 is positioned between the suction motor 20 and the second cyclone unit 190, it is possible to maintain the ability to separate dust and prevent the diameter or the size of the main body 2 from increasing.

The second body 12 may further include a suction guide 124 for guiding air to the suction opening 122. The suction guide 124 may tangentially protrude from the second body 12.

A locking protrusion 126 for locking the pipe 51 may be formed on the suction guide 124.

Further, the second body 12 may include a main body fastening boss 130 for fastening the pipe 51 using a fastener.

Further, the second body 12 may include a terminal mount 131 for mounting a first terminal 139 for electrical connection with the pipe 51 and a wire hole 128 through which a main body wire passes. The wire hole 128 may be covered with a packing (not shown) and the main body wire may pass through the packing. When a suction nozzle connected to the end of an extension pipe connected to the suction unit 5 has a driving unit, the first terminal 139 functions as a terminal for supplying power to the driving unit.

Alternatively, a nozzle having the driving unit may be connected directly to the suction unit 5, in which the driving unit of the suction nozzle can also be supplied with power from the battery 40 through the suction unit terminal.

When the pipe 51 is coupled to the main body fastening boss 130, the suction opening 122, the suction guide 124, the main body fastening boss 130, the terminal mount 131, and the wire hole 128 inside the second recession 120*a* are covered with the pipe 51.

The second body 12 may further include a second coupling portion 132 extending downward from the second body 12 on the opposite side to the suction opening 122.

A coupling hole 133 in which the first coupling portion 105 of the first body 10 is inserted may be formed on the second coupling portion 132.

Further, the second body 12 may include a wire hole 134 through which a main body wire for supplying power to the suction motor 20 passes. The wire hole 134 may be covered with a packing 138 (see FIG. 13) and the main body wire may pass through the packing 138 (see FIG. 13).

The second body 12 may further include a connector support 136. The connector support 136 may be disposed above the wire hole 134.

The second body 12 may include a first handle coupling portion for fastening the handle unit 3. The first handle coupling portion may include first rib coupling portions 139*a* and second rib coupling portions 139*b*.

For example, the second body 12 may include a plurality of vertically spaced first rib coupling portions 139*a*. Alternatively, the second body 12 may include a plurality of horizontally spaced first rib coupling portions 139*a*.

Alternatively, the second body 12 may include a plurality of first rib coupling portions 139*a* that is spaced horizontally and in a left-right direction.

The first rib coupling portions 139*a* may horizontally extend from the second body 12 and then bend upward. Accordingly, a space may be defined between some of the first rib coupling portions 139*a* and the second body 12. Therefore, a portion of the handle unit 3 may be positioned in the space when the handle 3 is moved downward.

Figure 12:
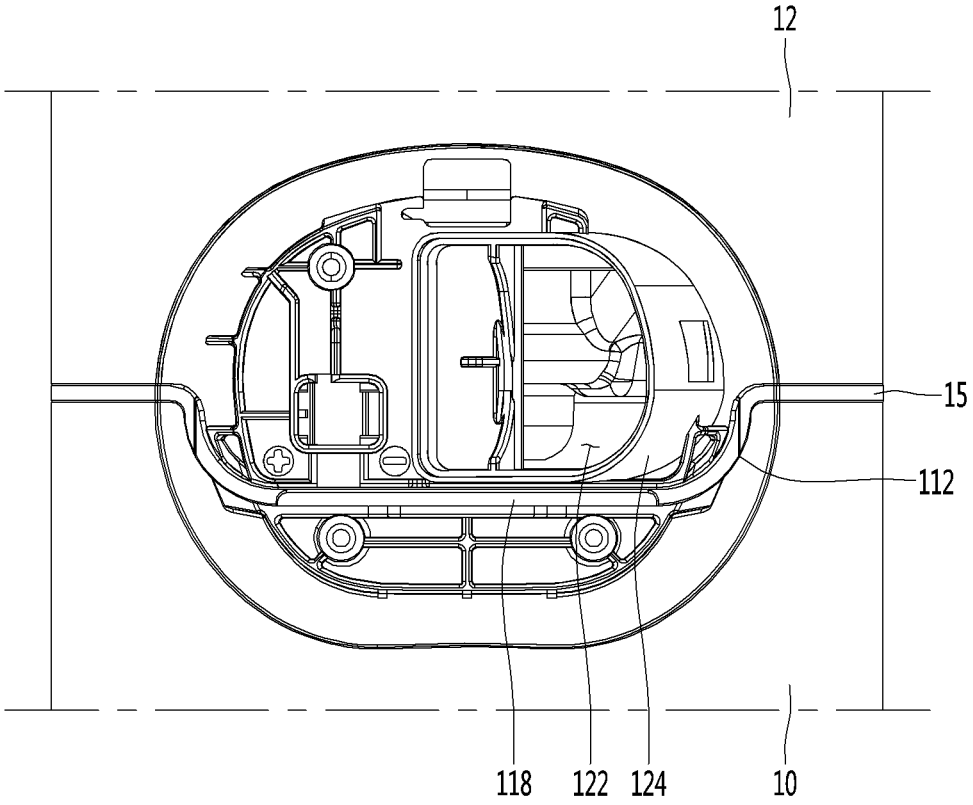
FIG. 12 is a front view of a main body formed by combining the first body and the second body with each other.
Figure 13:
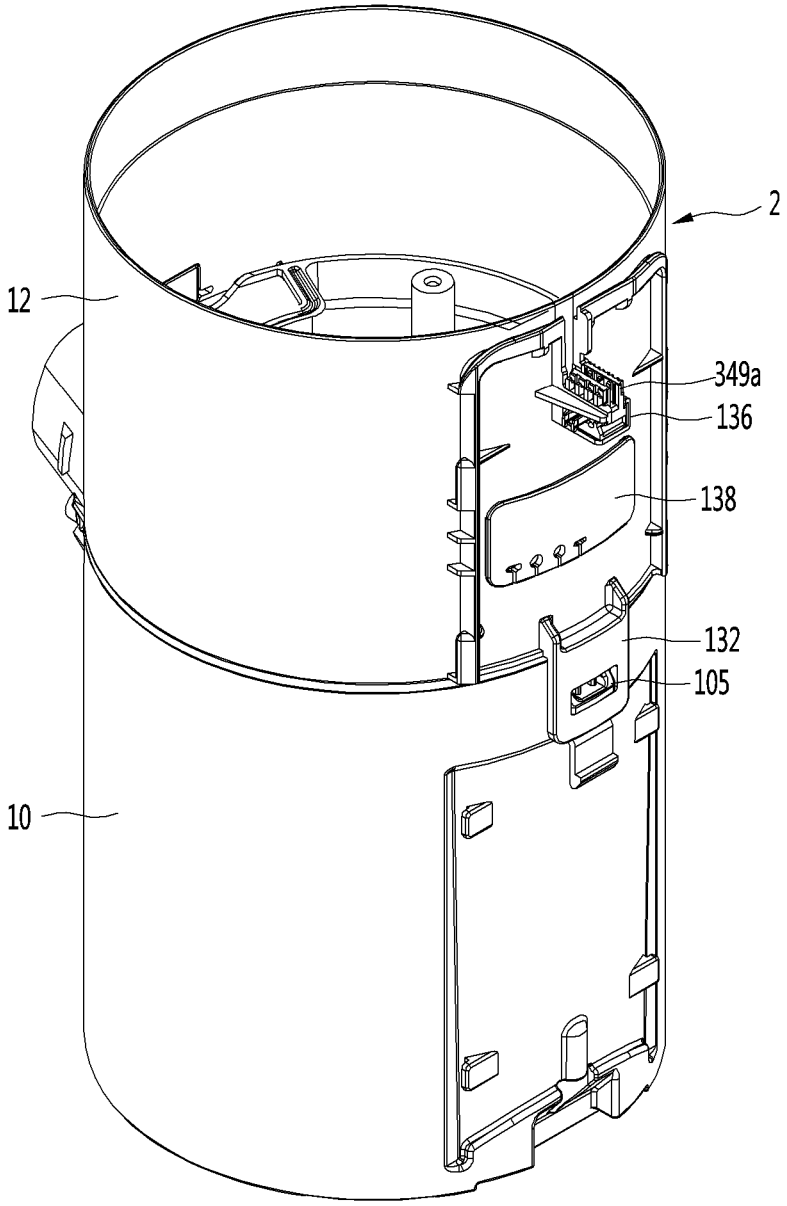
FIG. 13 is a rear perspective view of the main body formed by combining the first body and the second body with each other.

FIG. 12 is a front view of the main body formed by combining the first body and the second body with each other and FIG. 13 is a rear perspective view of the main body formed by combining the first body and the second body with each other.

Referring to FIGS. 6 to 13, in a stated in which the sealing member 15 combined with the support body 14, a lower portion of the support body 14 that is disposed under the sealing member 15 can be inserted into the first body 10.

Accordingly, the first section 151 of the sealing member 15 is seated on the upper end of the first body 10 and the second section 152 of the sealing member 15 is seated on the body receiving part 112 of the first body 10.

Then, the second body 12 is coupled to the first body 10 from above the first body 10.

Accordingly, a portion of the support body 14 that is disposed above the sealing member 15 is inserted in the second body 12 and the second coupling portion 132 of the second body 12 is coupled to the first coupling portion 105 of the first body 10.

Further, the lower end of the second body 12 is seated on the sealing member 15. When the second body 12 is coupled to the first body 10, the second body 12 and the first body 10 press the sealing member 15.

When the second coupling portion 132 is coupled to the first coupling portion 105, the second coupling portion 132 is positioned outside the sealing member 15. Accordingly, it is possible to prevent a portion of the sealing member 15 from separating outward from the support body 14.

Further, when the second body 12 is coupled to the first body 10, the suction opening 122 of the second body 12 and the opening 142 of the support body 14 are aligned.

After the first body 10 and the second body 12 are combined, the suction unit 5 can be coupled to both of the first body 10 and the second body 12.

According to this embodiment, since the first body 10 that provides a storage space and the second body 12 that receives the suction motor 20 are separately manufactured and then combined with each other, the structures of the bodies can be simple.

Further, according to the present invention, since the sealing member 15 is disposed at the boundary between the first body 10 and the second body 12 when the first body 10 and the second body 12 are combined, sealing can be maintained.

Before or after the first body 10 and the second body 12 are combined, a connecting terminal 349*a* may be mounted on the connector support 136 and the wire hole 134 may be covered with the packing 138. The connecting terminal 349*a* may include a signal terminal for transmitting control signals to the suction motor 20.

Figure 14:
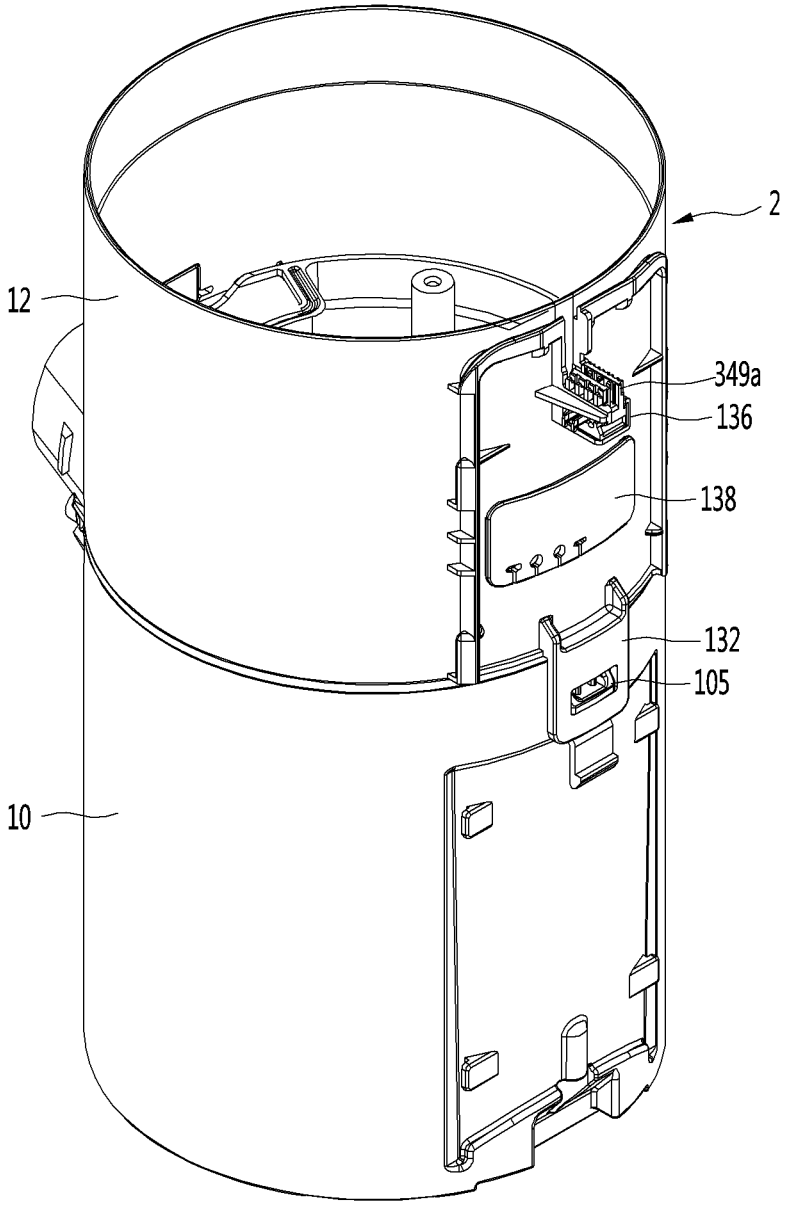
FIG. 14 is a perspective view of a suction unit according to an embodiment of the present invention.
Figure 15:
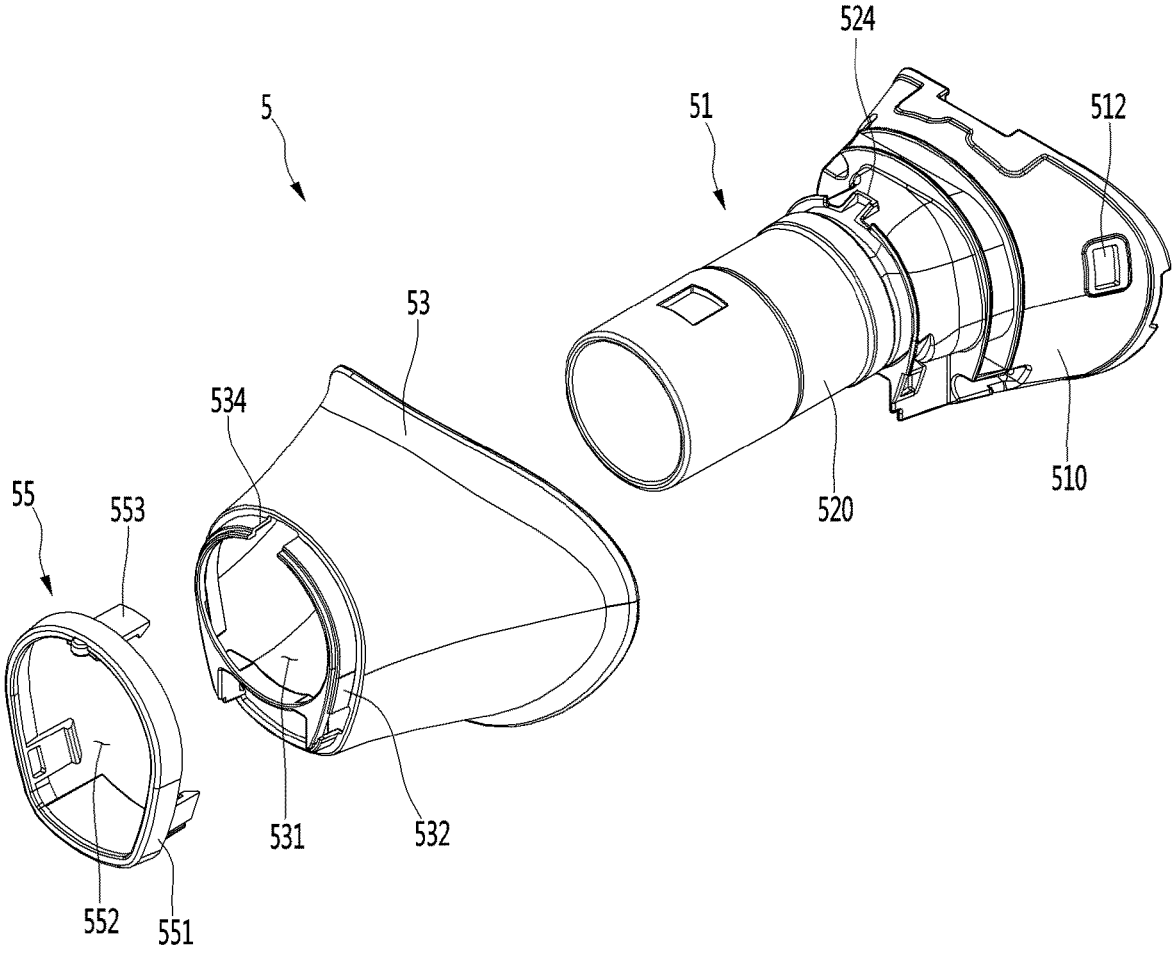
FIG. 15 is an exploded perspective view of the suction unit according to an embodiment of the present invention.
Figure 16:
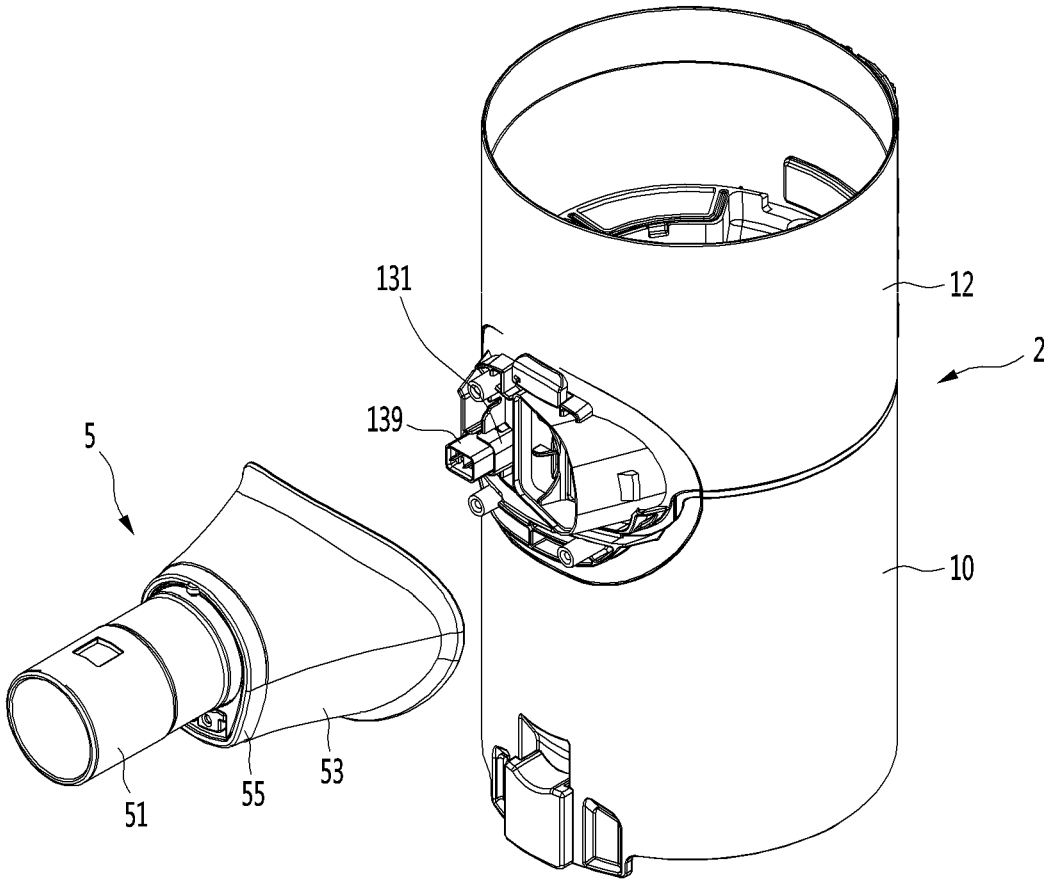
FIG. 16 is a view when the suction unit of the present invention is coupled to the main body.

FIG. 14 is a perspective view of the suction unit according to an embodiment of the present invention, FIG. 15 is an exploded perspective view of the suction unit according to an embodiment of the present invention, and FIG. 16 is a view when the suction unit of the present invention is coupled to the main body.

Referring to FIGS. 6 to 15, the pipe 51 may include a main body connecting portion 510 to be coupled to the main body 2 and a guide pipe 520 extending from the main body connecting portion 510 to guide air to the main body 2.

Though not shown in the guide pipe 520, an extension pipe connected to a suction nozzle can be coupled to the guide pipe. Alternatively, a suction nozzle may be coupled directly to the guide pipe 520.

The main body connecting portion 510 may include a guide duct 514 that communicates with the guide pipe 520 to guide airflow. An insertion groove 515 for fitting the end of the suction guide 124 may be formed on the edge of the guide duct 514.

The guide duct 514 may include an opening and closing part 526. The opening and closing part 526 may be rotatably connected to the guide duct 514.

The opening and closing part 526 connects the guide duct 514 and the suction opening 122 when the suction motor 20 is turned on, and disconnects the guide duct 514 and the suction opening 122 when the suction motor 20 is turned off.

An elastic member (not shown) may be connected to a hinge shaft of the guide duct 514. When the suction motor 20 is turned off, the opening and closing part 526 disconnects the guide duct 514 and the suction opening 122 by elasticity of the elastic member (not shown).

When the opening and closing part 526 disconnects the guide duct 514 and the suction opening 122, the dust in the dust container cannot be discharged outside through the guide duct 514 even if the cleaner 1 is turned upside down.

The main body connecting portion 510 may include a terminal mount 517 for mounting a second terminal 528 for electrical connection with the main body 2.

The main body connecting portion 510 may further include pipe fastening bosses 516 for coupling to the main body fastening bosses 116 and 130 of the bodies 10 and 12.

The main body connecting portion 510 may further include a locking hole 512 for locking the locking protrusion 126 of the suction guide 124.

In order to couple the pipe 51 to the main body 2, first, the pipe 51 is placed ahead of the main body 2 and then horizontally moved such that the locking protrusion 126 is locked into the locking hole 512 of the main body connecting portion 510. Accordingly, the suction guide 124 is inserted into the insertion groove 515 of the suction duct 514, and the main body fastening bosses 116 and 130 and the pipe fastening bosses 516 can be aligned.

The pipe 51 can be fixed to the main body 2 by coupling fasteners to the fastening bosses 516 and the main body fastening bosses 116 and 130 from ahead of the pipe 51.

Further, the second terminal 528 in the pipe 51 is electrically connected to the first terminal 139 in the second body 12. That is, according to the present invention, the terminals can be naturally connected when the pipe 51 is coupled to the main body 2 without a user connecting the terminals in person, so convenience for the user can be improved. In the present invention, the first terminal 139 and the second terminal 528 may be considered as terminals for a suction nozzle.

An anti-interference groove 518 may be formed on the pipe 51 to prevent interference between the pipe 51 and the second section 152 of the sealing member 15, with the pipe 51 fixed to the main body 2.

The pipe cover 53 may be placed in position to cover the pipe 51 after the pipe 51 is coupled to the main body 2.

The pipe cover 53 may include a hole 531 for passing the guide pipe 520. A mounting portion 532 for mounting the cover deco-member 55 is formed around the hole 531 of the pipe cover 53. Further, slots 534 for passing the hooks 553 of the cover deco-member 55 may be formed at the mounting portion 532.

The cover deco-member 55 may include a body 551 with a hole 552 for passing the guide pipe 520 and the hooks 553 extending from the body 551.

When the cover deco-member 55 is fitted on the mounting portion 532 with the pipe 51 covered by the pipe cover 53, the hooks 553 of the cover deco-member 55 are locked to hook locking protrusions 524 of the guide pipe 520.

When the cover deco-member 55 is fitted on the pipe 51, the edge of the pipe cover 53 comes in contact with the end of the first recession 101 of the first body 10 and the second recession 120*a* of the second body 12.

With the pipe 51 covered with the pipe cover 53, the first section 151 of the sealing member 15 is exposed to the outside, while the second section 152 is not exposed to the outside. That is, the suction unit 5 covers a portion of the boundary between the bodies 10 and 12.

The direction in which the suction unit 5 is coupled to the main body 2 may be referred to as a first coupling direction. The first coupling direction may be the horizontal direction.

Figure 17:
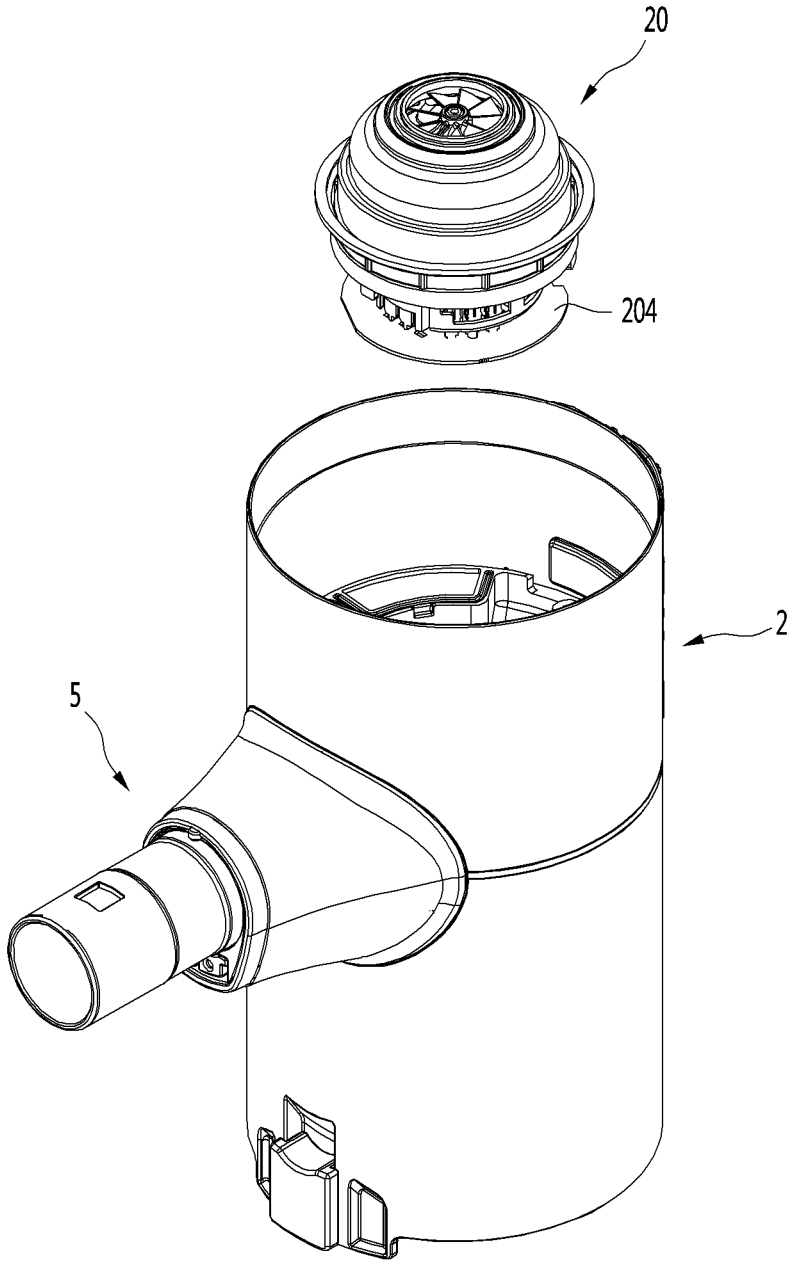
FIG. 17 is a view when a suction motor according to an embodiment of the present invention is inserted into the main body.

FIG. 17 is a view when the suction motor according to an embodiment of the present invention is inserted into the main body.

Referring to FIGS. 5 and 17, the suction motor 20 can be inserted into the main body 2 through the open top of the main body 2, with the suction unit 5 coupled to the main body 2.

The maximum diameter of the suction motor 20 may be smaller than the open top of the main body 2 in order to insert the suction motor 20 into the main body 2 through the open top of the main body 2.

A motor control substrate 204 may be coupled to the bottom of the suction motor 20, with the impeller 200 of the suction motor 20 facing up.

The suction motor 20 can be inserted into the main body 2, with the motor control substrate 204 coupled to the bottom of the suction motor 20. The motor control substrate 204 may be coupled to the bottom of the suction motor 20.

The maximum diameter of the motor control substrate 204 may be smaller than the open top of the main body 2 in order to insert the motor control substrate 204 into the main body 2 through the open top of the main body 2.

The suction motor 20 may be seated on the lower motor housing 27 described with reference to FIG. 5.

If the lower motor housing 27 is integrally formed with the second body 12, the suction motor 20 can be directly seated on the lower motor housing 27. However, when the lower motor housing 27 is formed separately from the second body 12, the suction motor 20 can be seated on the lower motor housing 27 after the lower motor housing 27 is first coupled to the second body 12.

The suction motor 20 may be seated on the lower motor housing 27, with the motor control substrate 205 and a portion of the suction motor 20 in the lower motor housing 27.

Accordingly, the minimum diameter of the opening of the lower motor housing 27 may be larger than the maximum diameters of the motor control substrate 205 and the suction motor 20.

Figure 18:
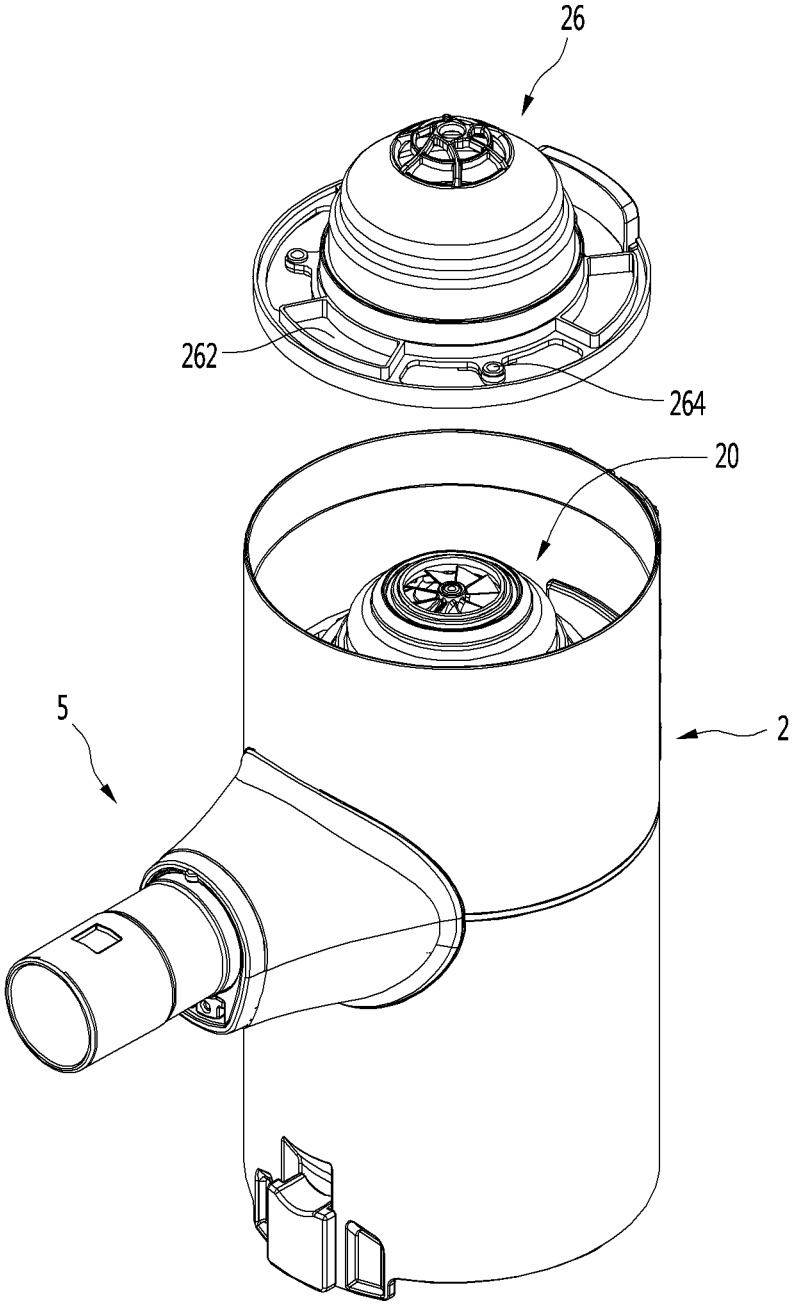
FIG. 18 is a view when an upper motor housing according to an embodiment of the present invention is inserted into the main body.

FIG. 18 is a view when the upper motor housing according to an embodiment of the present invention is inserted into the main body.

Referring to FIGS. 5 and 18, the upper motor housing 26 can be inserted into the main body 2 through the open top of the main body 2, with the suction motor 20 in the main body 2.

The maximum diameter of the upper motor housing 26 may be smaller than the open top of the main body 2 in order to insert the upper motor housing 26 into the main body 2 through the open top of the main body 2.

The upper motor housing 26 may cover the suction motor 20 when being inserted in the main body 2. Further, the upper motor housing 26 may be seated on the lower motor housing 27.

The inner diameter of the upper motor housing 26 may be larger than the outer diameter of the suction motor 20 so that the upper motor housing 26 can cover the suction motor 20.

The upper motor housing 26 may include an air through opening 262. The air discharged from the second cyclone unit 190 may pass through the air through opening 262.

The upper motor housing 26 may include one or more fastening portions 264 to be fastened to the lower motor housing 27.

Figure 19:
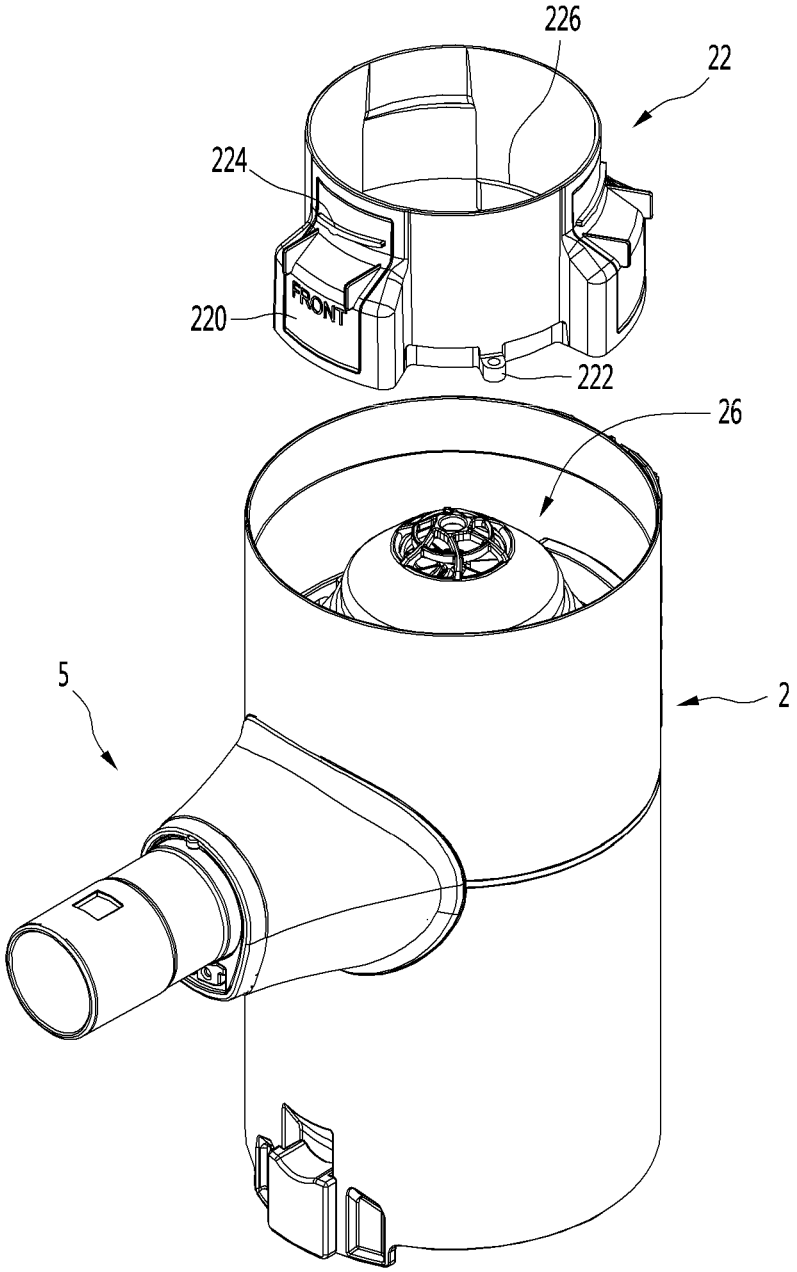
FIG. 19 is a view when a flow guide according to an embodiment of the present invention is inserted into the main body.

FIG. 19 is a view when the flow guide according to an embodiment of the present invention is inserted into the main body.

Referring to FIGS. 5 and 19, the flow guide 22 can be inserted into the main body 2 through the open top of the main body 2, with the upper motor housing 26 in the main body 2. The flow guide 22 can be seated on the upper motor housing 26 when being inserted in the main body 2.

The flow guide 22 may be open at the top and bottom. The flow guide 22 may include a passage wall 220 for forming the first air passage 232 through which the air discharged from the second cyclone unit 190 flows.

The passage wall 220 may be formed by making portions of the flow guide 20 radially convex. The flow guide 22 may include a plurality of passage walls 220 that is circumferentially spaced for smooth airflow.

The suction motor 20 is positioned inside the flow guide 22, but the gap between the flow guide 22 and the suction motor 20 should be small in order not to increase the size of the main body 2. However, when the gap between the flow guide 22 and the suction motor 20 is small, airflow is not smooth.

However, when the plurality of passage walls 220 are formed in the convex shape, as in the present invention, a sufficient cross-sectional area of the channel for airflow can be secured by the passage walls 220, so air can more smoothly flow.

In order that the suction motor 20 can be positioned inside the flow guide 22, the diameters of the open top and the bottom top of the flow guide 22 may be larger than the outer diameter of the suction motor 20.

Further, in order that the flow guide 22 can cover the upper motor housing, the diameters of the open top and the bottom top of the flow guide 22 may be larger than the outer diameter of the upper motor housing.

The flow guide 22 may further include a filter support 226 for seating the pre-filter 29.

Further, the flow guide 22 may include fastening portions 222 to be fastened to the motor housings 26 and 27.

The fastening portions 222 may be seated on the upper motor housing 26. In this state, fasteners can be fitted down into the upper motor housing 26, the lower motor housing 27, and the discharged guide 28 through the fastening portions 222.

Further, the flow guide 22 may include fixing ribs 224 for coupling to the filter unit 50. The fixing ribs 224 may extend at an angle around the flow guide 22 so that the height of the filter unit 50 can be changed when the filter unit 50 rotates.

Figure 20:
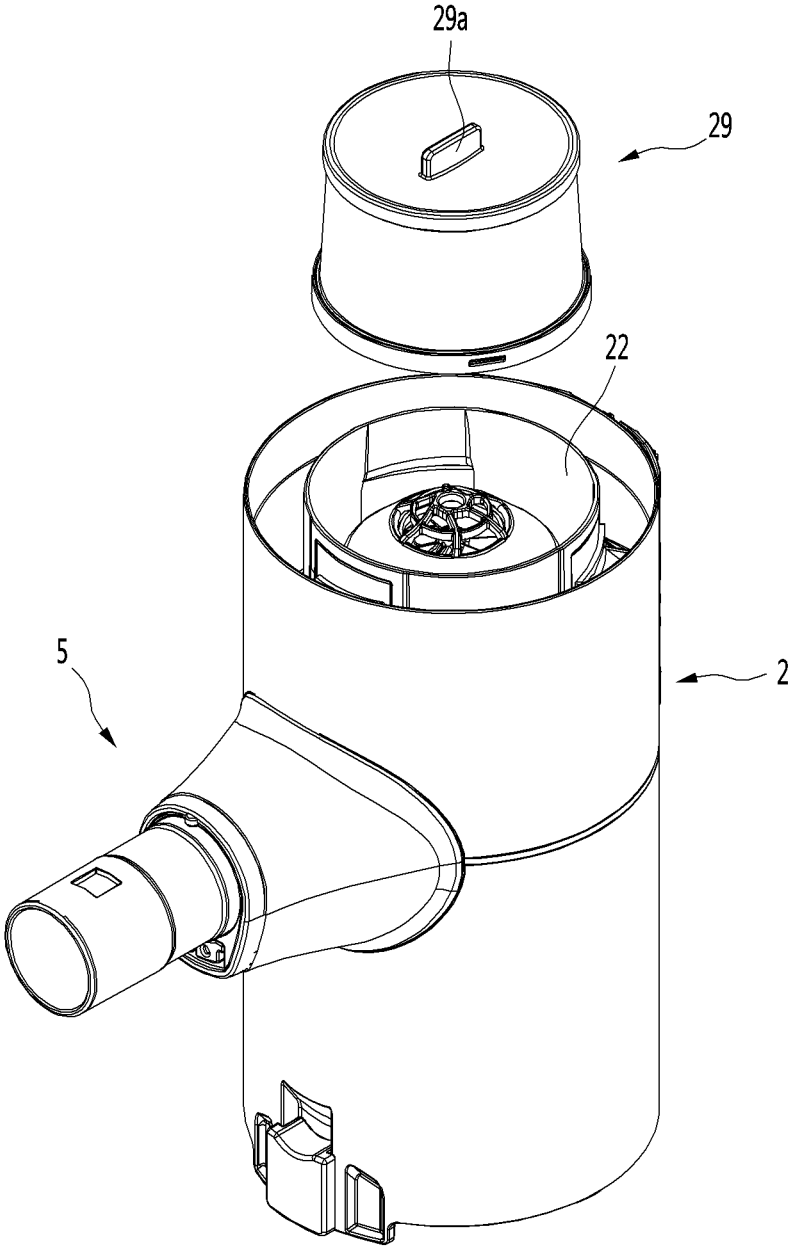
FIG. 20 is a view when a pre-filter according to an embodiment of the present invention is inserted into the main body.

FIG. 20 is a view when the pre-filter according to an embodiment of the present invention is inserted into the main body.

Referring to FIGS. 5, 19, and 20, the pre-filter 29 may include a grip 29*a*. It is possible to hold the grip 29*a* and insert the pre-filter 29 into the main body 2 through the open top of the main body 2.

The pre-filter 29 may be seated on the filter support 226 in the flow guide 22.

The outer diameter of the pre-filter 29 may be smaller than the inner diameter of the flow guide 22 so that the pre-filter 29 can be inserted in the flow guide 22.

Figure 21:
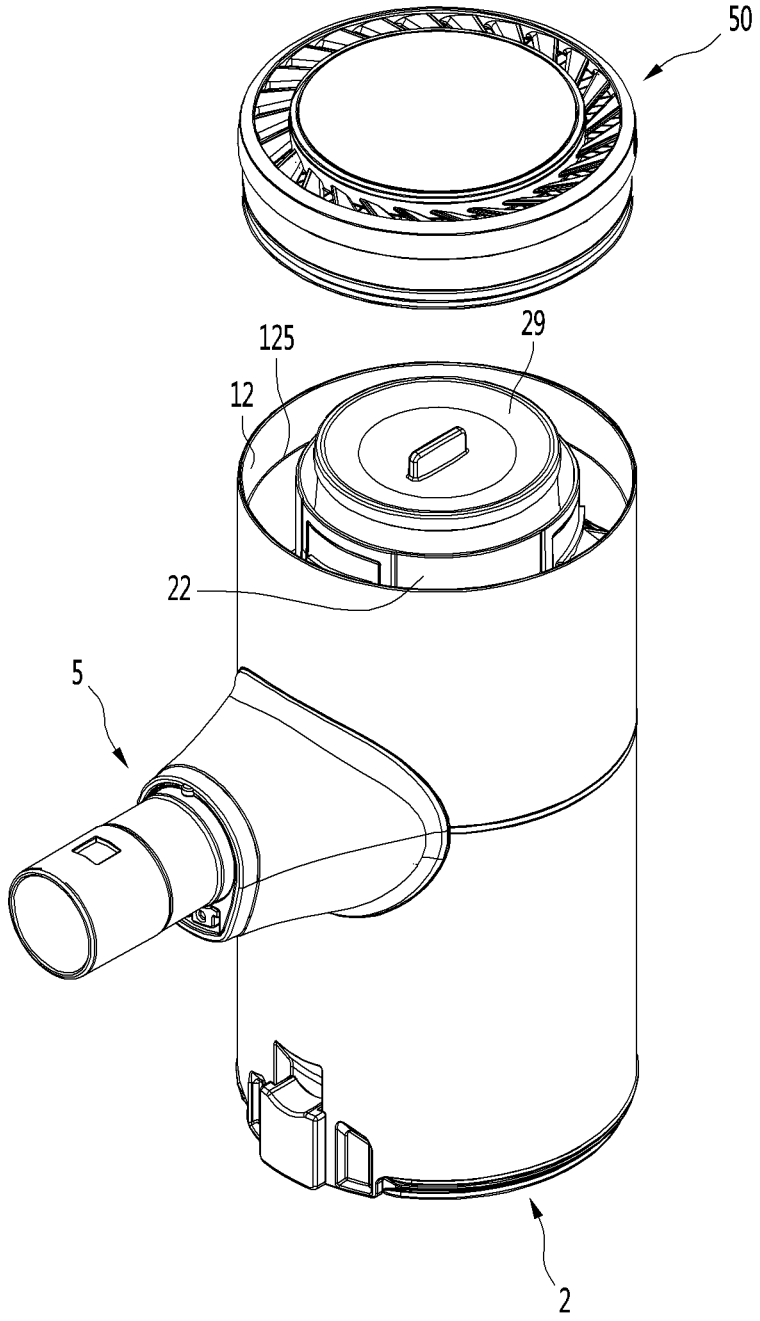
FIG. 21 is a view when a filter unit according to an embodiment of the present invention is coupled to the main body.
Figure 22:
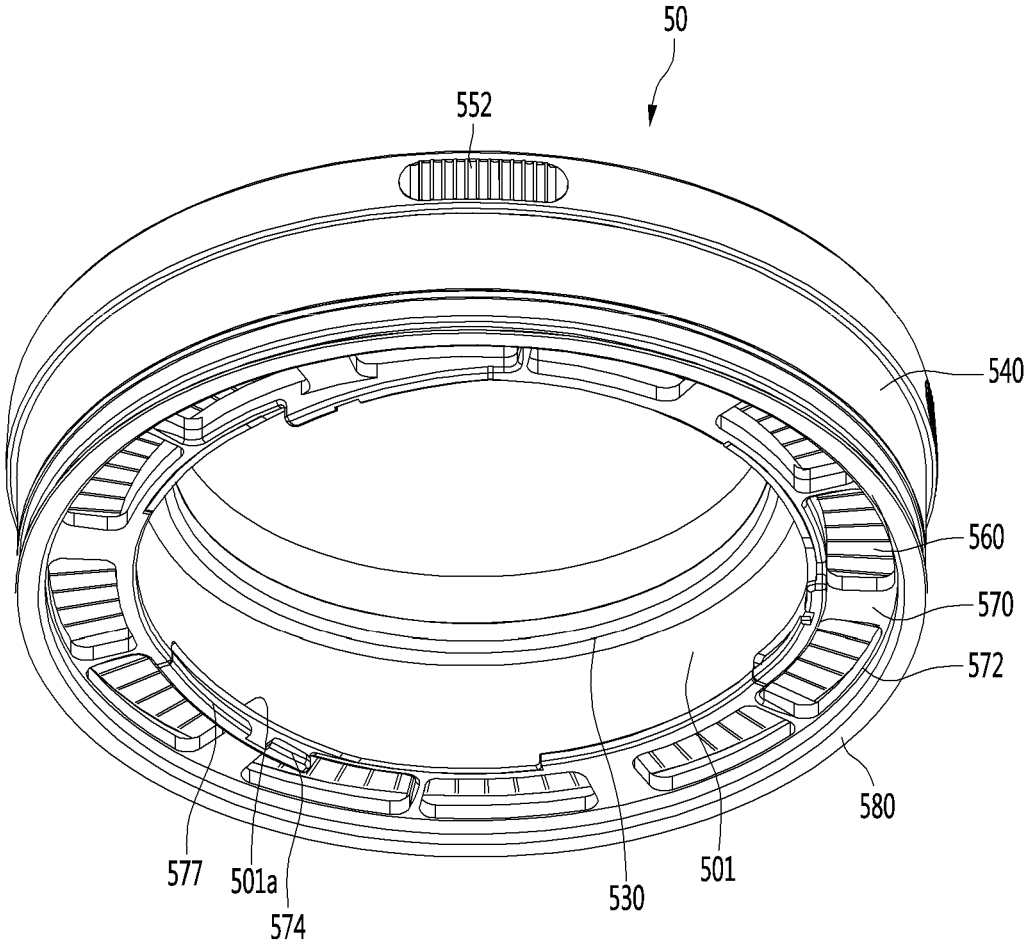
FIG. 22 is a bottom perspective view of the filter unit according to an embodiment of the present invention.

FIG. 21 is a view when the filter unit according to an embodiment of the present invention is coupled to the main body and FIG. 22 is a bottom perspective view of the filter unit according to an embodiment of the present invention.

Referring to FIGS. 21 and 22, the filter unit 50 may further include an exhaust filter 560 for filtering the air discharged from the suction motor 20 and a filter frame for supporting the exhaust filter 560.

The exhaust filter 560, for example, may be an HEPA (High Efficiency Particulate Air) filter.

The exhaust filter 560 may be positioned around the flow guide 22 when the filter unit 50 is coupled to the main body 2 to prevent an increase in height of the cleaner 1. That is, the exhaust filter 560, for example, may be formed in a ring shape and a portion of the flow guide 22 may be positioned in the area defined by the exhaust filter 560.

The exhaust filter 560 and the pre-filter 290 both may be positioned in the area defined by the second body 12. That is, both of the exhaust filter 560 and the pre-filter 29 may be positioned in the same body.

At least a portion of the pre-filter 29 may be positioned in the area defined by the exhaust filter 560 to prevent an increase in height when the exhaust filter 560 and the pre-filter 29 are positioned in the second body 12. The exhaust filter 560 can surround the pre-filter 29.

According to this configuration, the axis of cyclonic flow in the first cyclone unit 110 can pass through the pre-filter 29 and the filter unit 50. For example, the axis of the cyclonic flow can pass through the area defined by the exhaust filter 560. That is, the axis of the cyclonic flow in the first cyclone unit 180 can pass through the open center portion of the exhaust filter 560.

The filer frame may be locked to the fixing ribs of the flow guide 22 between the second body 12 and the flow guide 22.

The filter frame may include an inner frame 501 and an outer frame 540 disposed around the inner frame 501.

The outer side of the inner frame 501 and the inner side of the outer frame 540 are spaced apart from each other and the exhaust filter 560 may be disposed between the inner frame 501 and the outer frame 540.

The filter frame may further include a filter cover 570 that covers the bottom of the exhaust filter 560. The filter cover 570 may include air openings 572 for passing the air discharged from the suction motor 20.

The filter frame may further include rib receiving portions 574 for seating the fixing ribs 224 of the flow guide 22.

The rib receiving portions 574 may be formed by rib supports 577 on the filter cover 570 and a recession 501*a* formed on the inner frame 501.

The rib receiving portions 574 may extend at an angle around the filter frame so that the fixing ribs 224 can be seated in the rib receiving portions 574.

The filter unit 50 may further include sealing members 530 and 580 for sealing the filter unit 50 and the main body 2 when the filter unit 50 is coupled to the main body 2.

The sealing members 530 and 580 may include an inner sealing member 530 for preventing air from leaking through the gap between the outer side of the flow guide 22 and the inner side of the inner frame 501.

Further, sealing members 530 and 580 may further include an outer sealing member 580 for preventing the air in the second air passage 234 from flowing into the gap between the outer frame 540 and the second body 12 without passing through the exhaust filter 560.

The inner sealing member 530 may be fitted in the inner frame 501 and the outer sealing member 580 may be fitted on the filter cover 570.

The outer sealing member 580 may be seated on a support step 125 formed on the inner side of the second body 12. The inner sealing member 530 may be seated on the upper end of the flow guide 22.

Figure 23:
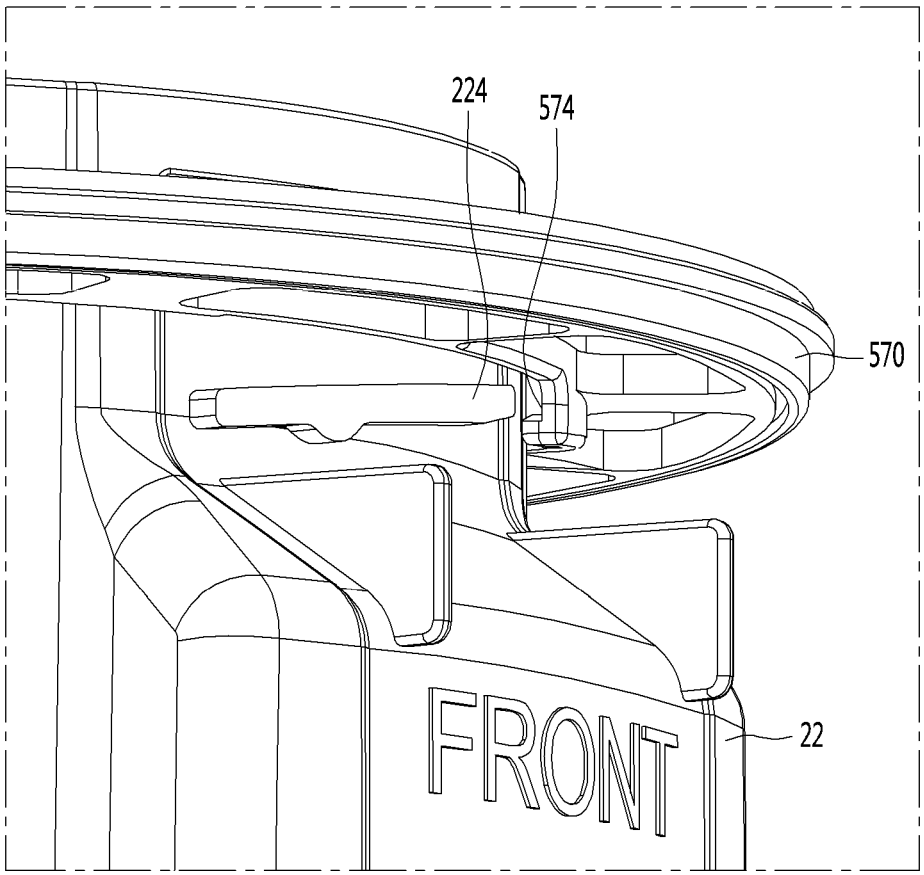
FIG. 23 is a view before the filter unit according to an embodiment of the present invention is coupled to the flow guide.
Figure 24:
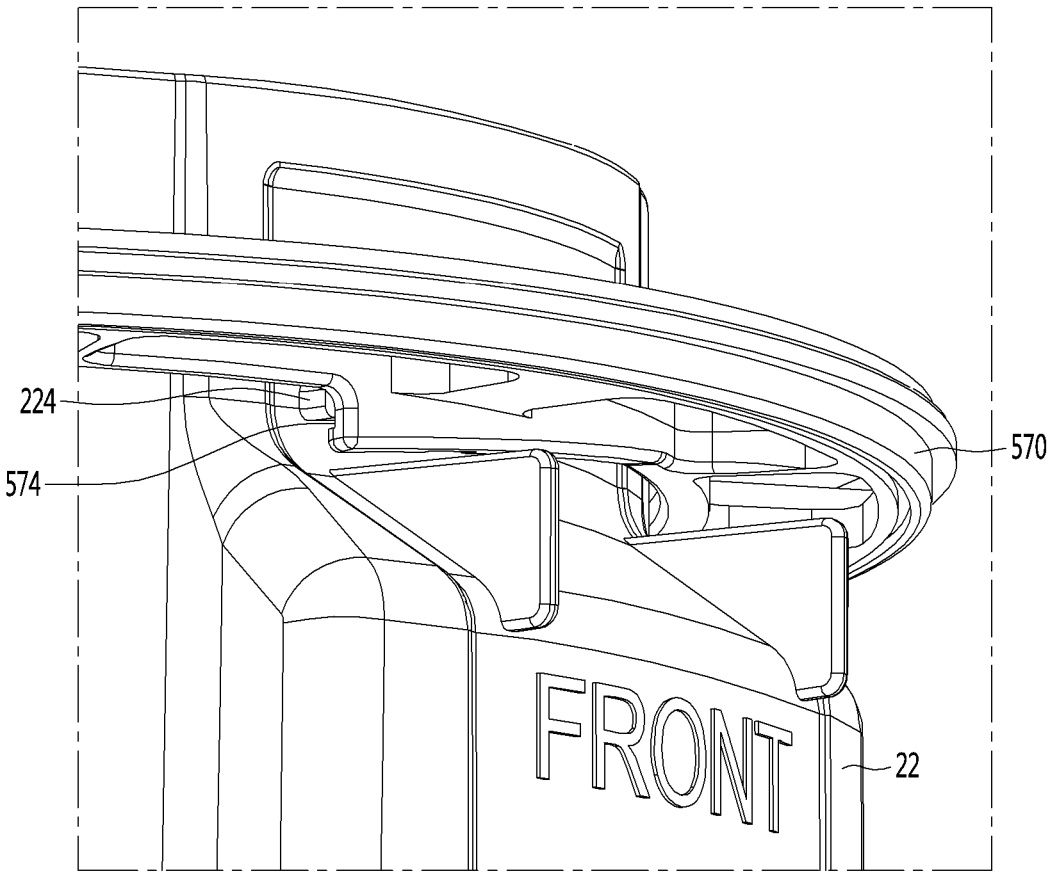
FIG. 24 is a view after the filter unit according to an embodiment of the present invention is coupled to the flow guide.

FIG. 23 is a view before the filter unit according to an embodiment of the present invention is coupled to the flow guide and FIG. 24 is a view after the filter unit according to an embodiment of the present invention is coupled to the flow guide.

A process of combining the filter unit 50 is described with reference to FIGS. 23 and 24.

A portion of the lower portion of the filter unit 50 is inserted into the second body 12 to couple the filter unit 50 to the main body 2.

Accordingly, the rib receiving portions 574 of the filter unit 50 and the fixing ribs 224 can be aligned.

In this state, the fixing ribs 224 are inserted into the rib receiving portions 574 by rotating the filter unit 50 in a predetermined direction. The receiving portions 574 may be positioned higher than the fixing ribs 224 so that the fixing ribs 224 can be easily inserted into the rib receiving portions 574.

Since the fixing ribs 224 extend at an angle, the filter unit 50 is moved down by the fixing ribs 224 when being rotated.

Meanwhile, it is possible to rotate the filter unit 50 in another direction to separate the filter unit 50 from the main body 2. Since the fixing ribs 224 extend at an angle, the filter unit 50 is moved upward by the fixing ribs 224 when being rotated in the direction. When the fixing ribs 224 are separated out of the rib receiving portions 574, the filter unit 50 and the main body 2 are separated.

It is possible to separate the filer unit 50 from the main body 2 by lifting the filter unit 50 in this state.

Figure 26:
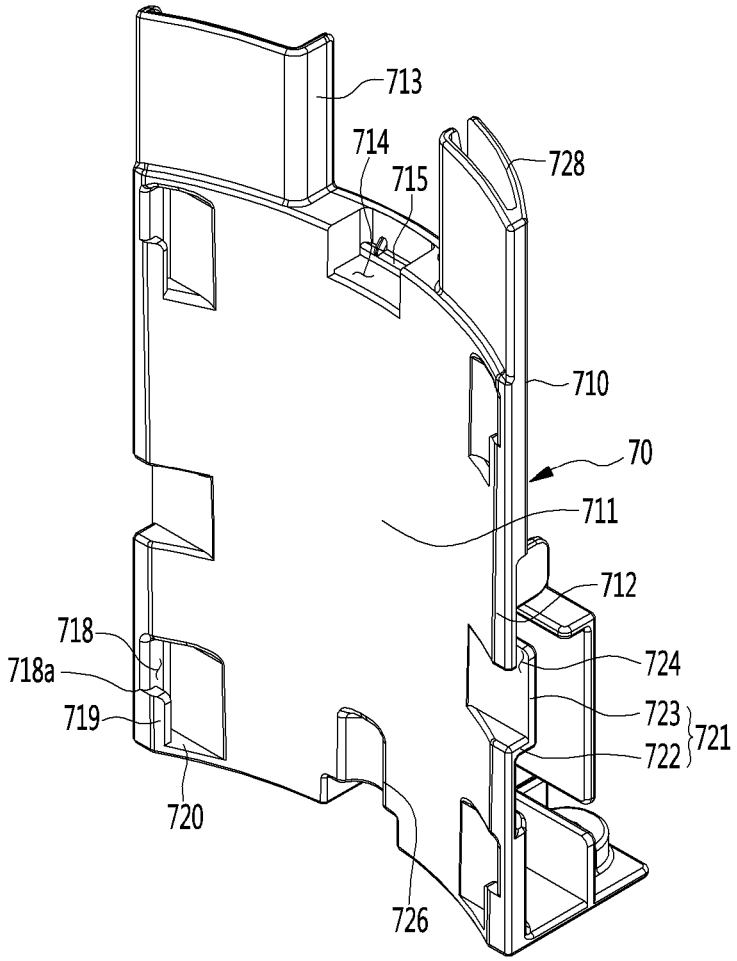

FIGS. 25 and 26 are perspective views of the cover member according to an embodiment of the present invention.

Referring to FIGS. 8, 25, and 26, the cover member 70 may include a cover body 710 that is in contact with the outer side of the first body 10.

The cover body 710 may include a first cover body 711 that is in contact with the first contact surface 101 and second cover bodies 712 that are disposed at both sides of the first cover body 711 to be brought in contact with the second contact surfaces 102.

The first cover body 711 may include a rounded surface to come in contact with the first contact surface 101.

The second cover bodies 712 may include a flat surface to come in contact with the second contact surfaces 102.

The cover body 710 may further include a receiving space 713 for receiving the second coupling portion 132 of the second body 12. The receiving space 713 may be formed at the upper center portion of the cover body 710.

The cover body 710 may further include a slot 714 for passing the cover coupling hook 104 and a hook locking portion 715 for locking the cover coupling hook 104 passing through the slot 714.

The slot 714 is disposed at a lower side of the receiving space 713. Therefore, according to the present invention, the cover coupling hook 104 can be locked to the hook locking portion 715 sequentially through the receiving space 713 and the slot 714. The second coupling portion 132 of the second body 12 can be inserted into the receiving space 713 without interference with the cover body 710.

The receiving space 713 is a space spaced apart from both sides of the cover body 710, so when the second coupling portion 132 of the second body 12 is inserted in the receiving space 713, the cover body 710 cannot be horizontally moved by the second coupling portion 132.

The cover body 710 may further include rib receiving spaces 718 for receiving the locking ribs 103 of the first body 10, retaining ribs 719 for preventing the locking ribs 103 in the rib receiving spaces 718 from moving away radially from the first body 10, and rib support sides 720 for supporting the locking ribs 103 in the rib receiving spaces 718.

The retaining ribs 719 may be disposed under inlets 718*a* of the rib receiving spaces 718.

The cover body 710 may further include second handle coupling portions 721 for coupling the handle unit 3.

The second handle coupling portions 721 may include a first extension 722 horizontally extending from the cover body 710 and a second extension 723 extending upward from the first extension 722.

At least a portion of the second extension 723 may face a first surface of the cover body 710.

In the cover body 710 of the present invention, the surface that comes in contact with the first body 10 may be a second surface and the opposite surface to the second surface may be the first surface.

Accordingly, an insertion opening 724 is formed between the second extensions 723 and the first surface of the cover body 710.

Insertion ribs 302 (see FIG. 32) of the handle unit 3 may be inserted into the insertion openings 724.

Figure 27:
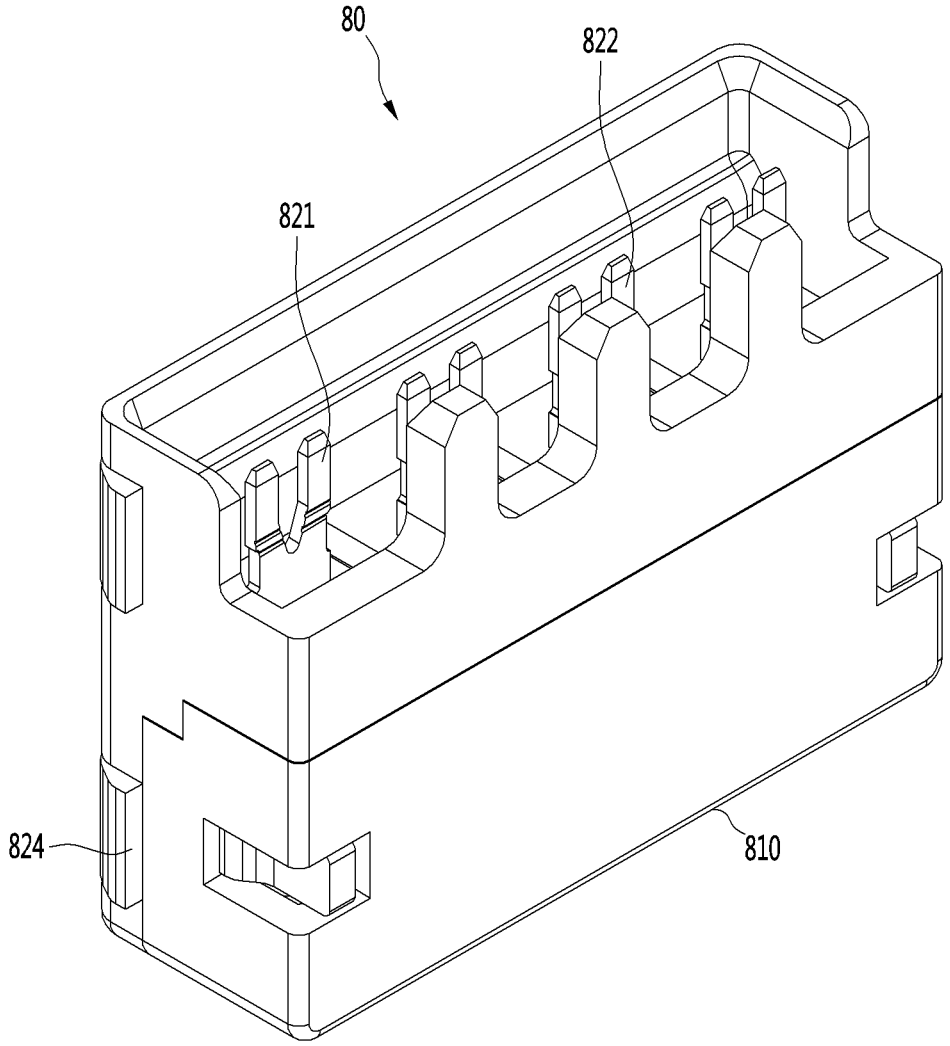
FIG. 27 is a perspective view showing a main body terminal according to an embodiment of the present invention.

The cover body 710 may include a terminal mount 716 for mounting a main body terminal 80 (see FIG. 27). The terminal mount 716 may include a plurality of horizontally spaced coupling ribs 716*a* and coupling holes 716*b* for coupling the main body terminal 80 may be formed on each of the coupling ribs 716*a*.

Accordingly, the main body terminal 80 may be coupled to the coupling holes 716*b* between the coupling ribs 716*a*.

When the main body terminal 80 is coupled to the coupling holes 716*b*, the main body terminal 80 cannot be moved downward in the process of coupling the handle terminal 90 of the handle unit 3 to the main body terminal 80.

The vertical length of the coupling ribs 716*a* may be larger than the vertical length of the main body terminal 80. This is for making the coupling ribs 716*a* guide the handle terminal 90 (see FIG. 33) and the main body terminal 80 when the handle terminal 90 is coupled to the main body terminal 80.

The cover body 710 may further include a terminal support 716*c* for supporting the main body terminal 80. The terminal support 716*c*, for example, may connect the bottoms of the coupling ribs 716*a*.

Accordingly, it is possible to prevent the main body terminal 80 from being pushed down when coupling the handle terminal 90 of the handle unit 3 to the main body terminal 80 supported by the terminal support 716*c*.

Figure 31:
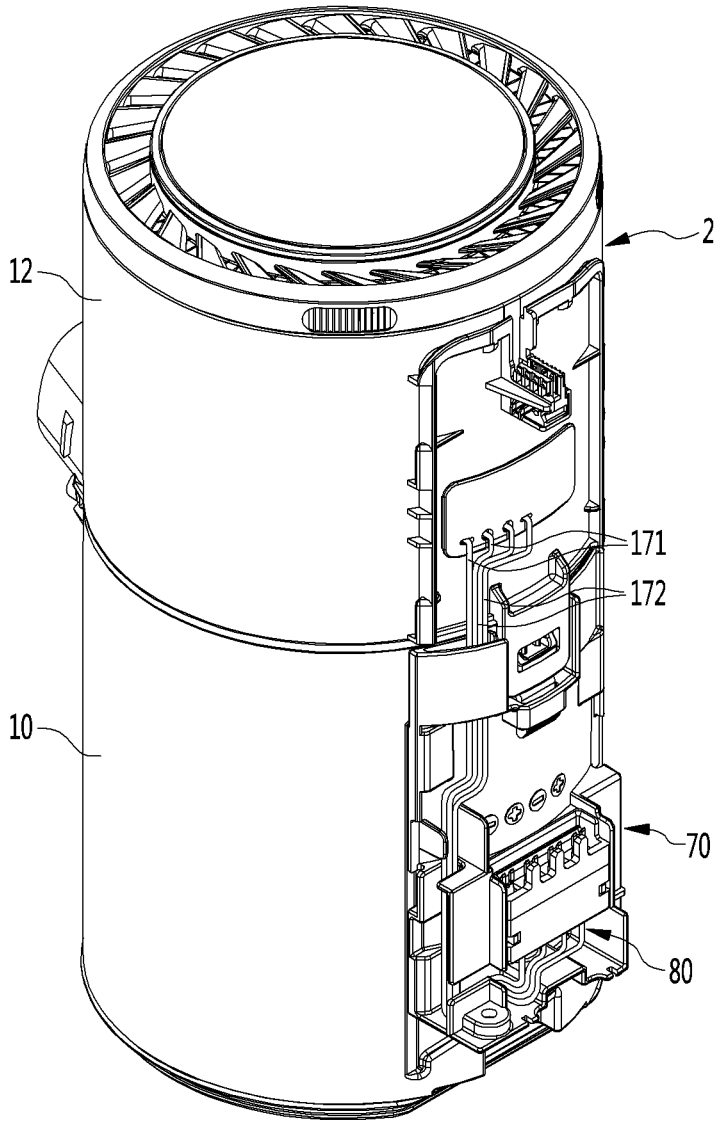
FIG. 31 is a view after the main body terminal is mounted on the cover member.

The cover body 710 may further include one or more guide ribs for guiding the main body wires 171 and 172 (see FIG. 31).

The guide ribs may include an upper guide rib 728 and a lower guide rib 728*a*.

The cover body 710 may further include a fastening portion groove 726 in which the housing fastening portion 108 of the first body 10 is positioned to prevent interference with the housing fastening portion 108.

The cover body 710 may further include a handle hook coupling portion 717 for coupling a handle hook 303 (see FIG. 32) of the handle unit 3.

FIG. 27 is a perspective view showing the main body terminal according to an embodiment of the present invention.

Referring to FIG. 27, the main body terminal 80 may include a terminal housing 810. The terminal housing 810 may be open at the top.

Coupling protrusions 824 that are fitted into the coupling holes 716*b* of the coupling ribs 716*a* may be formed on both sides of the terminal housing 810.

First lower power terminals 821 and second lower power terminals 822 may be disposed in the terminal housing 810. The lower power terminals 821 and 822 each may include a pair of terminal pins. The terminal pins of the lower power terminals 821 and 822 may be horizontally spaced apart from each other and arranged in a line.

The first lower power terminals 821, for example, may be connected to the suction motor 20. The second lower power terminals 822, for example, may be connected to the first terminal 139.

According to this embodiment, since a signal terminal for transmitting control signals and a control terminal for supplying power are separated and the main body terminal 80 has the power terminals 821 and 822, an increase in size of the main body terminal 80 can be prevented.

Figure 28:
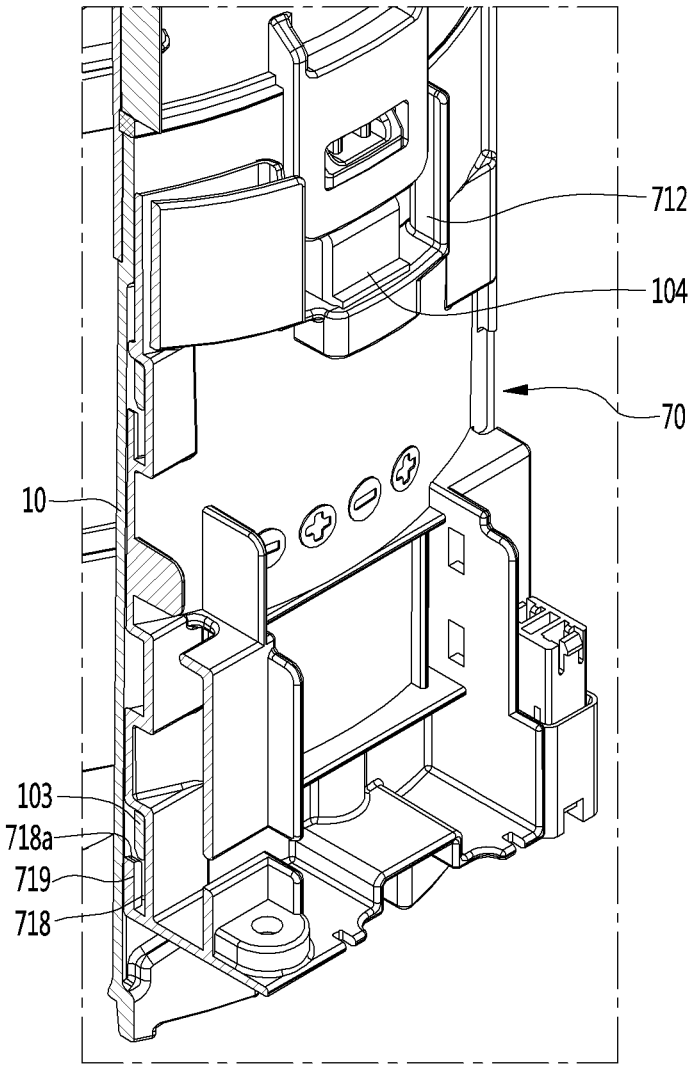
FIG. 28 is a vertical cross-sectional view before the cover member according to an embodiment of the present invention is coupled to the main body.
Figure 29:
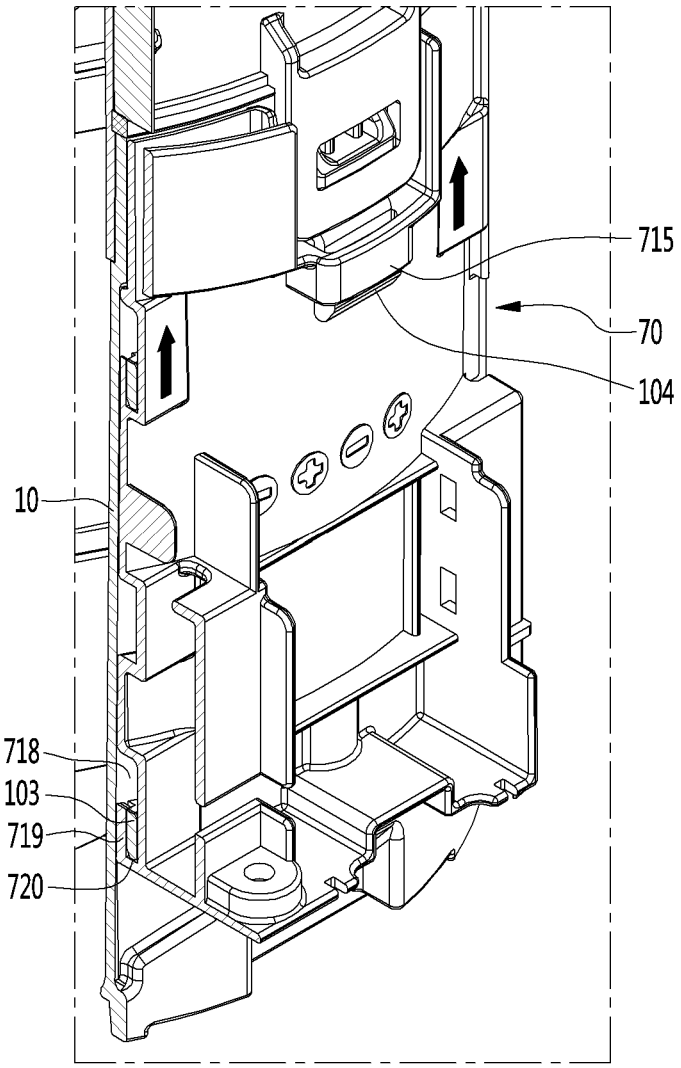
FIG. 29 is a vertical cross-sectional view after the cover member is coupled to the main body.
Figure 30:
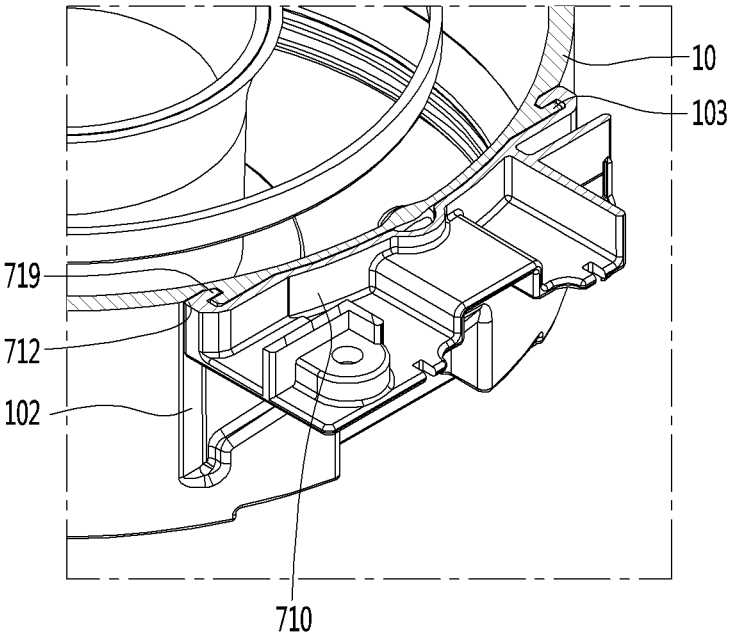
FIG. 30 is a horizontal cross-sectional view after the cover member according to an embodiment of the present invention is coupled to the main body.

FIG. 28 is a vertical cross-sectional view before the cover member according to an embodiment of the present invention is coupled to the main body, FIG. 29 is a vertical cross-sectional view after the cover member is coupled to the main body, and FIG. 30 is a horizontal cross-sectional view after the cover member according to an embodiment of the present invention is coupled to the main body.

Referring to FIGS. 26 to 30, in order to couple the cover member 70 to the first body 10, the inlets 718*a* of the rib seats 718 of the cover body 710 are aligned with the locking ribs 103 of the first body 10.

In this state, a portion of the second coupling portion 132 of the second body 12 has been positioned in the receiving space 713 of the cover body 710.

In this state, the cover body 710 is brought in contact with the first body 10. That is, the first cover body 711 is brought in contact with the first contact surface 101 of the first body 10 and the second cover bodies 712 are brought in contact with the second contact surfaces 102 of the first body 10. Further, the locking ribs 103 of the first body 10 are inserted into the rib seats 718.

In this state, as shown in FIG. 29, the cover member 70 is pushed up. Accordingly, the locking ribs 103 of the first body 10 are brought in close contact with the ribs support sides 720 and the cover coupling hook 104 is locked to the hook locking portion 715 through the slot 714 of the cover body 710.

After the cover coupling hook 104 is locked to the hook locking portion 715, the cover member 70 cannot be moved down.

Further, after the locking ribs 103 of the first body 10 are brought in close contact with the rib support sides 720, the cover member 70 cannot be moved upward due to the locking ribs 103.

Further, the retaining ribs 719 are positioned between the second contact surfaces 102 of the first body 10 and the locking ribs 103, so the cover member 70 cannot be moved radially outward from the first body 10.

FIG. 31 is a view after the main body terminal is mounted on the cover member.

Referring to FIG. 31, the main body terminal 80 can be coupled to the cover member 70 after or before the cover member 70 is coupled to the main body 2, that is, the first body 10.

Then, the main body wires 171 and 172 may be connected to the main body terminal 80.

The main body wires 171 and 172 are guided by the guide ribs 728 and 728*a* and may be connected to the main body terminal 80 from under the main body terminal 80.

The main body wires 171 and 172 may include a pair of first main body wires 171 connected to the motor control substrate 204 to supply power to the suction motor 20 and a pair of second main body wires 172 connected to the first terminal 139.

According to the present invention, since the terminal mount 716 is formed on the first surface of the cover body 710 and the main body terminal 80 is mounted on the terminal mount 716, when the main body wires 171 and 172 are connected to the bottom of the main body terminal 80, the cover body 710 is positioned between the first body 10 and the main body terminal 80 and main body wires 171 and 172.

Therefore, even if the first body 10 is made of a transparent or translucent material, the main body wires 171 and 172 and the main body terminal 80 are not seen from the outside of the first body 10.

Figure 32:
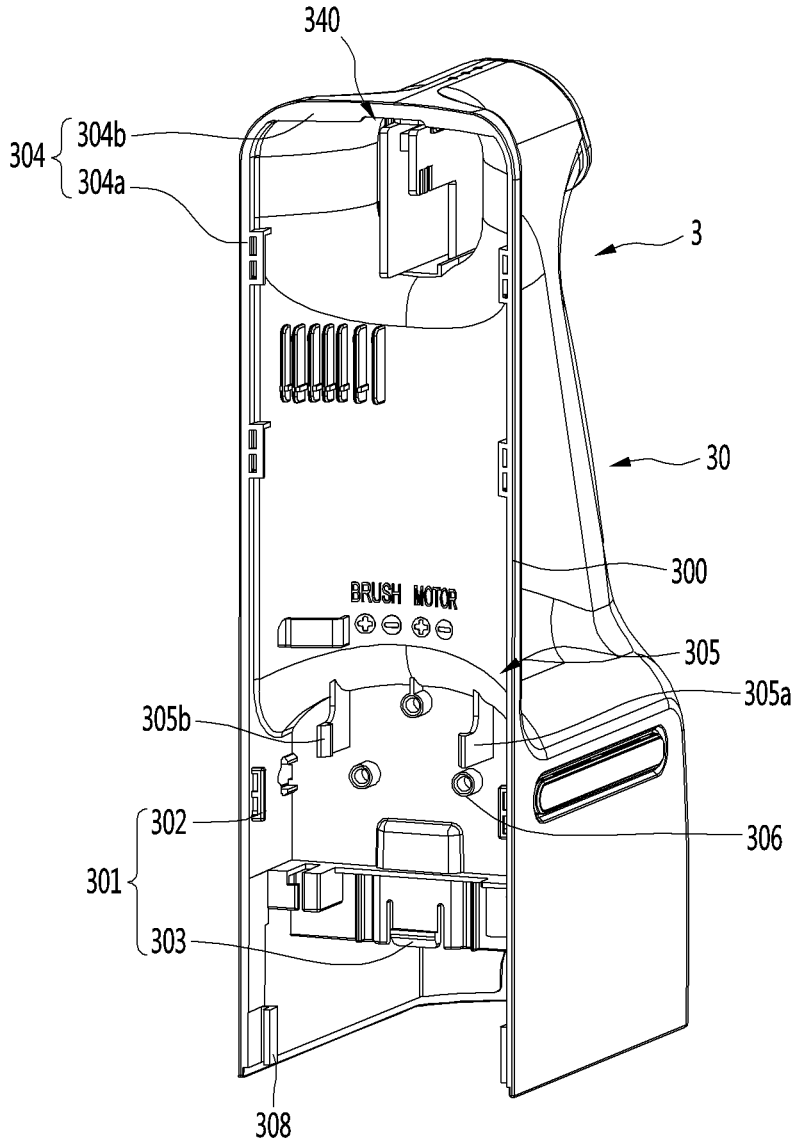
FIG. 32 is a perspective view of a handle unit according to an embodiment of the present invention.

FIG. 32 is a perspective view of the handle unit according to an embodiment of the present invention.

Referring to FIGS. 10 and 32, the handle unit 3 may include a handle body 300 that covers the main body 2 in contact with the outer side of the main body 2.

The handle body 300 may include a cover coupling portion 301 for coupling the cover member 70.

The handle unit 3, for example, may be vertically coupled to the cover member 70 by the cover coupling portion 301.

The cover coupling portion 301 may include a handle hook 303 that is coupled to the handle hook coupling portion 717 of the cover member 70.

The cover coupling portion 301 may further include insertion ribs 302 that are coupled to the second handle coupling portions 721 of the cover member 70.

The handle body 300 may further include a body coupling portion 304 for coupling the second body 12 of the main body 2.

The body coupling portion 304 may include side coupling ribs 304*a* and a top coupling rib 304*b*. The side coupling ribs 304*a* can be coupled to the first rib coupling portions 139*a* and the top coupling rib 304*b* can be coupled to the second rib coupling portions 139*b*.

The handle body 300 may further include housing coupling ribs 308 for coupling the inner housing 610.

The handle unit 3 may further include the handle terminal 90 that is connected to the main body terminal 80 mounted on the cover member 70.

The handle body 300 may further include a terminal coupling portion 305 for coupling the handle terminal 90.

The terminal coupling portion 305 may include a plurality of terminal coupling hooks 305*a* and 305*b* that are coupled to both sides of the handle terminal 90 and coupling protrusions 306 that are coupled to the housing protrusions 914 (see FIG. 34) of the handle terminal 90.

The handle terminal 90 is positioned between the terminal coupling hooks 305*a* and 305*b* and coupled to the terminal coupling hooks 305 and 305*b*.

The handle unit 3 may further include a main PCB (Printed circuit board) unit 340 for controlling the suction motor 20.

Figure 33:
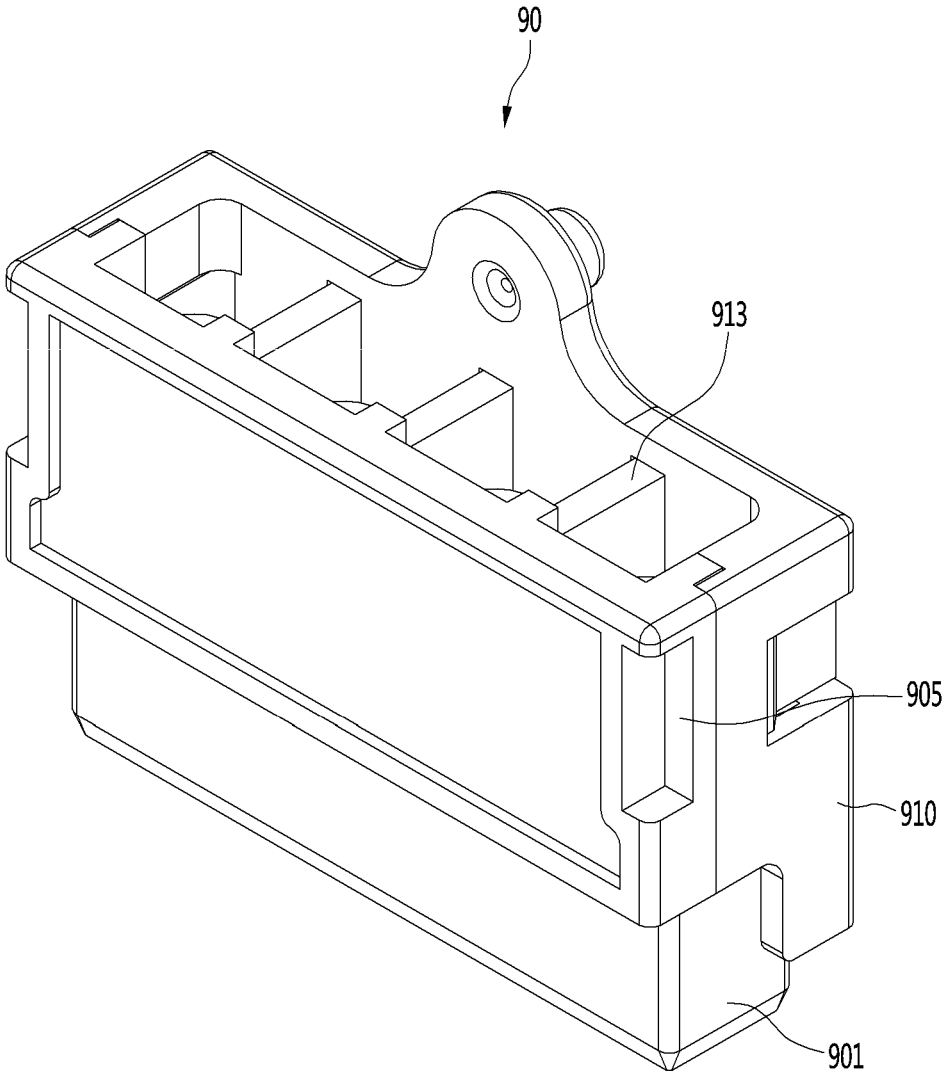
FIGS. 33 and 34 are perspective views of a handle terminal according to an embodiment of the present invention.
Figure 34:
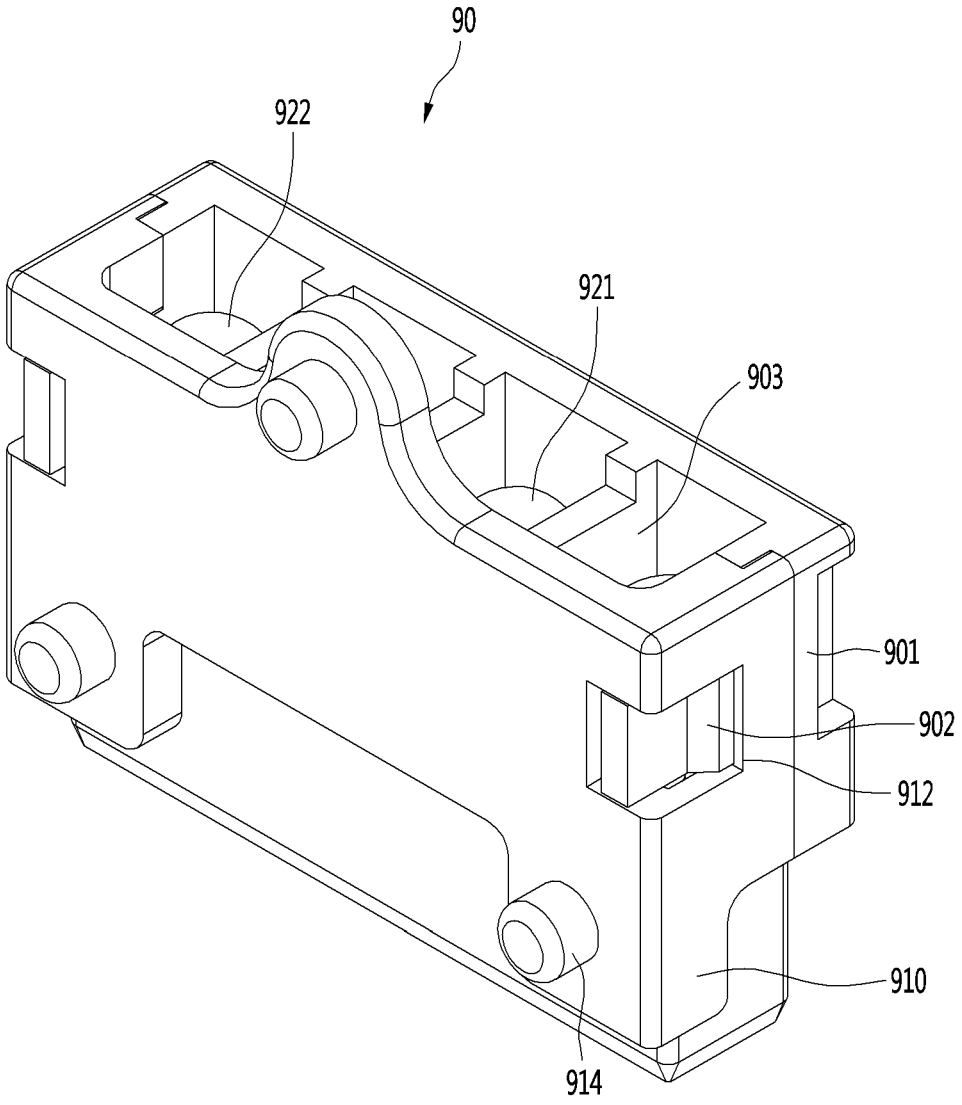

FIGS. 33 and 34 are perspective views of the handle terminal according to an embodiment of the present invention.

Referring to FIGS. 33 and 34, the handle terminal 90 may include terminal housings 901 and 910.

The handle terminal 90 may further include a first upper power terminal 921 and a second upper power terminal 922.

The first upper power terminal 921 can be connected to the first lower power terminal 821 and the second upper power terminal 922 can be connected to the second lower power terminal 822.

Each of the upper power terminals 921 and 922 may include a pair of terminal pins. The terminal pins of the upper power terminals 921 and 922 may be horizontally spaced apart from each other and arranged in a line.

The terminal housings 901 and 910 may include a first housing 901 and a second housing 910 coupled to the first housing 901.

Housing hooks 902 are formed at any one of the first housing 901 and the second housing 901 and hook slots 912 for locking the housing hook 902 may be formed at the other one of the first and second housings. In FIG. 34, for example, the housing hooks 902 are formed at the first housing 901 and the hook slots 912 are formed at the second housing 910.

The first housing 901 and the second housing 910 may be, for example, horizontally combined. The first housing 901 and the second housing 910 may define terminal receiving spaces.

The first housing 901 and the second housing 910 each may include a plurality of separation walls 903 and 913, respectively, for defining a plurality of divided terminal receiving spaces.

Housing protrusions 914 for coupling the coupling protrusions 306 of the handle body 300 may be formed on the second housing 910. The housing protrusions 914 may be formed on the second housing 910 so that the handle terminal 90 can be stably coupled to the main body.

Hook locking grooves 905 for locking the terminal coupling hooks 305*a* and 305*b* may be formed at both sides of the first housing 901.

Figure 35:
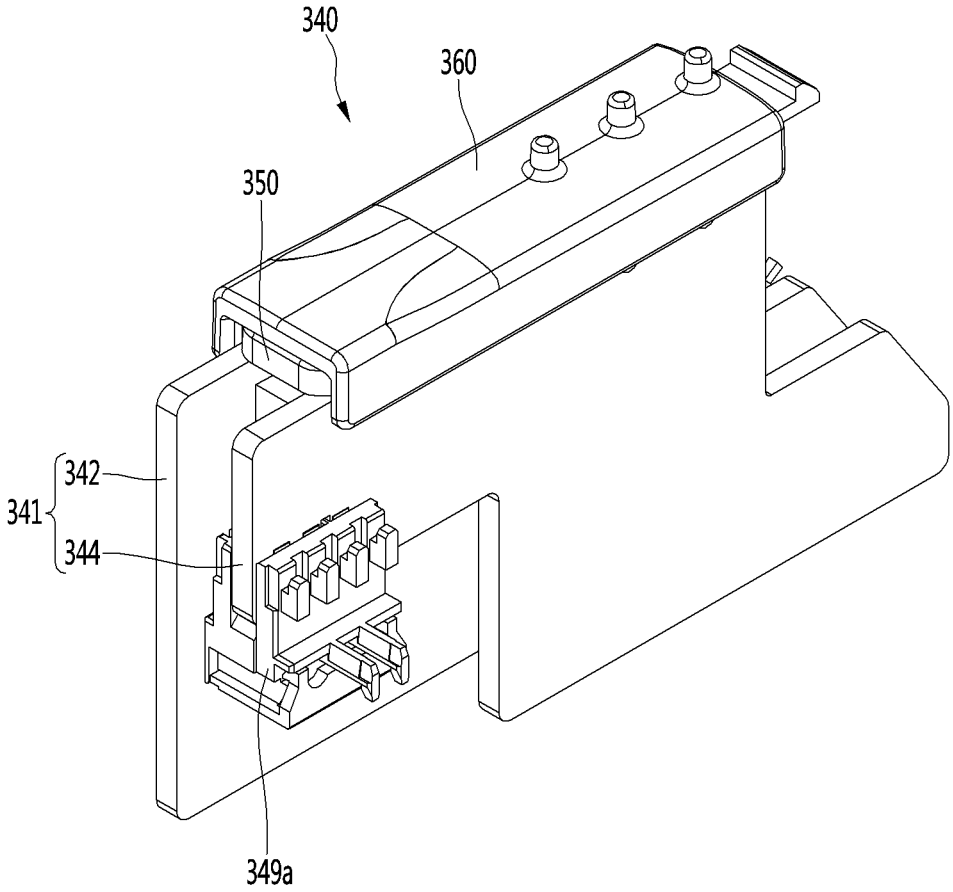
FIG. 35 is a perspective view of a main PCB unit according to an embodiment of the present invention.
Figure 36:
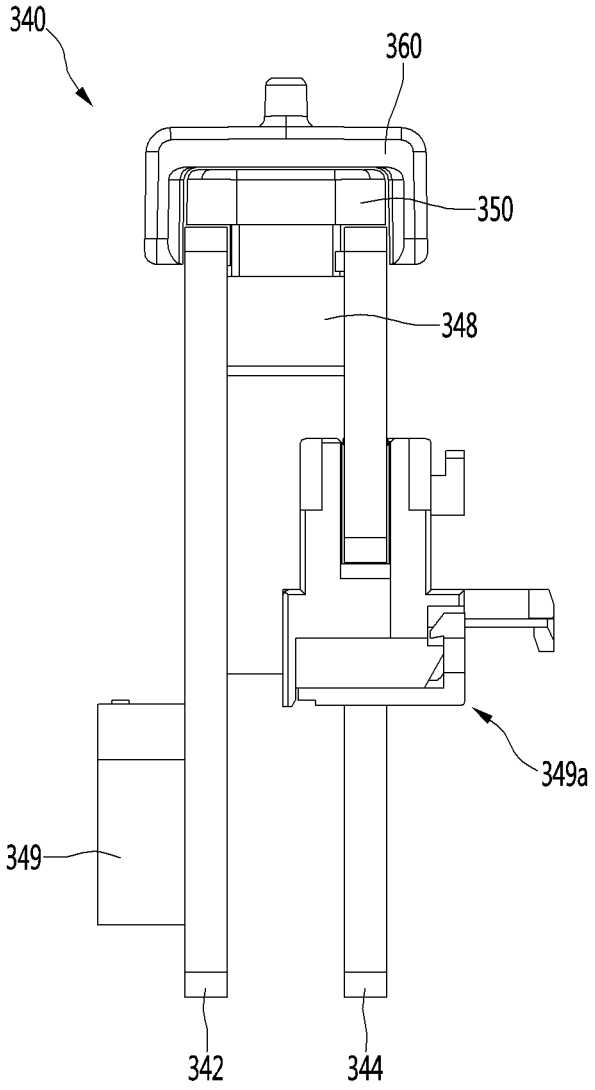
FIG. 36 is a front view of the main PCB unit shown in FIG. 35.
Figure 37:
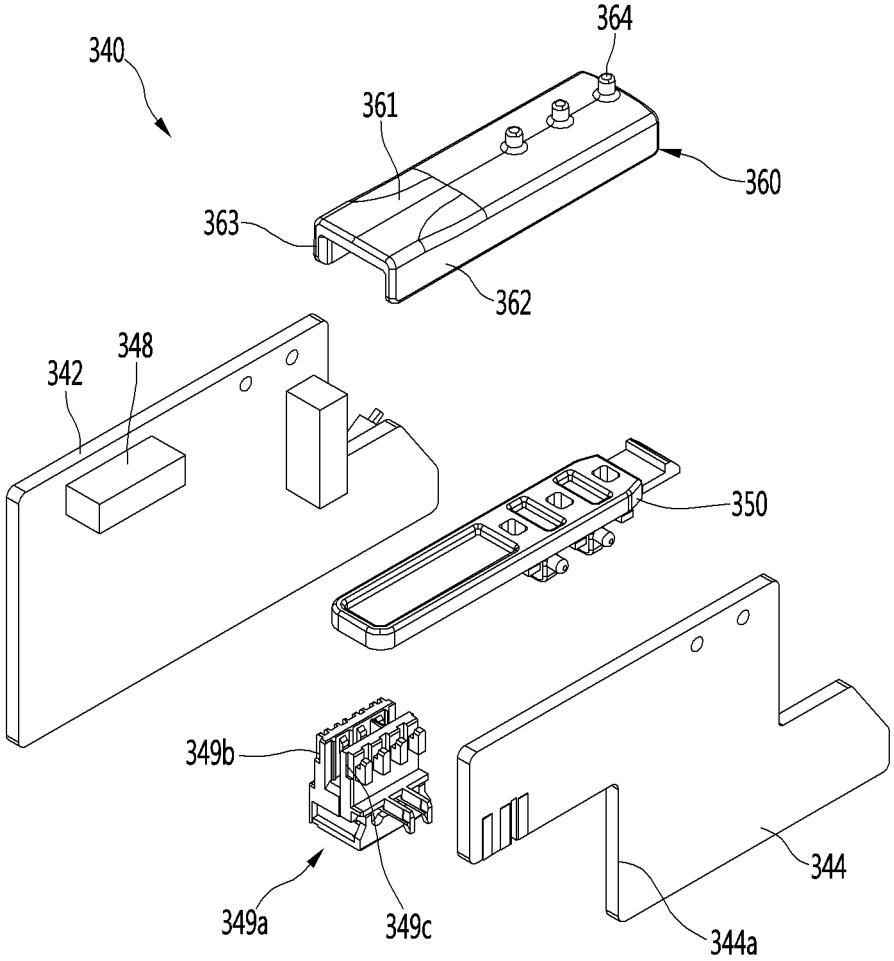
FIGS. 37 and 38 are exploded perspective views of the main PCB unit shown in FIG. 35.
Figure 38:
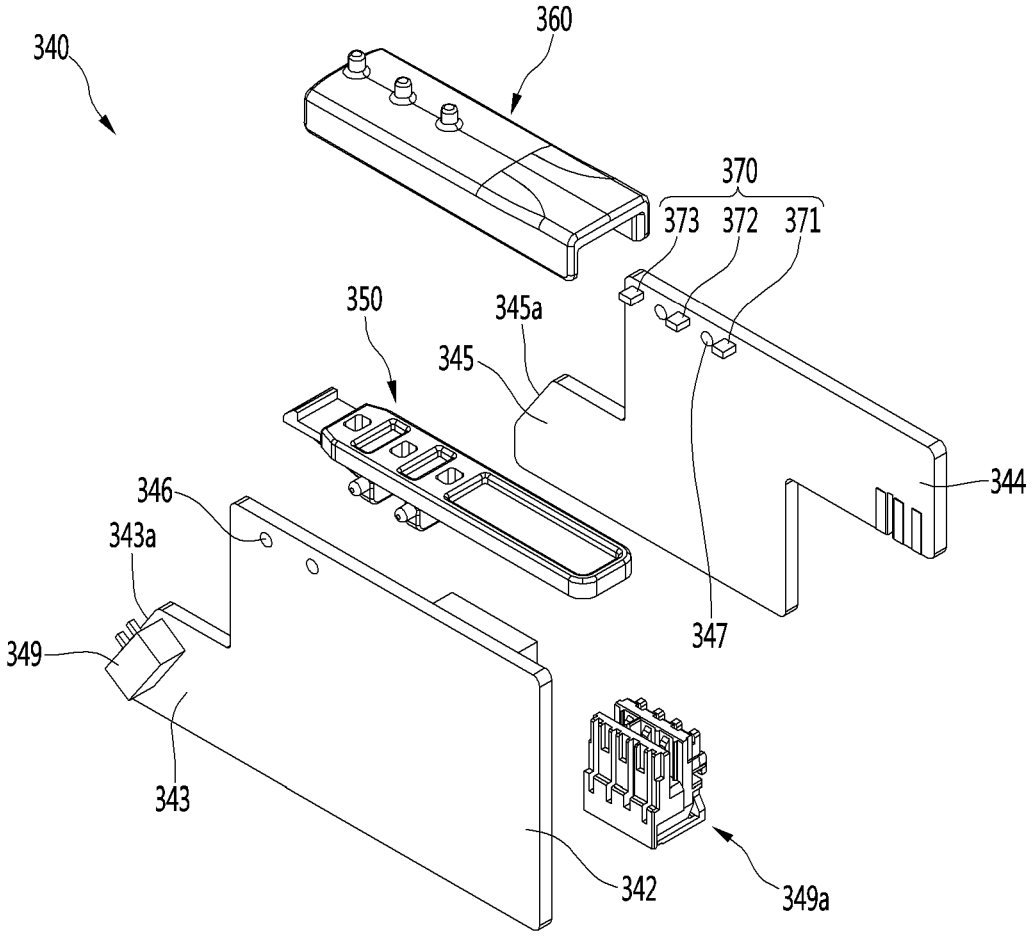
Figure 39:
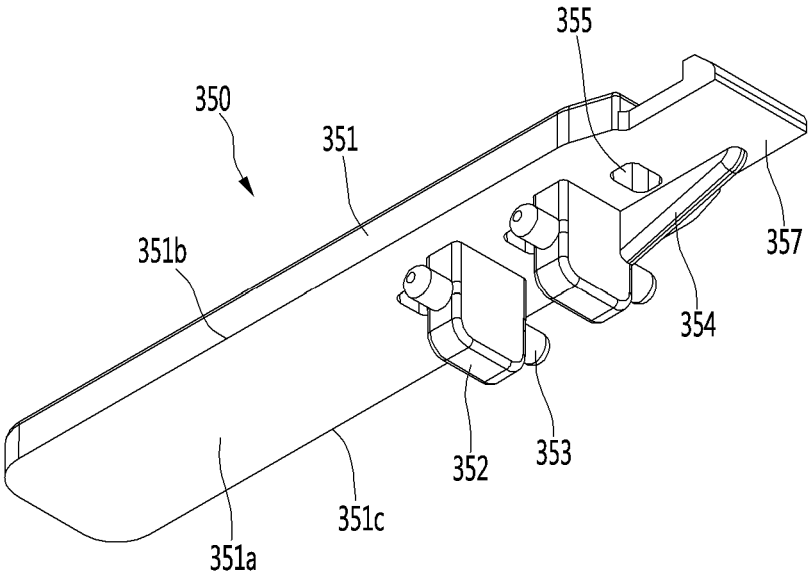
FIG. 39 is a perspective view of a PCB connector of the present invention.

FIG. 35 is a perspective view of the main PCB unit according to an embodiment of the present invention, FIG. 36 is a front view of the main PCB unit shown in FIG. 35, FIGS. 37 and 38 are exploded perspective views of the main PCB unit shown in FIG. 35, and FIG. 39 is a perspective view of a PCB connector of the present invention.

In the present invention, a connecting terminal 349*a* is mounted on the connector support 136 of the second body 12, but a PCB connector is shown in FIGS. 35 to 38 for helping clearly understanding the combination relationship with the main PCB.

Referring to FIGS. 35 to 39, the main PCB unit 340 according to this embodiment may include a main PCB 341.

The main PCB 341 may be composed of a plurality of separate PCBs to be disposed inside the second extension 320. That is, the main PCB 341 may include a first PCB 342 and a second PCB 344.

The first PCB 342 and the second PCB 344 may be erect in parallel with each other. The first PCB 342 and the second PCB 344 may be horizontally spaced apart from each other.

One or more connection terminals 348 for connecting the first PCB 342 and the second PCB 344 may be disposed between the PCBs.

The main PCB unit 340 may further include a PCB connector 350 for connecting the first PCB 342 and the second PCB 344 to each other.

The PCB connector 350 can mechanically connect the first PCB 342 and the second PCB 344 to each other.

The PCB connector 350 may include a connector body 351 on which the first PCB 342 and the second PCB 344 may be mounted.

The connector body 351 may be formed in a plate shape. The PCB connector 350 may further include one or more spacers 352 for maintaining the first PCB 342 and the second PCB 344 spaced apart from each other.

The spacers 352 may protrude downward from the bottom 351*a* of the connector body 351.

A coupling protrusion 353 for coupling the first PCB 342 and the second PCB 344 may be formed on both sides of each of the spacers 352. Further, protrusion coupling portions 346 and 347 for coupling the coupling protrusions 353 may be formed at the PCBs 342 and 344. The protrusion coupling portions 346 and 347 may be grooves or holes.

In this specification, the PCB connector 350 and the main PCB 341 combined with each other may be called as a main PCB assembly.

The width of the spacers 352 may be smaller than the width of the connector body 351 so that the connector body 351 can be seated on the tops of the first PCB 342 and the second PCB 344 when the coupling protrusions 353 of the PCB connector 350 are fitted in the protrusion coupling portions 346 and 347 of the PCBs 342 and 344.

Further, the spacers 352 may be spaced apart from the lateral sides 351*b* and 351*c* of the connector body 351.

When the connector body 351 is seated on the tops of the first PCB 342 and the second PCB 344, with the coupling protrusions 353 of the PCB connector 350 fitted in the protrusion coupling portions 346 and 347 of the PCBs 342 and 344, the height of the main PCB unit 340 can be reduced.

The connector body 351 may be spaced apart from the tops of the first PCB 342 and the second PCB 344, with the coupling protrusions 353 of the PCB connector 350 fitted in the protrusion coupling portions 346 and 347 of the PCBs 342 and 344.

Further, when the spacers 352 are spaced apart from the lateral sides 351*b* and 351*c* of the connector body 351, the width of the main PCB unit 340 can be reduced with the coupling protrusions 353 of the PCB connector 350 fitted in the protrusion coupling portions 346 of the PCBs 342 and 344.

When the PCB connector 350 has the spacers 352, the spacers 352 may be spaced apart from each other in the longitudinal direction of the connector body 351.

The PCB connector 350 may include a coupling hook 357 for coupling the handle body 332.

The coupling hook 357 may horizontally extend from the connector body 351.

A reinforcing rib 354 may be formed on the bottom 351*a* of the connector body 351 to prevent damage to the coupling hook 357 when the PCB connector 350 and the handle body 332 are coupled by the coupling hook 357.

Though not limited, the reinforcing rib 354 may protrude from the bottom 351*a* of the connector body 351 and may connect the coupling hook 357 and one or more of the spacers 352 to each other.

If the PCB connector 350 has a plurality of spacers 352, the reinforcing rib 354 may connect the coupling hook 357 and the spacer 352, which is closest to the coupling hook 357 of the spacers 352, to each other.

A light emitting unit 370 for displaying the state of the cleaner 1 may be disposed on any one of the first PCB 342 and the second PCB 344.

For example, the light emitting unit 370 is disposed on the second PCB 344 in FIG. 38. The light emitting unit 370 may include one or more LEDs. For example, in FIG. 38, the light emitting unit 370 includes a plurality of LEDs 371, 372, and 373 spaced apart from each other in the longitudinal direction of the connector body 351.

Though not limited, it is possible to display the remaining capacity of the battery 40 and the intensity of the suction force of the suction motor 20, using the LEDs 371, 372, and 373.

The connector body 351 may include a plurality of light holes 355 for passing the light from the LEDs 371, 372, and 373.

The light holes 355 may be spaced apart from each other in the longitudinal direction of the connector body 351, and when the PCB connector 350 is coupled to the PCBs 342 and 344, the light holes 355 can be aligned with the LEDs 371, 372, and 373.

The spacers 352 are each positioned between two adjacent light holes 355 not to interfere with the light from the LEDs 371, 372, and 373.

According to this configuration, the spacers 352 do not interfere with the light from the LEDs 371, 372, and 373 and also each prevent interference between the light from adjacent two LEDs. That is, the spacers 352 each separate the paths of the light from two adjacent LEDs.

The PCBs 342 and 344 may include extensions 343 and 345, respective, for supporting a power PCB 380 to be described below (see FIG. 43). The extensions 343 and 345 may include inclined surfaces 343*a* and 345*a*, respectively, for supporting at an angle the power PCB 380.

A first connection terminal 349 that is connected to the power PCB 380 (see FIG. 43) may be disposed on any one of the first PCB 342 and the second PCB 344.

For example, the first connection terminal 349 is disposed on a first extension 343 of the first PCB 342 in FIG. 36.

The connecting terminal 349*a* may be connected to any one of the first PCB 342 and the second PCB 344.

For example, in FIG. 35, the connecting terminal 349*a* may be coupled to the second PCB 344. The second PCB 344 may include a cut groove 344*a* to be coupled to the connecting terminal 349*a* when being vertically moved.

Further, the connecting terminal 349*a* may include a first signal terminal 349*b* and a second signal terminal 349*c* spaced apart from the first signal terminal 349*b* so that the second PCB 344 can be fitted on the connecting terminal 349*a*.

The second PCB 344 can be fitted in between the first signal terminal 349*b* and the second signal terminal 349*c*.

One or more of the first PCB 342 and the second PCB 344 may be connected to the handle terminal 90 through a wire (not shown).

The main PCB unit 340 may further include a PCB cover 360 that covers upper portions of the PCBs 342 and 344 and the PCB connector 350.

The PCB cover 360 may include a top portion 361 covering the top of the PCB connector 350 and a pair of side portions 362 and 363 extending downward from both sides of the top portion 361.

The side portions 362 and 363 can cover not only the PCB connector 350, but a portion of the upper portions of the PCBs 342 and 344.

The side portions 362 and 363 can prevent the PCBs 342 and 344 coupled to the PCB connector 350 from horizontally moving in the handle 30.

The PCB cover 360 covers the light holes 355 of the connector body 351. The PCB cover 360 may include a plurality of light transmissive portions 364 so that the light passing through the light holes 355 can pass through the PCB cover 360. The light transmissive portions 364 are the same in number as the light holes 355 and face the light holes 355.

The light transmissive portions 364 may protrude upward from the top portion 361 of the PCB cover 360.

At least the light transmissive portions 364 of the PCB cover 360 may the transparent or translucent.

Figure 40:
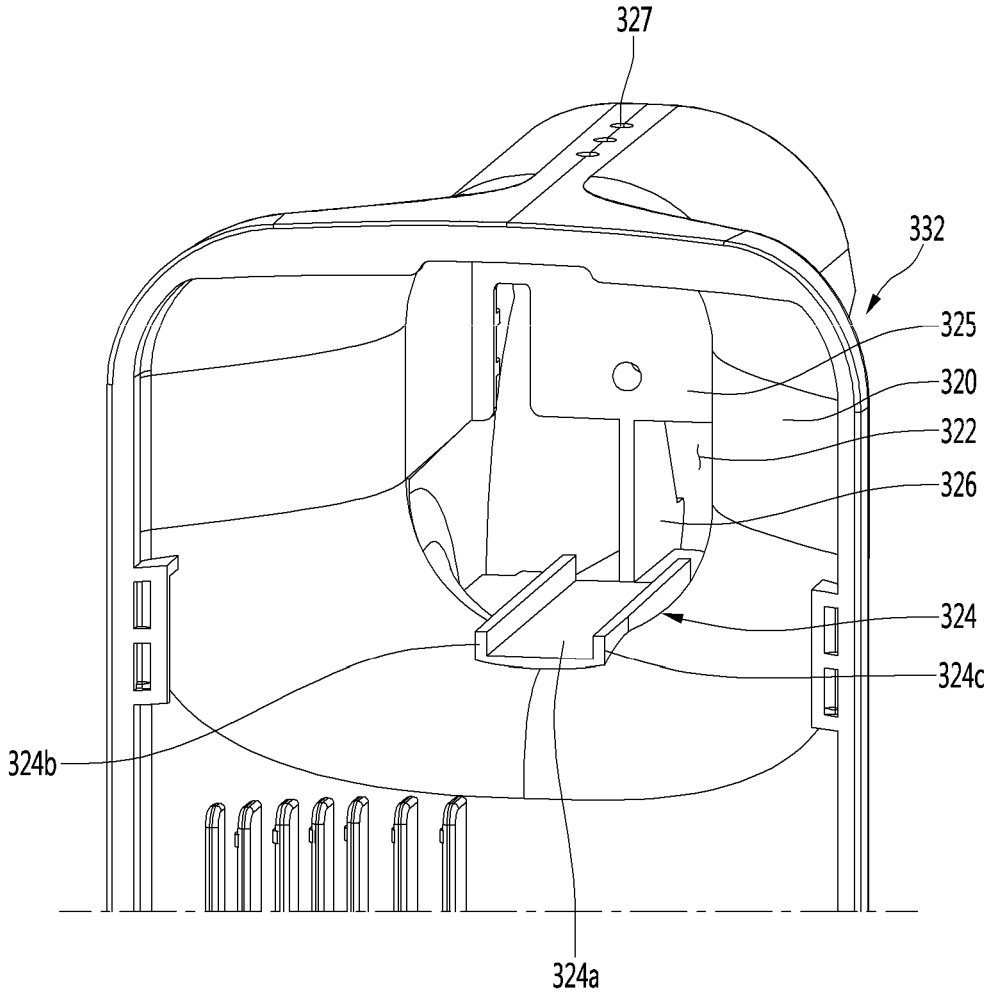
FIG. 40 is a perspective view of a handle body according to an embodiment of the present invention.
Figure 41:
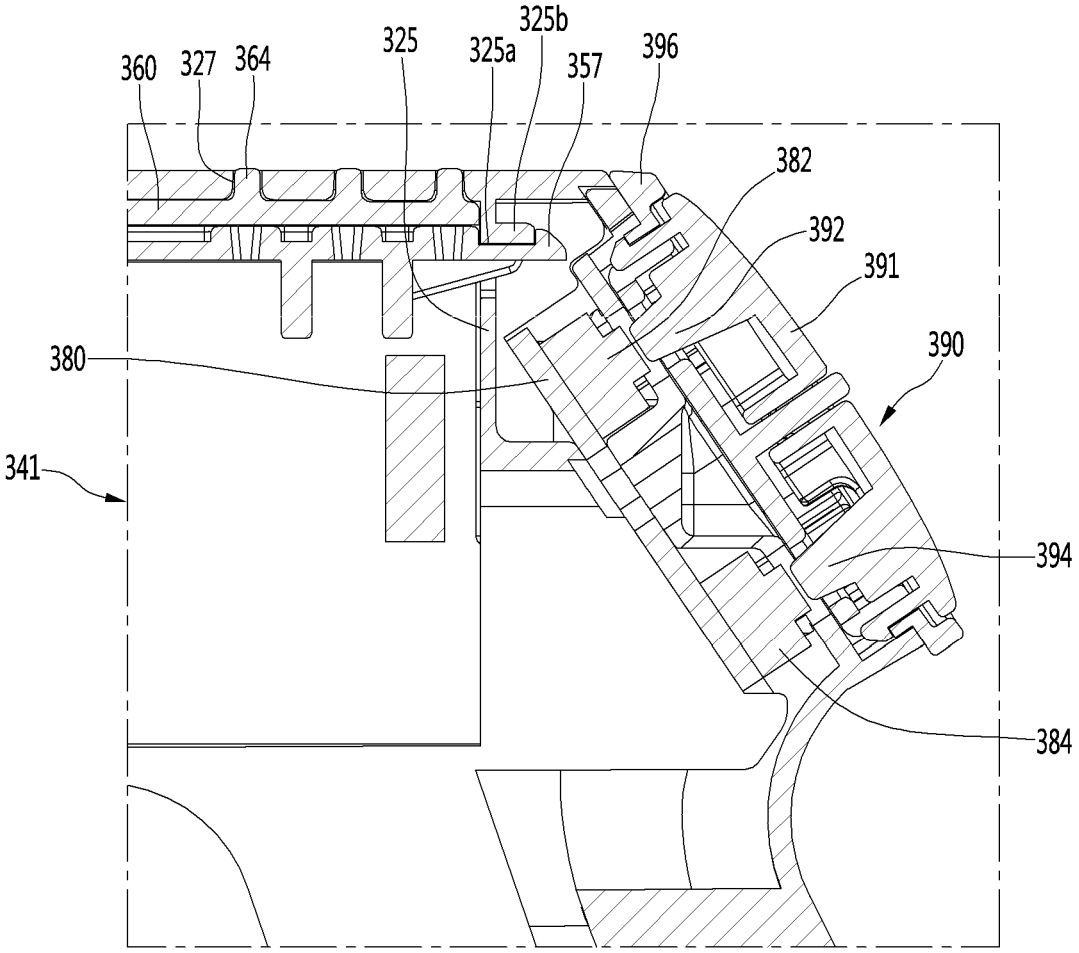
FIG. 41 is a cross-sectional view showing the internal structure of a handle according to an embodiment of the present invention.
Figure 42:
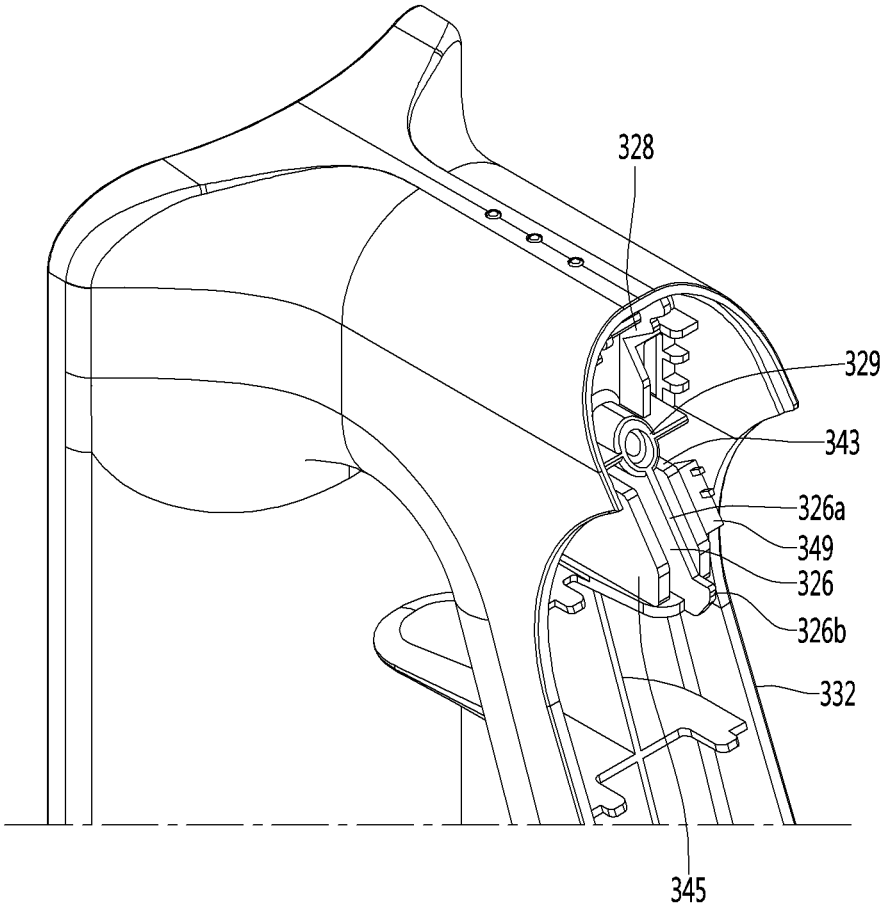
FIG. 42 is a cross-sectional view when the main PCB unit is coupled to the handle body according to an embodiment of the present invention.
Figure 43:
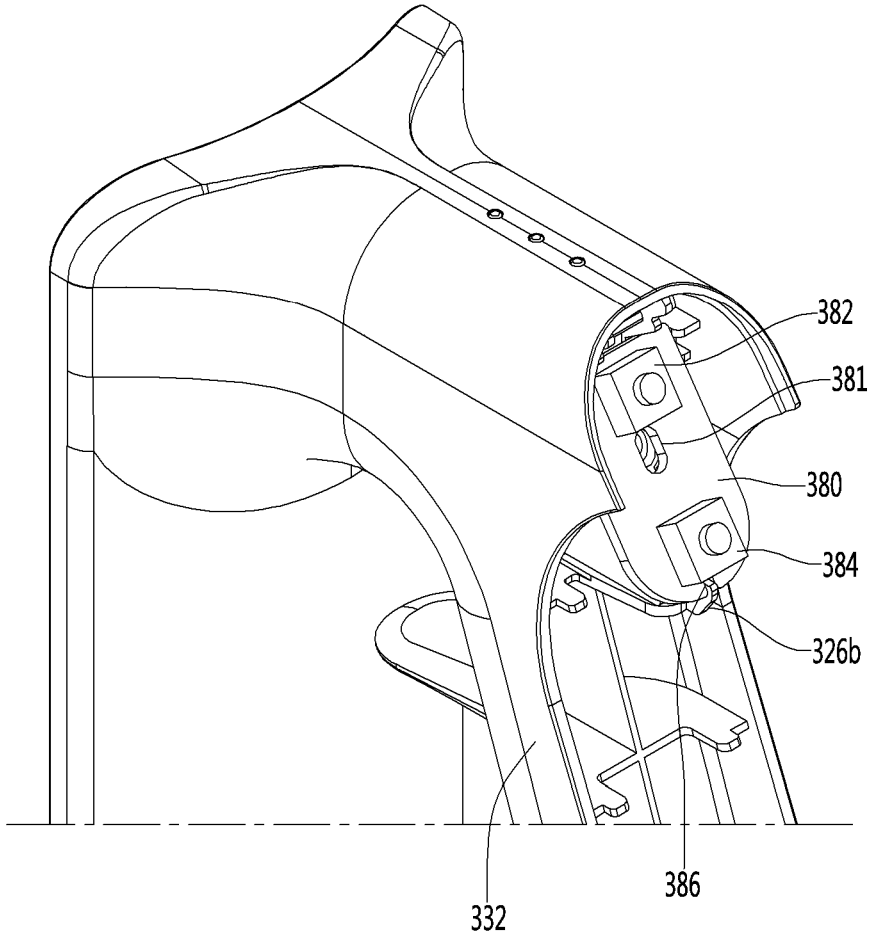
FIG. 43 is a view showing a power PCB seated on a support rib with the main PCB unit coupled to the handle body according to an embodiment of the present invention.
Figure 44:
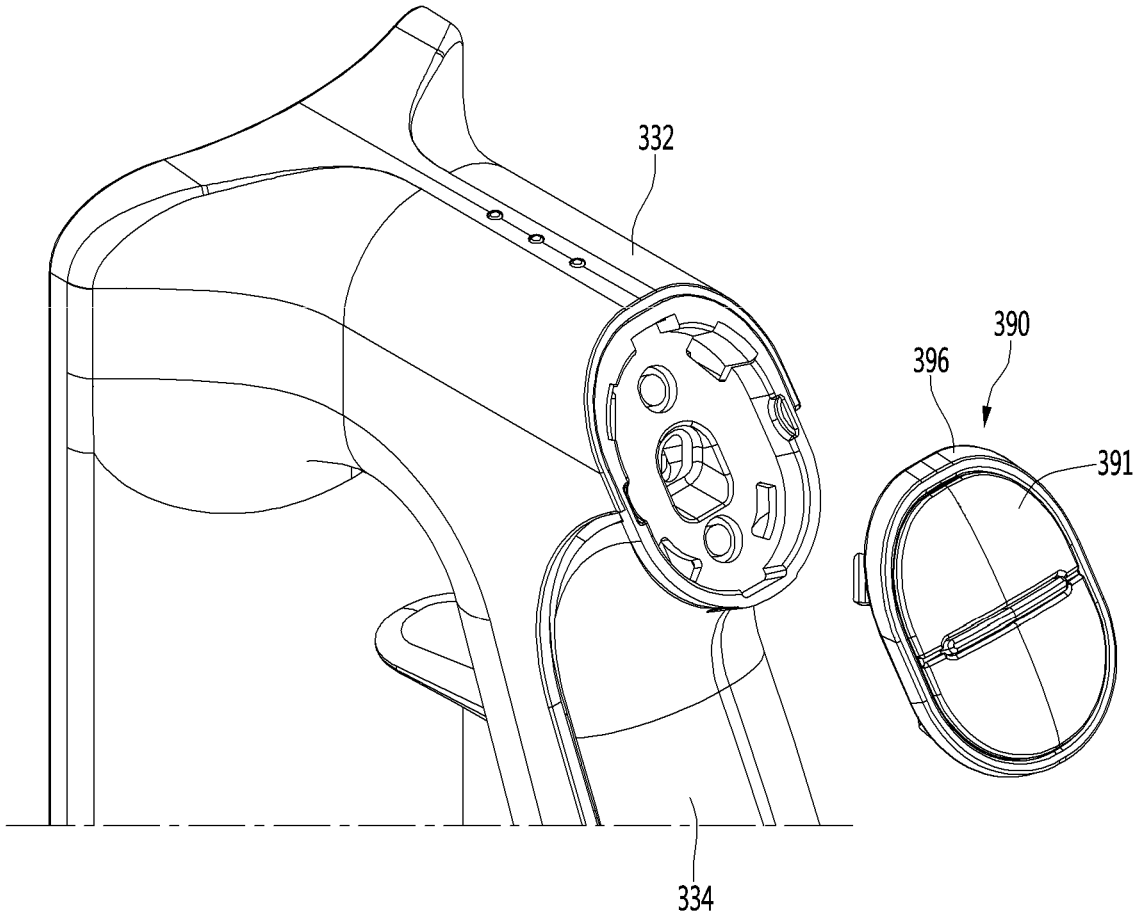
FIG. 44 is a view when a handle cover and an operation unit are combined in the state shown in FIG. 43.

FIG. 40 is a perspective view of the handle body according to an embodiment of the present invention, FIG. 41 is a cross-sectional view showing the internal structure of a handle according to an embodiment of the present invention, FIG. 42 is a cross-sectional view when the main PCB unit is coupled to the handle body according to an embodiment of the present invention, FIG. 43 is a view showing the power PCB seated on the support rib with the main PCB unit coupled to the handle body according to an embodiment of the present invention, and FIG. 44 is a view when the handle cover and an operation unit are combined in the state shown in FIG. 43.

Referring to FIGS. 40 to 44, the handle body 300 may include a first handle body 332 and a second handle body 334 coupled to the first handle body 332.

The first handle body 332 forms a portion of the first extension 310 and a portion of the second extension 320. The second handle body 334 forms the other portion of the first extension 310 and the other portion of the second extension 320.

That is, when the second handle body 334 is coupled to the first handle body 332, the first handle body 332 and the second handle body 334 form the first extension 310 and the second extension 320.

The first handle body 332 may form not only the handle 30, but the outer housing 600.

A space 322 for receiving the main PCB unit 340 may be defined in the first handle body 332. The space 322 is a space substantially defined in the second extension 320.

The first handle body 332 may include a support 324 that supports the main PCB unit 340.

The support 324 may include a seat 324*a* on which the main PCB unit 340 is seated, a first rib 324*b* that supports the first PCB 342 on the seat 324*a*, and a second rib 324*c* that supports the second PCB 344 on the seat 324*a*.

The ribs 324*b* and 324*c* may protrude upward from the seat 324*a*.

The main PCB unit 340 on the support 324 cannot be moved left and right in FIG. 40 by the first rib 324*b* and the second rib 324*c*.

Further, the first rib 324*b* and the second rib 324*c* guide the main PCB assembly that is inserted into the space 322 of the first handle body 332.

The first handle body 332 may further include a plurality of insertion holes 364 for inserting the light transmissive portions 364 of the PCB cover 360.

When being inserted in the insertion holes 327, the light transmissive portions 364 may be exposed to the outside of the handle 30. Accordingly, a user can visually check the light from the LEDs 371, 372, and 373 through the light transmissive portions 364.

In this embodiment, since the light transmissive portions 364 are inserted in the insertion holes 327, it is possible to prevent external moisture or dirt from flowing to the main PCB 341 through the insertion holes 327.

The first handle body 332 may further include a connector coupling portion 325 to which the PCB connector 350 is coupled when the main PCB assembly is inserted into the space 322.

The connector coupling portion 325 may include a hole 325*a* for passing the coupling hook 357 of the PCB connector 350 and a hook locking rib 325*b* for locking the coupling hook 357 that has passed through the hole 325*a*.

Meanwhile, the power PCB 380 may include a first switch 382 and a second switch 384 for receiving operation instructions from the operation unit 390. Though not limited, the first switch 382 may receive instructions to turn on/off the suction motor 20 and the second switch 384 may receive instructions to control the intensity of the suction force of the suction motor 20.

The first handle body 332 may further include a support rib 326 for supporting the power PCB 380. The support rib 326 may extend downward from the connector coupling portion 325.

The support rib 326 may include an inclined surface 326*a* so that the power PCB 380 can be positioned at an angle. Accordingly, when the power PCB 380 is supported by the inclined surface 326*a*, the first switch 382 and the second switch 384 are at different heights.

When the main PCB unit 340 is coupled to the first handle body 332, the support rib 326 is positioned between the first PCB 342 and the second PCB 344. The support rib 326 is spaced apart from the first PCB 342 and the second PCB 344 in order not to damage the main PCB 341 when the main PCB unit 340 is coupled.

The inclination angle of the inclined surface 326*a* of the support rib 326 may be the same as the inclination angles 343*a* and 345*a* of the extensions 343 and 345 of the PCBs 342 and 344.

Accordingly, the inclined surfaces 343*a* and 345*a* of the PCBs 342 and 344 and the inclined surface 326*a* of the support rib 326 can support the power PCB 380.

Obviously, the inclined surfaces 343*a* and 345*a* of the PCBs 342 and 344 may be spaced apart from the power PCB 380, with the power PCB 380 in contact with the inclined surface 326*a* of the support rib 326.

The first handle body 332 may further include a fitting rib 326*b* passing through the power PCB 380 to prevent the power PCB 380 being in contact with the inclined surface 326*a* of the support rib 326 from moving left and right in FIG. 43. Further, a slit 386 for passing the fitting rib 326*b* may be formed in the power PCB 380.

The fitting rib 326*b* may be formed at the lower portion of the support rib 326. When the power PCB 380 is seated on the inclined surface 326*a* of the support rib 326, the fitting rib 326*b* is fitted in the slit 386, so it is possible to prevent the power PCB 380 from sliding down on the inclined surface 326*a* of the support rib 326 in the process of assembling the power PCB 380.

The first handle body 332 may further include a top stopper 328 for preventing the power PCB 380 on the support rib 326 from moving up.

The first handle body 332 may further include a fastening boss 329 for fastening the power PCB 380 on the support rib 326 using a fastener (not shown) such as a screw.

A hole 381 for passing the fastener may be formed through the power PCB 380.

On the other hand, the operation unit 390 may include a support frame 396 for coupling to the second handle body 334 and an operation button 391 combined with the support frame 396.

The operation button 391 may include a first pushing portion 392 for pressing the first switch 382 and a second pushing portion 394 for pressing the second switch 384. That is, one operation button 391 may include two pushing portions 392 and 394.

According to the present invention, since the power PCB 380 is inclined with the first switch 382 and the second switch 384 at different heights, a user can hold the handle 30 and press the first switch 382 or the second switch 384 by operating the operation button 391 with one finger. Accordingly, the user can more conveniently operate the cleaner.

A process of assembling the main PCB unit 340 and the power PCB 380 is described hereafter.

First, the PCB cover 360 is inserted into the space 322 of the first handle body 332 such that the light transmissive portions 364 of the PCB cover 360 are inserted into the insertion holes 327 of the first handle body 332.

The main PCB assembly is completed by connecting the first PCB 342 and the second PCB 344 through the PCB connector 350 and then the main PCB assembly is inserted into the space between the PCB cover 360 and the support 324 of the handle body 332.

When the main PCB assembly is inserted, the side portions 362 and 363 of the PCB cover 360 and the first and second ribs 324*b* and 324*c* of the support 324 guide the main PCB assembly.

When the coupling hook 357 of the PCB connector 350 is locked to the hook locking rib 325*b* through the hook hole 325*a* while the main PCB assembly is inserted into the space 322 of the first handle body 332, coupling of the main PCB assembly is completed.

In this state, as in FIG. 43, the power PCB 380 is seated on the support rib 326 and then the power PCB 380 may be fixed to the first handle body 332 by a fastener.

The power PCB 380 is fixed to the first handle body 332 substantially at the same height as the main PCB 341.

Next, as in FIG. 44, the second handle body 334 is coupled to the first handle body 332 and then the operation unit 390 may be coupled to the second handle body 334.

According to the present invention, the main PCB 341 is divided into two PCBs and inserted in the first handle body 332, and the size of the main PCB 341 can be reduced.

In particular, the two PCBs are erect in parallel with each other and inserted in the handle body, the size of the main PCB unit 340 can be minimized.

Further, since the main PCB assembly can be coupled to the first handle body 332 while it is inserted into the space 322 of the first handle body 332 with the two PCBs connected to the PCB connector 350, the structures for fixing the two PCBs to each other and fixing the two PCBs to the first handle body 332 are simple and a user can easily assemble them.

Figure 45:
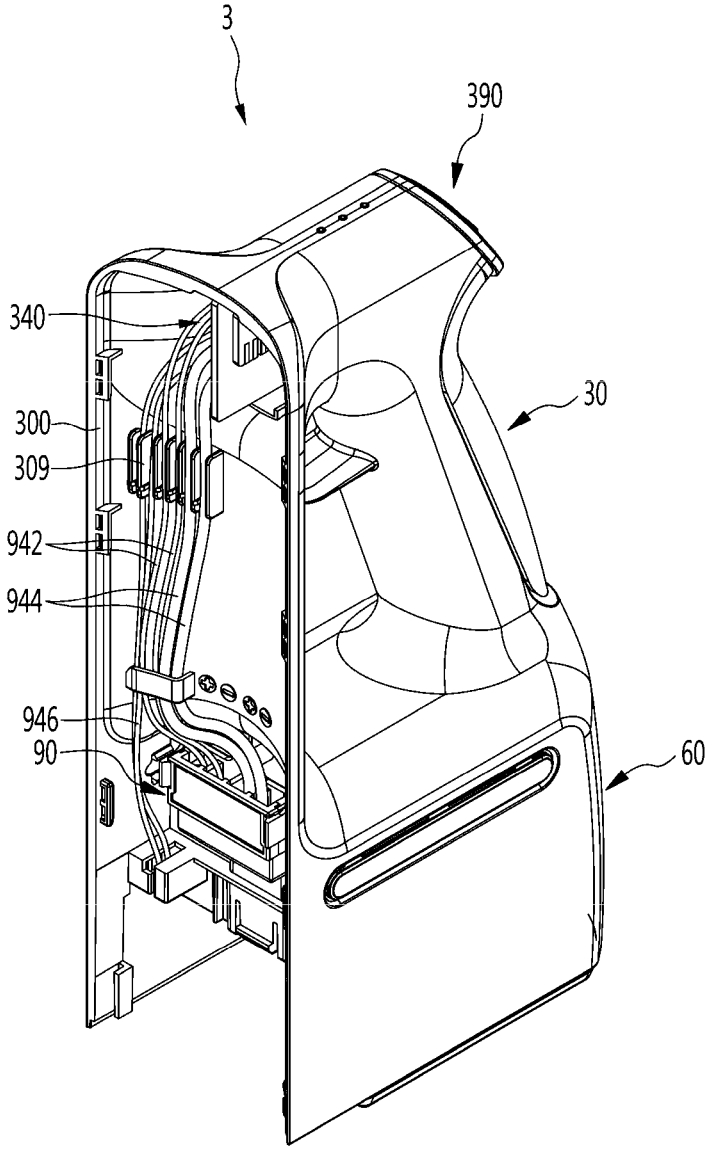
FIG. 45 is a view after the handle terminal and the main PCB unit are installed in the handle unit according to an embodiment of the present invention.
Figure 46:
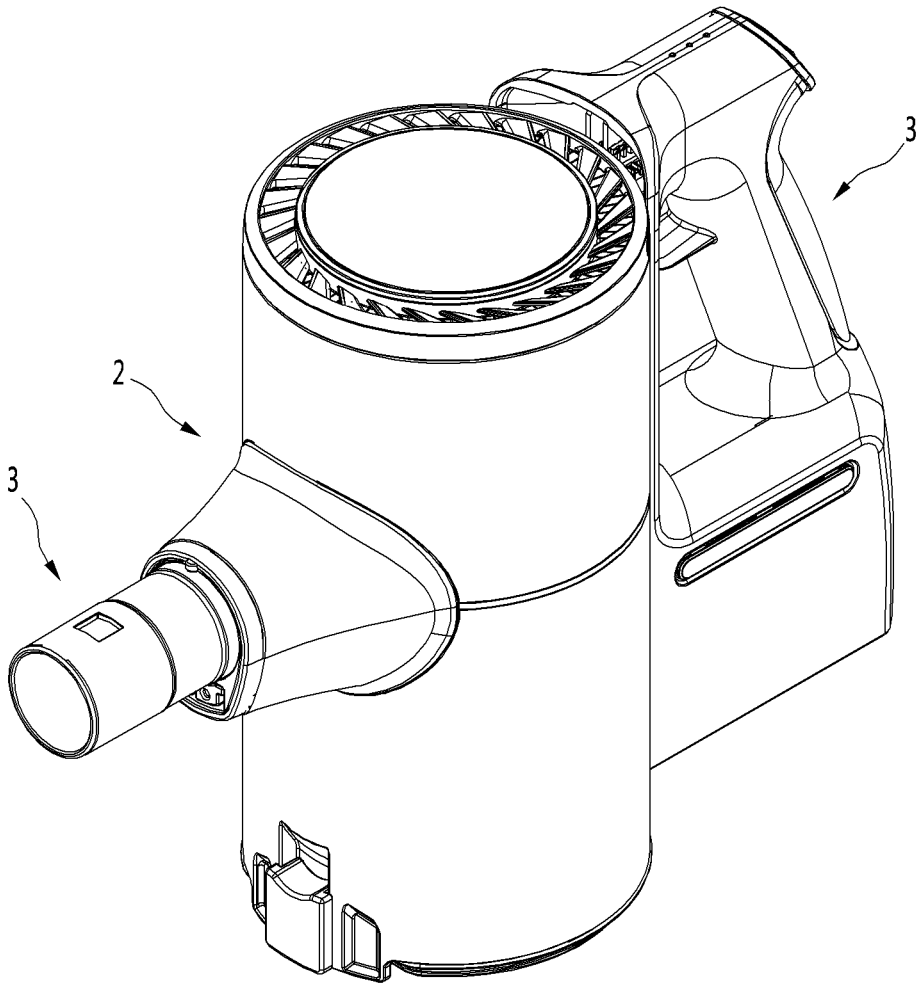
FIG. 46 is a view when the handle unit according to an embodiment of the present invention is coupled to the main body after being assembled.

FIG. 45 is a view after the handle terminal and the main PCB unit are installed in the handle unit according to an embodiment of the present invention and FIG. 46 is a view when the handle unit according to an embodiment of the present invention is coupled to the main body after being assembled.

Referring to FIGS. 45 and 46, the handle 3 can be coupled to the main body 2, with the main PCB unit 340, the operation unit 390, and the handle terminal 90 combined with the handle body 300.

The handle unit 3 may be slide-coupled to the main body 2 without screws. For example, the handle unit 3 can be coupled to the main body 2 by bringing the handle unit 3 in contact with the main body 2 and then sliding down the handle unit 3.

A direction in which the handle unit 3 is coupled to the main body 2 may be referred to as a second coupling direction. The suction unit 5 may be coupled to the main body 2 in a first coupling direction along a first axis, and the handle unit 3 may be coupled to the main body 2 in the second coupling direction along a second axis. The first axis may pass through the main body 2 and cross the second axis. That is, the second coupling direction may cross a first coupling direction in which the suction unit 5 is coupled to the main body 2. The second coupling direction may be substantially perpendicular to the first coupling direction.

According to the present invention, the handle unit 3 is coupled to both of the second body 12 of the main body 2 and the cover member 70.

The handle unit 3 is simultaneously coupled to the second body 12 and the cover member 70.

The handle unit 3 may further include a plurality of handle wires 942, 944, and 946. The handle wires 942, 944, and 946 may be connected to the main PCB unit 340.

The main PCB unit 340 may be connected to the battery 40. Further, the main PCB unit 340 may receive operation signals from the operation unit 390. The main PCB unit 340 may supply power to the suction motor 20 and/or the first terminal 130 or control the intensity of the suction force of the suction motor 20 on the basis of the input operation signals.

The handle wires 942, 944, and 946 may include first handle wires 942 connected to the handle terminal 90 to supply power to the first terminal 139 and second handle wires 944 connected to the handle terminal 90 to supply power to the suction motor 20.

When the handle terminal 90 is connected to the main body terminal 80, the first handle wires 942 may be connected to the first main body wires 171 of the main body 2 and the second handle wires 944 may be connected to the second main body wires 172 of the main body 2.

The handle wires 942, 944, and 946 may further include terminal connection wires 946 connected to the charging stand connection terminals 628.

The handle unit 3 may further include wire guides 309 that guide the handle wires to prevent the handle wires 942, 944, and 946 from getting entangled.

First, a process of coupling the handle unit 3 to the cover member 70 is described.

Figure 47:
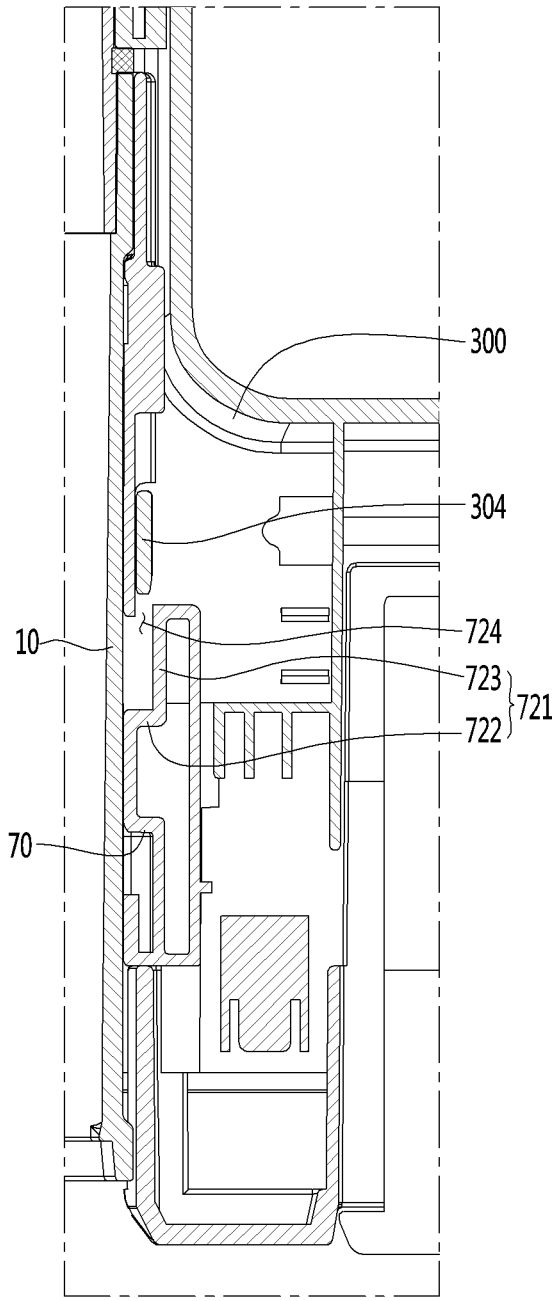
FIG. 47 is a vertical cross-sectional view before the handle unit according to an embodiment of the present invention is coupled to the cover member.
Figure 48:
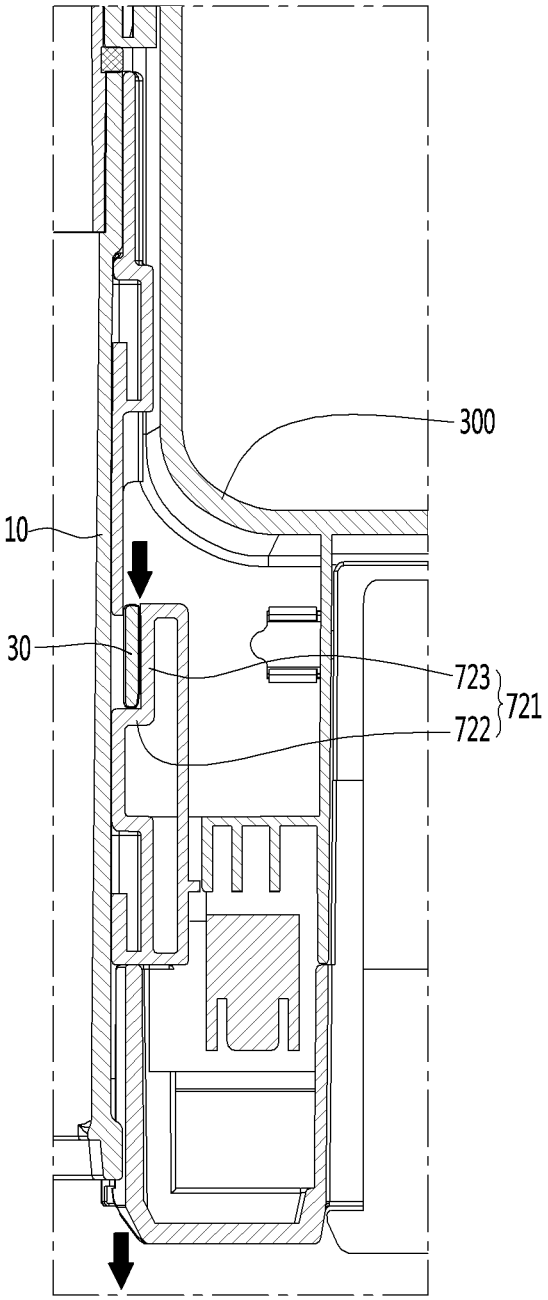
FIG. 48 is a vertical cross-sectional view after the handle unit according to an embodiment of the present invention is coupled to the cover member.
Figure 49:
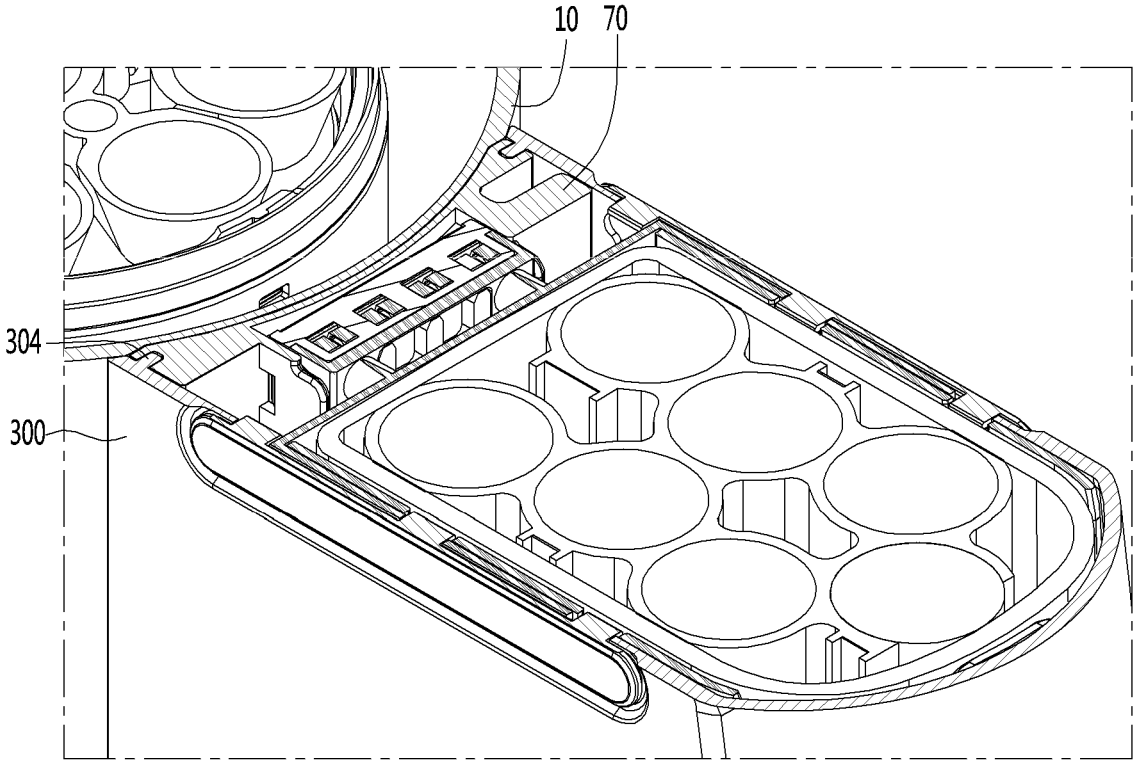
FIG. 49 is a horizontal cross-sectional view after the handle unit according to an embodiment of the present invention is coupled to the cover member.

FIG. 47 is a vertical cross-sectional view before the handle unit according to an embodiment of the present invention is coupled to the cover member, FIG. 48 is a vertical cross-sectional view after the handle unit according to an embodiment of the present invention is coupled to the cover member, and FIG. 49 is a horizontal cross-sectional view after the handle unit according to an embodiment of the present invention is coupled to the cover member.

Referring to FIGS. 25 and 47 to 49, in order to couple the handle unit 3 to the cover member 70, the insertion ribs 302 of the handle unit 3 may be aligned with the insertion openings 724 of the handle coupling portions 721 of the cover body 710.

In this state, when the handle unit 3 is pushed down, the insertion ribs 302 of the handle unit 3 are brought in contact with the first extensions 722 of the handle coupling portions 721 through the insertion openings 724 and locked to the second extensions 723.

Further, the handle hook 303 of the handle unit 3 is locked to the handle hook coupling portion 717 of the cover body 710. Further, the handle terminal 90 is connected to the main body terminal 80. That is, the handle terminal 90 is connected to the main body terminal 80 when the handle unit 3 is pushed down to be coupled to the cover member 70.

The coupling ribs 716*a* of the cover member 70 guide the handle terminal 90 and the main body terminal 80. Further, when the handle terminal 90 is coupled to the main body terminal, the coupling ribs 716*a* can cover portions of both sides of the handle terminal 90.

Therefore, according to the present invention, since the handle terminal 90 and the main body terminal 80 are connected to each other when the handle unit 3 is coupled to the cover member 70, the process of combining the handle terminal 90 and the main body terminal 80 can be removed, so a user can more conveniently combine the terminals.

Since the handle unit 3 is slide-coupled to the cover body 70 by the insertion ribs 302 of the handle unit 3 and the handle coupling portions 721 of the cover member 70, it is possible to stably combine the handle terminal 90 and the main body terminal 80.

Next, a process of coupling the handle unit 3 to the second body 12 is described.

Figure 50:
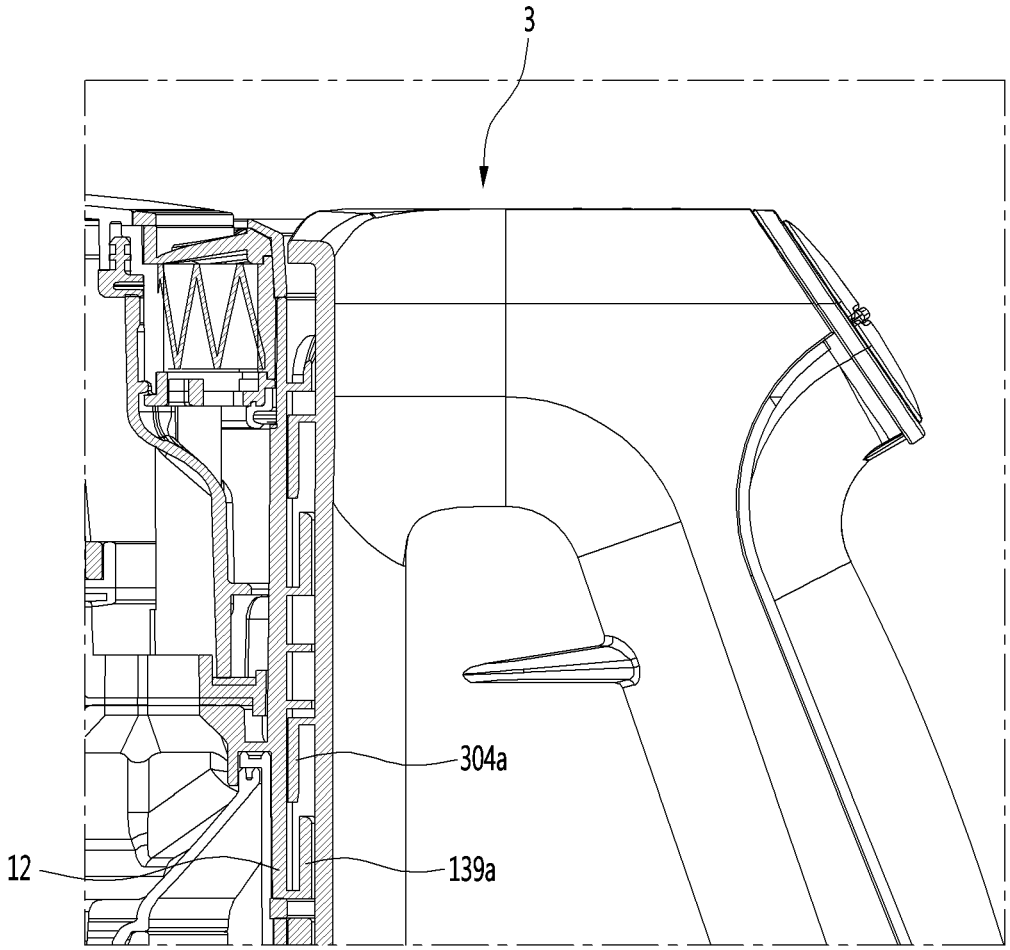
FIG. 50 is a vertical cross-sectional view before the handle unit according to an embodiment of the present invention is coupled to the second body.
Figure 51:
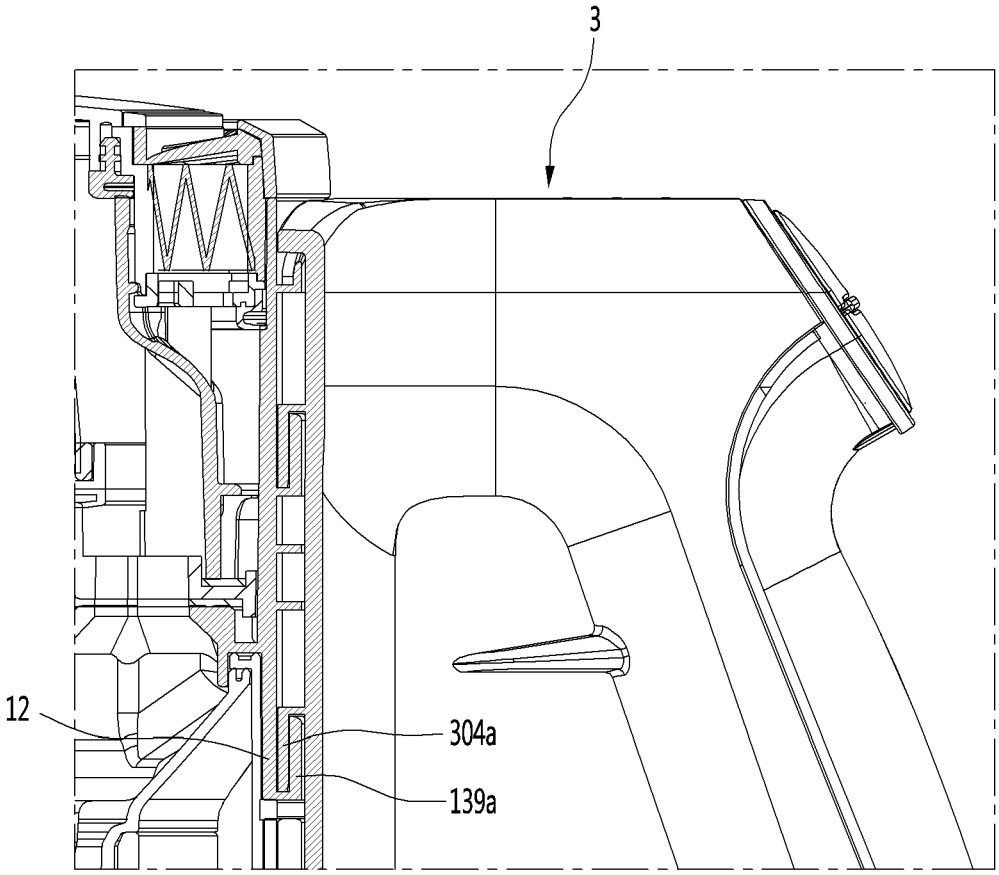
FIG. 51 is a vertical cross-sectional view after the handle unit according to an embodiment of the present invention is coupled to the second body.

FIG. 50 is a vertical cross-sectional view before the handle unit according to an embodiment of the present invention is coupled to the second body and FIG. 51 is a vertical cross-sectional view after the handle unit according to an embodiment of the present invention is coupled to the second body.

Referring to FIGS. 10, 32, 50, and 51, in order to couple the handle unit 3 to the second body 12, the side coupling ribs 304*a* of the handle unit 3 are aligned with the first rib coupling portions 139*a* and the top coupling rib 304*b* is aligned with the second rib coupling portions 139*b*. Further, the second PCB 344 is aligned with the space between the first signal terminal 349*b* and the second signal terminal 349*c* of the connecting terminal 349*a*.

In this state, when the handle unit 3 is pushed down, the side coupling ribs 304*a* are fitted to the first rib coupling portions 139*a* and the top coupling rib 304*b* is fitted to the second rib coupling portions 139*b*. Further, the second PCB 344 is inserted into the space between the first signal terminal 349*b* and the second signal terminal 349*c* of the connecting terminal 349*a* and comes in contact with the signal terminals 349*b* and 349*c*.

According to the present invention, since the second PCB 344 can be connected to the connecting terminal 349*a* only by pushing down the handle unit 3 being in contact with the main body 2, it is possible to reduce the inconvenience that a user has to connect the connecting terminal 349*a* and the main PCB 341 to each other.

Further, since it is possible to couple the handle unit 3 to the main body 2 even without using screws, so the assembly process is simplified.

Figure 52:
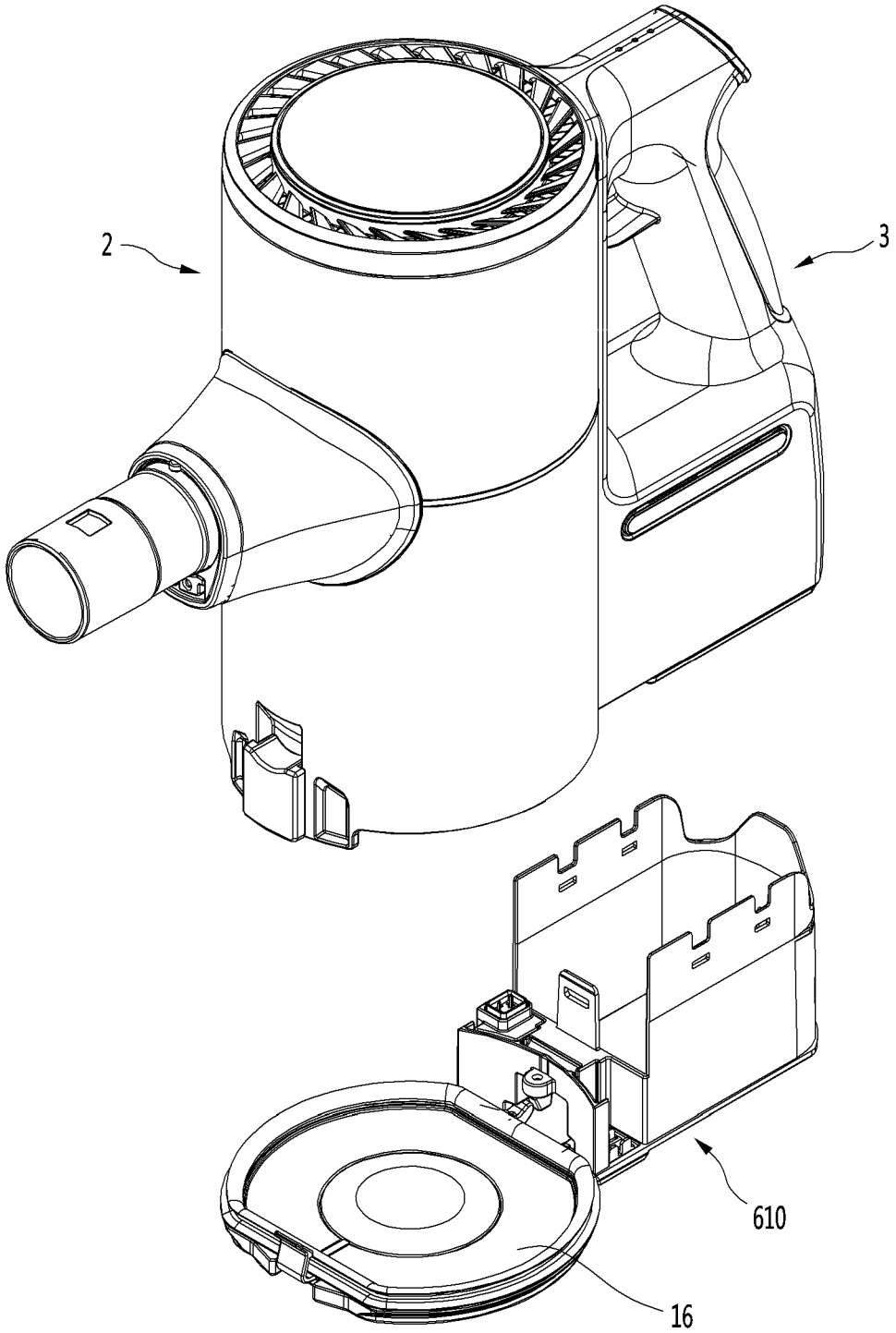
FIG. 52 is a view when an inner housing combined with a body cover according to an embodiment of the present invention is coupled to the main body.
Figure 53:
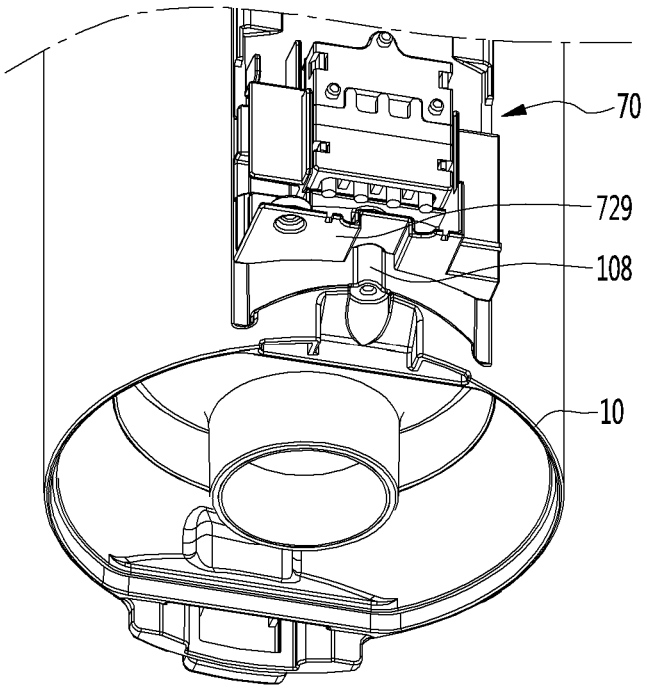
FIG. 53 is a perspective view after the cover member according to an embodiment of the present invention is coupled to the main body.
Figure 54:
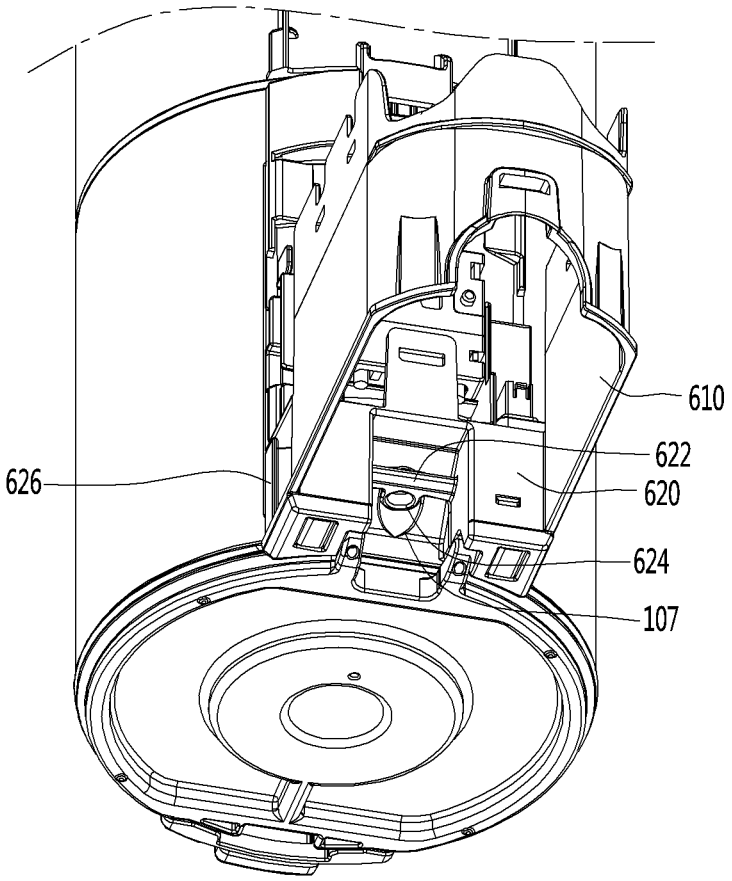
FIG. 54 is a perspective view after the inner housing is coupled to the main body combined with the cover member according to an embodiment of the present invention.
Figure 55:
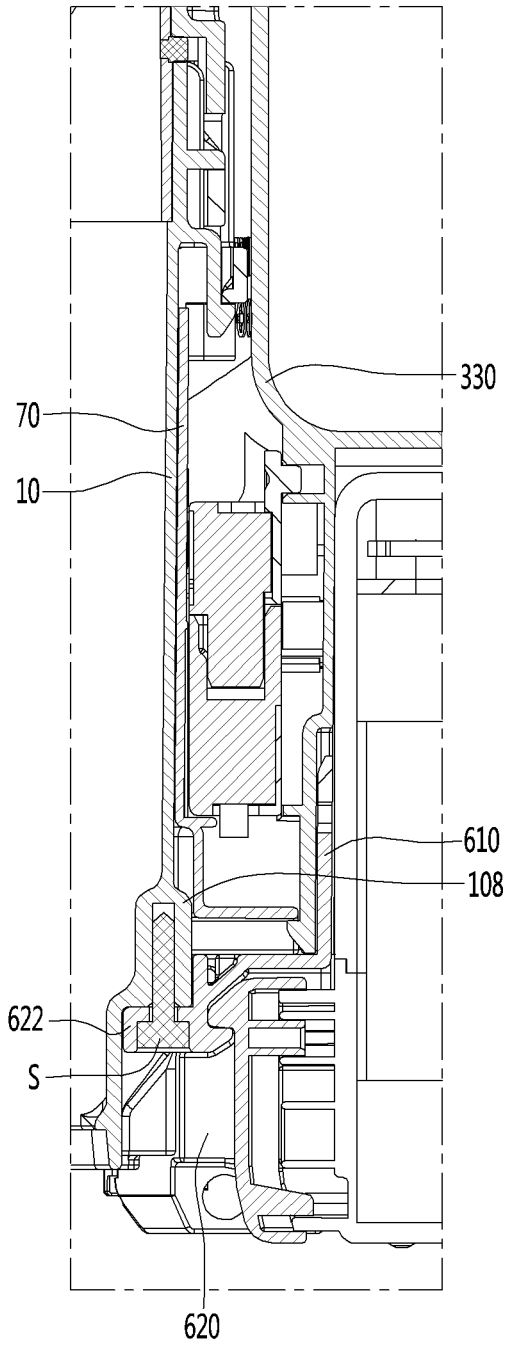
FIG. 55 is a cross-sectional view after the inner housing is coupled to the main body according to an embodiment of the present invention.

FIG. 52 is a view when the inner housing combined with a body cover according to an embodiment of the present invention is coupled to the main body, FIG. 53 is a perspective view after the cover member according to an embodiment of the present invention is coupled to the main body, FIG. 54 is a perspective view after the inner housing is coupled to the main body combined with the cover member according to an embodiment of the present invention.

Referring to FIGS. 52 to 55, it is possible to couple the inner housing 610 combined with the body cover 16 to the main body 2, with the handle unit 3 coupled to the main body 2.

The hinge 162 of the body cover 16 may be coupled to the hinge coupling portions 620 of the inner housing 610.

When the cover member 70 is coupled to the first body 10, the bottom 729 of the cover body 70 is spaced apart from the bottom of the first body 10. Further, the bottom 729 of the cover member 70 is positioned higher than the lower end of the housing fastening portion 108.

A space for the hinge coupling portions 620 of the inner housing 610 is defined between the bottom 729 of the cover body 70 and the lower end of the first body 10.

Accordingly, the inner housing 610 can be received in the outer housing 600 and the hinge coupling portions 620 can be in contact with the bottom 729 of the cover member 70.

A fastening rib 622 for fastening the housing fastening portion 108 of the first body 10 is disposed between the hinge coupling portions 620 of the inner housing 610. The fastening rib 622 connects the hinge coupling portions 620 to each other.

The fastening rib 622 may include a fastening hole 624 for a fastener S.

A portion of the fastening rib 622 is positioned in the guide groove 107 of the first body 10. When being positioned in the guide groove 107, the fastening rib 622 is in contact with the bottom of the housing fastening portion 108.

In this state, it is possible to fasten the fastening rib 622 and the housing fastening portion 108 to each other using the fastener S from under the fastening rib 622.

The inner housing 610 may include rib coupling portions 626 for coupling the housing coupling ribs 308 of the handle unit 3. For example, the rib coupling portions 626 may be formed at the hinge coupling portions 620, respectively.

Accordingly, the inner housing 610 can be coupled to the first body 10 and the handle unit 3.

Figure 56:
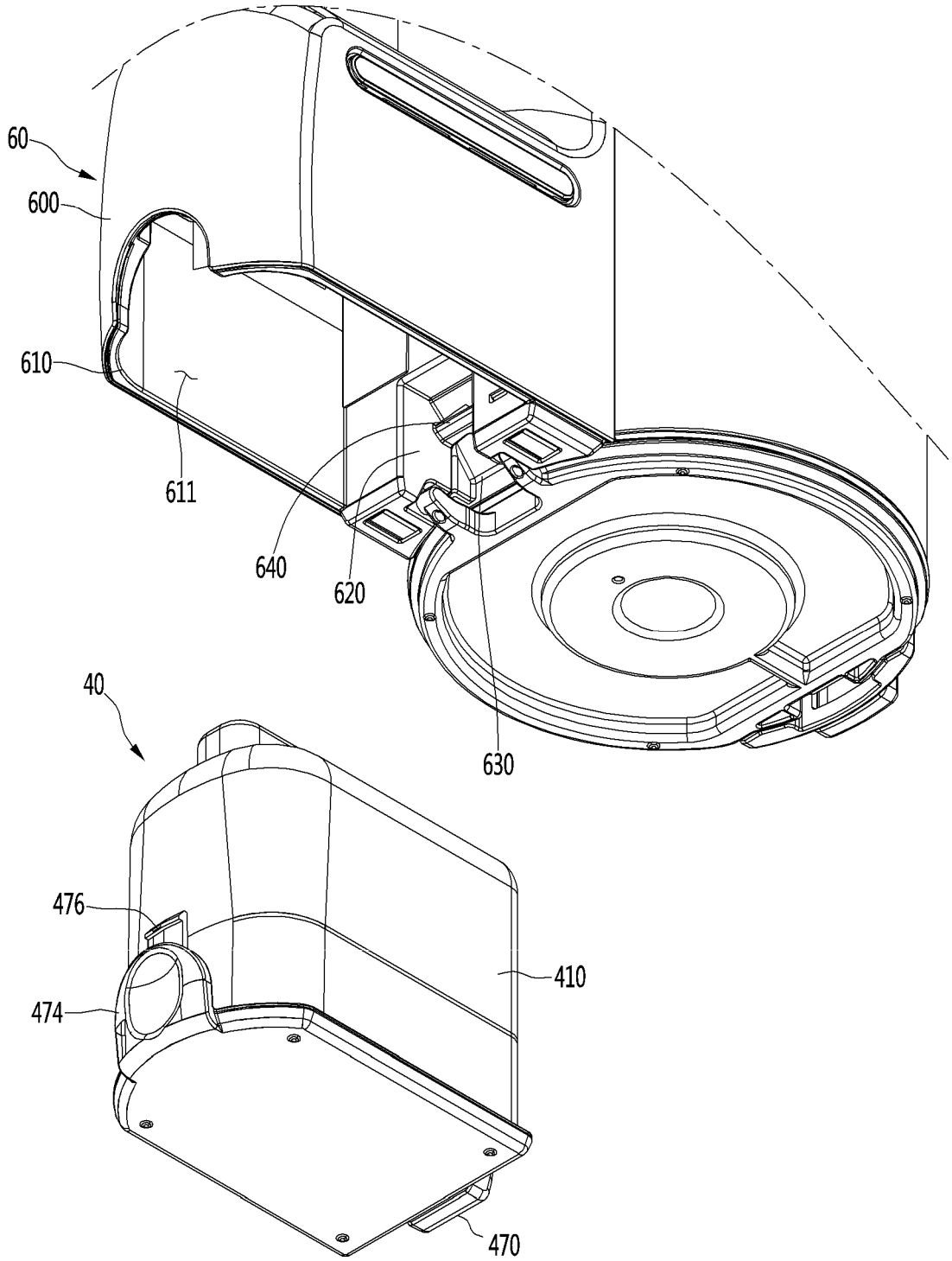
FIG. 56 is a perspective view when a battery is coupled to a battery housing according to an embodiment of the present invention.
Figure 57:
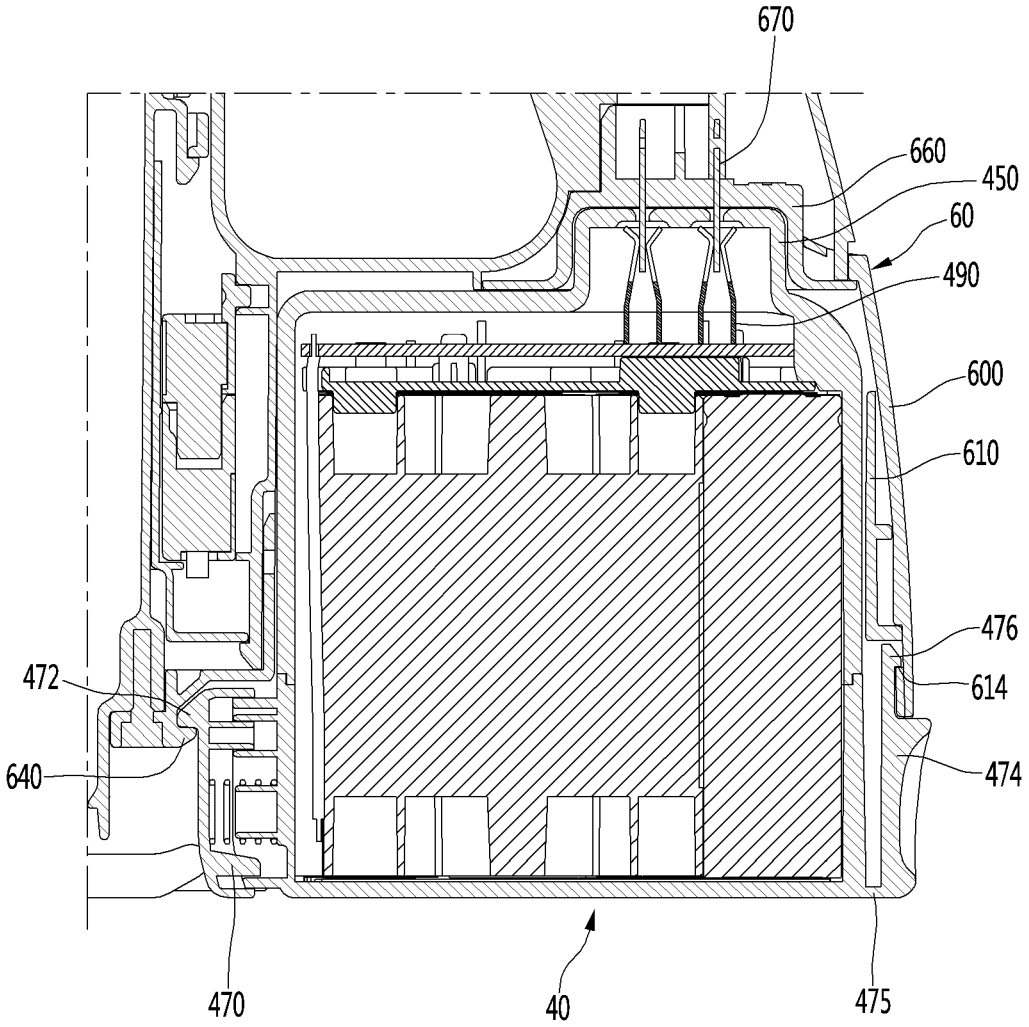
FIG. 57 is a vertical cross-sectional view after the battery is coupled to the battery housing according to an embodiment of the present invention.

FIG. 56 is a perspective view when the battery is coupled to the battery housing according to an embodiment of the present invention and FIG. 57 is a vertical cross-sectional view after the battery is coupled to the battery housing according to an embodiment of the present invention.

Referring to FIGS. 56 and 57, the inner housing 610 provides a battery chamber 611 for receiving the battery 40.

Further, the inner housing 610 may include a locking rib 640 for coupling the battery 40.

The battery 40 may include a plurality of coupling portions 470 and 474. The coupling portions 470 and 474 may include a first coupling portion 470 disposed on a first side of the battery 40 and a second coupling portion 474 disposed on a second side of the frame 410. The first coupling portion 470 and the second coupling portion 474, for example, may be positioned opposite to each other.

The first coupling portion 470 may include a first hook 472. When the battery 40 is coupled, the first hook 472 of the first coupling portion 470 can be locked to the locking rib 640 through the space 622.

The second coupling portion 474 is integrally formed with a frame 410 that forms the outer shape of the battery 40 and can be elastically bent by external force.

An extension 475 horizontally extends from the bottom of the frame 410 and the second coupling portion 474 extends upward from the end of the extension 475.

The second coupling portion 474 is spaced apart from the outer surface of the frame 410 by the extension 475.

That is, a space for bending is defined between the frame 410 and the second coupling portion 474. The second coupling portion 474 can be elastically bent toward the fame 410 by the space.

The second coupling portion 474 may include a second hook 476. The second hook 476 may be thinner than other portion of the second coupling portion 474.

The outer housing 600 has a first exposing hole 602 and the inner housing 610 has a second exposing hole 612 to expose the second coupling portion 474 to the outside so that the second coupling portion 474 can be operated with the battery 40 in the battery chamber 611.

Further, a coupling slot 614 for coupling the second hook 476 of the second coupling portion 474 may be formed over the second exposing hole 612 of the inner housing 610. The coupling slot 614 may be a hole or a groove.

The second hook 476 of the second coupling portion 474 can be inserted into the locking slot 614 when being inserted in the inner housing 610.

A protrusion 450 is formed on the top of the battery 40 and the battery terminals 490 may be positioned in the protrusion 450.

The battery housing 60 may include a receiving portion 660 for receiving the protrusion 450. The receiving portion 660 may include a battery connection terminal 670 for coupling the battery terminals 490. The battery connection terminal 670 may be connected to the main PCB 341.

In this embodiment, since the battery connection terminal 670 passes through the protrusion 450 when the protrusion 450 is inserted into the receiving portion 660, the receiving portion 660 guides the protrusion 450 so that the battery connection terminal 670 can stably pass through the protrusion 450.

In order to separate the battery 40 from the battery housing 60, a user can insert a finger into the space 622 defined between the hinge coupling portions 620.

Further, the user can press the first coupling portion 470 toward the frame 410 with the finger. Accordingly, the first hook 472 of the first coupling portion 470 is unlocked from the locking rib 640.

Further, the user can unlock the second coupling portion 474 from the battery housing 60 by operating the second coupling portion 474 exposed to the outside of the battery housing 60.

In detail, the user presses the second coupling portion 474 toward the frame 410. Accordingly, the second coupling portion 474 is bent toward the frame 410 by the space between the frame 410 and the second coupling portion 474. Therefore, the second hook 476 is pulled out of the coupling slot 614.

As a result, the first coupling portion 470 and the second coupling portion 474 are moved toward each other by a user, whereby they are unlocked.

Accordingly, a user can unlock the first coupling portion 470 and the second coupling portion 474 using two fingers, so the user can easily separate the battery 40 downward from the battery housing 60.

According to the present invention, since the battery 40 can be separated from the battery housing 60, it is possible to place only the battery 40 on the charging stand to charge it.

Figure 58:
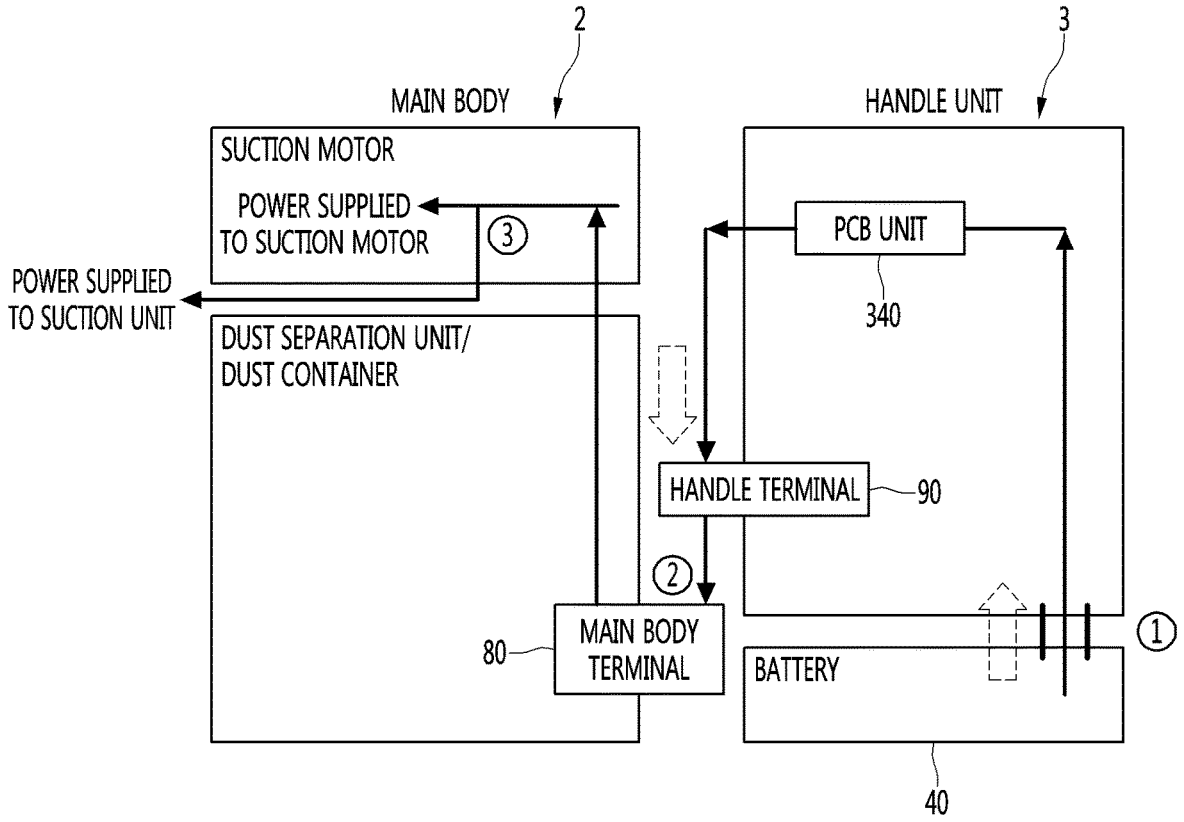
FIG. 58 is a conceptual diagram schematically showing the combination structures of the cleaner of the present invention.

FIG. 58 is a conceptual diagram schematically showing the combination structures of the cleaner of the present invention.

Referring to FIGS. 1 to 58, the present invention may include, as described above, the main body 2, the handle unit 3, and the battery 40.

The cleaner 1 of the present invention have largely three combination structures for power supply.

The first combination structure is the structure for combining the battery 40 and the handle unit 3. The battery 40 is separably coupled to the handle unit 3 in the present invention.

When the battery 40 is coupled to the handle unit 3, the battery 40 is connected to the main PCB unit 340. The battery 40 and the handle unit 3 are combined by mechanically combining the battery terminal 490 and the battery connection terminal 670. Obviously, since the main PCB unit 340 is connected to the battery connection terminal 670 through wires, when the battery terminal 490 and the battery connection terminal 670 are combined, they are electrically connected, so the power from the battery 40 can be supplied to the main PCB unit 340.

The second combination structure of the present invention is the structure for combining the handle unit 3 and the main body 2.

When the handle unit 3 is vertically slide-coupled to the main body 2, with the main PCB unit 340 connected to the handle terminal 90, the handle terminal 90 and the main body terminal 80 are mechanically combined. Obviously, when the handle terminal 90 and the main body terminal 80 are combined, they are electrically connected, so power can be supplied to the main body terminal 80 through the handle terminal 90 from the main PCB unit 340.

The handle unit 3 has the cover coupling portion 301 and the cover member 70 has the insertion openings 724 and the handle hook coupling portion 717 for coupling the cover coupling portion 301. Accordingly, the handle unit 3 can be stably combined with the cover member 70, and in this process, the handle terminal 90 can be accurately coupled to the main body terminal 80. That is, the cover coupling portion 301, the insertion openings 724, and the handle hook coupling portion 717 guide the handle terminal 90 and the main body terminal 80 that are combined with each other, so an assembly error of the handle terminal 90 and the main body terminal 80 is reduced.

Since the handle unit 3 has the body coupling portion 304 and the second body 12 of the main body 2 has the first handle coupling portions **139*a* and 139*b*, the handle unit 3 can be stably combined with the second body 12, and in this process, the handle terminal 90 can be accurately coupled to the main body terminal 80. That is, the body coupling portion 304 and the first handle coupling portions 139*a* and 139*b* also guide the handle terminal 90 and the main body terminal 80 that are combined with each other, so an assembly error of the handle terminal 90 and the main body terminal 80** is reduced.

Further, as described above, the coupling ribs **716*a* for coupling the main body terminal 80 and the terminal support 716*c* for supporting the bottom of the main body terminal 80** are formed on the cover member 70. Accordingly, the main body terminal 80 is not pushed down when the handle terminal 90 is coupled to the main body terminal 80, so the assembly error of the handle terminal 90 and the main body terminal 80 is reduced.

The third combination structure of the present invention is the combination structure among the main body wires electrically connected to the main body terminal 80, the suction motor 20 in the main body 2, and the first terminal 139. This combination structure is an electrically connected structure positioned in the main body 2 and achieved by the main body wires. The power supplied to the main body terminal 80 can be finally supplied to the suction motor 20 and the first terminal 139 by the electrically combined structure.

According to the combination structures of the present invention, air channels are formed only in the main body 2 and are not formed in the handle unit 3.

Accordingly, there is no need for a structure for sealing the boundary between the handle unit 3 and the main body 2 when the handle unit 3 is coupled to the main body 2. Therefore, the structure for coupling the handle unit 3 to the main body 2 is simple and the coupling is easy.

In the present invention, the suction motor 20 and the first terminal 139 receive power from the battery 40, so they may be called power receiving components.

On the other hand, although the main body terminal 80 is mounted on the cover member 70 and the handle terminal 90 is connected to the main body terminal 80 in the embodiments described above, the connecting terminal 349*a* of the second body of the main body may include not only the signal terminal for transmitting control signals of the suction motor 20, but a power terminal for power supply. Accordingly, the main PCB unit 340 may also have the power terminal.

According to this configuration, the main body terminal 80 is removed from the main body 2, the handle terminal 90 is removed from the handle unit 3, and the main PCB unit 340 is connected to the connecting terminal 349*a*, so control signals and power can be transmitted to the suction motor by the main PCB unit 340 and the connecting terminal 349*a* and power can be transmitted to the first terminal 349.

According to the invention, since the main body is assembled, the handle unit is assembled, and the handle unit is slide-coupled to the main body, the process of combining the main body unit and the handle unit using screws is removed, so the cleaner can be more simply assembled.

Further, since the handle terminal is mounted on the handle unit, the main body terminal is mounted on the main body unit, and the main body terminal is coupled to the handle terminal when the handle unit is slide-coupled to the main body, there is no need for a process of separately connecting the terminals.

Further, since the main body has the connecting terminal, the handle unit has the main PCB, and the main PCB is coupled to the connecting terminal when the handle unit is slide-coupled to the main body, there is no need for a process of connecting the main PCB to the connecting terminal.

Further, since the handle terminal and the main body terminal include only power terminals without a signal terminal for controlling the suction motor, it is possible to prevent an increase in size of the handle terminal and the main body terminal.

Further, since the main body terminal is mounted on the cover member and the wires connected to the main body terminal are guided by the cover member, the wires cannot be seen from the outside through the dust container even if the dust container is made of a transparent material or a translucent material.

What is claimed is:

1. A cleaner comprising:

a suction unit that is configured to receive dust and air;

a main body that includes a suction motor and a dust separation unit, the dust separation unit being configured to separate dust from the air received through the suction unit;

a main body terminal that is mounted to the main body and electrically connected to the suction motor;

a handle unit that is slide-coupled to the main body along a handle coupling direction; and a handle terminal that is mounted to the handle unit and configured, based on the handle unit being slide-coupled to the main body, to be electrically connected to the main body terminal along the handle coupling direction.

2. The cleaner of claim 1, wherein the suction unit is configured to couple to the main body in a first coupling direction along a first axis, and the handle unit is configured to couple to the main body in the handle coupling direction along a second axis, the first axis passing through the main body and crossing the second axis.

3. The cleaner of claim 2, wherein the first coupling direction is parallel to a longitudinal axis of the suction unit and perpendicular to the handle coupling direction.

4. The cleaner of claim 1, wherein the main body includes a handle coupling portion, and the handle unit includes a body coupling portion that is configured to be coupled to the handle coupling portion, and wherein the body coupling portion is configured to be fitted to the handle coupling portion based on the handle unit sliding relative to the main body along the handle coupling direction.

5. The cleaner of claim 4, wherein the handle unit further includes a coupling hook, and the main body further includes a hook coupling portion configured to be coupled to the coupling hook, and wherein the handle coupling portion and the hook coupling portion are vertically spaced apart from each other in the main body.

6. The cleaner of claim 5, wherein the main body further includes:

a first body;

a second body connected to the first body; and a cover member coupled to the first body, wherein the main body terminal is mounted on the cover member, wherein the hook coupling portion is located on the cover member, and wherein the handle coupling portion is located on the second body.

7. The cleaner of claim 6, wherein the cover member further includes an additional handle coupling portion, and the handle unit further includes a rib that is configured, based on the cover member being coupled to the handle unit, to be coupled to the additional handle coupling portion.

8. The cleaner of claim 6, wherein the cover member is configured to be slide-coupled to the main body in a direction opposite the handle coupling direction.

9. The cleaner of claim 6, wherein the first body and the second body are connected to each other in a vertical direction, wherein the first body includes a first coupling portion, and wherein the second body includes a second coupling portion that is configured to be coupled to the first coupling portion.

10. The cleaner of claim 6, wherein the cover member includes a plurality of coupling ribs that are spaced apart from each other and configured to support the main body terminal, and wherein the main body terminal is disposed between the plurality of coupling ribs and coupled to the plurality of coupling ribs.

11. The cleaner of claim 6, wherein the cover member includes a terminal support that is configured to support a bottom of the main body terminal.

12. The cleaner of claim 1, wherein each of the main body terminal and the handle terminal includes a power terminal configured to supply power.

13. The cleaner of claim 12, wherein the main body further includes a connecting terminal that is spaced apart from the main body terminal and configured to transmit control signals.

14. The cleaner of claim 13, wherein the handle unit further includes a main printed circuit board (PCB) that is connected to the connecting terminal, wherein the connecting terminal includes a first signal terminal and a second signal terminal spaced apart from the first signal terminal, and wherein a portion of the main PCB is configured, based on the handle unit being coupled to the main body, to fit in a space between the first signal terminal and the second signal terminal.

15. The cleaner of claim 14, wherein the connecting terminal is configured to transmit the control signals from the main PCB to the suction motor, and wherein the main body terminal is configured to supply power to the suction motor.

16. The cleaner of claim 1, wherein the main body further includes a first terminal, and the suction unit includes a second terminal that is configured, based on the suction unit being coupled to the main body, to be electrically connected to the first terminal.

17. The cleaner of claim 16, wherein the main body terminal includes a first power terminal configured to transmit power to the suction motor and a second power terminal configured to transmit power to the second terminal of the suction unit.

18. The cleaner of claim 17, wherein each of the first and second power terminals includes a plurality of terminal pins that are horizontally spaced apart from each other.

19. The cleaner of claim 1, further comprising a battery, wherein the battery is configured to be inserted into the handle unit in a direction opposite the handle coupling direction.

20. A cleaner comprising:

a suction unit that is configured to receive air and dust;

a main body that includes a suction motor, the suction motor being configured to generate suction force to thereby suction air and dust through the suction unit;

a main body terminal that is mounted to the main body and electrically coupled to the suction motor through a wire;

a handle unit that is slide-coupled to the main body along a handle coupling direction;

a battery that is separately connected to the handle unit and configured to supply power to the suction motor; and a handle terminal that is mounted to the handle unit and configured to be electrically connected to the battery, the handle terminal being configured, based on the handle unit being coupled to the main body, to be mechanically and electrically connected to the main body terminal along the handle coupling direction.

21. The cleaner of claim 20, wherein the handle unit includes a battery connection terminal that is configured to be electrically connected to a battery terminal of the battery.

22. The cleaner of claim 21, wherein the handle unit includes a main printed circuit board (PCB) unit that is electrically connected to the handle terminal and the battery connection terminal.

23. A cleaner comprising:

a suction unit that is configured to receive dust and air;

a main body that includes a suction motor, a dust separation unit configured to separate dust from the air received through the suction unit, and a connecting terminal configured to transmit control signals to the suction motor;

a handle unit that is slide-coupled to the main body along a handle coupling direction; and a printed circuit board (PCB) unit that is mounted to the handle unit and configured, based on the handle unit being slide-coupled to the main body, to be electrically connected to the connecting terminal along the handle coupling direction.

* * * * *